US010239682B2

(12) United States Patent
Har-Shai et al.

(10) Patent No.: US 10,239,682 B2
(45) Date of Patent: Mar. 26, 2019

(54) PROPELLANT-FREE PRESSURIZED MATERIAL DISPENSER

(71) Applicant: GreenSpense Ltd., Misgav (IL)

(72) Inventors: Gadi Har-Shai, Hod-HaSharon (IL); Adam Schwartz, Haifa (IL)

(73) Assignee: GreenSpense Ltd., Misgav (IL)

( * ) Notice: Subject to any disclaimer, the term of this patent is extended or adjusted under 35 U.S.C. 154(b) by 0 days.

(21) Appl. No.: 14/650,890

(22) PCT Filed: Jan. 16, 2014

(86) PCT No.: PCT/IL2014/050059

§ 371 (c)(1),
(2) Date: Jun. 10, 2015

(87) PCT Pub. No.: WO2014/111939

PCT Pub. Date: Jul. 24, 2014

(65) Prior Publication Data

US 2015/0307258 A1 Oct. 29, 2015

Related U.S. Application Data

(60) Provisional application No. 61/753,433, filed on Jan. 17, 2013, provisional application No. 61/753,428, filed on Jan. 16, 2013, provisional application No. 61/753,424, filed on Jan. 16, 2013.

(51) Int. Cl.
*B65D 83/00* (2006.01)

(52) U.S. Cl.
CPC ..... *B65D 83/0061* (2013.01)

(58) Field of Classification Search
CPC ..... A61M 5/152; B65D 83/0061
See application file for complete search history.

(56) References Cited

U.S. PATENT DOCUMENTS

| | | | |
|---|---|---|---|
| 2,966,282 | A | 12/1960 | Geisler |
| 3,791,557 | A | 2/1974 | Venus, Jr. |
| 3,961,725 | A | 6/1976 | Clark |

(Continued)

FOREIGN PATENT DOCUMENTS

| | | |
|---|---|---|
| CN | 101058650 | 10/2007 |
| CN | 101735493 | 6/2010 |

(Continued)

OTHER PUBLICATIONS

Applicant-Initiated Interview Summary dated May 25, 2016 From the US Patent and Trademark Office Re. U.S. Appl. No. 13/949,456.

(Continued)

*Primary Examiner* — David P Angwin
*Assistant Examiner* — Bob Zadeh

(57) ABSTRACT

A device for dispensing a material under pressure, including at least one elastic portion defining at least one wall of a chamber defining a volume within which the material is to be contained; and at least one non-elastic portion coupled to the at least one elastic portion and affecting a geometry of one or both of the elastic portion and of the chamber; wherein, at least when the material is contained within the chamber, the at least one elastic portion is stretched so as to urge a reduction in volume of the chamber by at least 70%. The non-elastic portion is optionally rigid.

27 Claims, 42 Drawing Sheets

(56) References Cited

U.S. PATENT DOCUMENTS

| | | | | |
|---|---|---|---|---|
| 3,981,415 | A | 9/1976 | Fowler et al. | |
| 3,993,069 | A * | 11/1976 | Buckles | A61J 1/05 604/132 |
| 4,008,831 | A * | 2/1977 | Vidilles | B60K 15/03177 220/666 |
| 4,077,543 | A | 3/1978 | Kulikowski et al. | |
| 4,121,737 | A | 10/1978 | Kain | |
| 4,222,499 | A | 9/1980 | Lee et al. | |
| 4,251,032 | A | 2/1981 | Werding | |
| 4,458,830 | A | 7/1984 | Werding | |
| 4,573,992 | A * | 3/1986 | Marx | A61M 1/0011 128/DIG. 24 |
| 4,574,746 | A | 3/1986 | Keyes, IV et al. | |
| 4,785,972 | A * | 11/1988 | LeFevre | B65D 83/625 222/1 |
| 4,964,540 | A | 10/1990 | Katz | |
| 4,981,238 | A | 1/1991 | Wenmaekers | |
| 5,014,881 | A | 5/1991 | Andris | |
| 5,060,700 | A * | 10/1991 | Wenmaekers | B65D 83/0055 141/114 |
| 5,080,652 | A * | 1/1992 | Sancoff | A61M 5/152 222/103 |
| 5,111,971 | A | 5/1992 | Winer | |
| 5,127,554 | A | 7/1992 | Loychuk | |
| 5,156,309 | A * | 10/1992 | Friedrich | B65D 83/0061 222/135 |
| 5,167,631 | A * | 12/1992 | Thompson | A61M 5/152 222/386.5 |
| 5,303,853 | A | 4/1994 | Nye | |
| 5,372,578 | A * | 12/1994 | Kriesel | A61M 5/152 604/8 |
| 5,409,142 | A * | 4/1995 | Wenmaekers | B65D 83/0061 222/386.5 |
| 5,526,957 | A | 6/1996 | Brown et al. | |
| 5,656,032 | A * | 8/1997 | Kriesel | A61M 5/1409 128/DIG. 12 |
| 5,927,551 | A | 7/1999 | Taylor et al. | |
| 6,407,155 | B1 | 6/2002 | Qian et al. | |
| 6,413,239 | B1 | 7/2002 | Burns et al. | |
| 6,793,090 | B2 * | 9/2004 | Ackerman | B65D 41/22 15/322 |
| 6,818,693 | B2 | 11/2004 | Heinrich et al. | |
| 9,409,698 | B2 | 8/2016 | Har-Shai | |
| 2003/0172801 | A1 * | 9/2003 | Reininger | F15B 15/103 91/1 |
| 2003/0176537 | A1 | 9/2003 | Chaiko | |
| 2005/0027058 | A1 | 2/2005 | Dias et al. | |
| 2005/0103802 | A1 | 5/2005 | Alberg | |
| 2006/0211909 | A1 * | 9/2006 | Anstadt | A61M 1/1068 600/16 |
| 2006/0243741 | A1 | 11/2006 | Schiefer | |
| 2007/0193669 | A1 | 8/2007 | Giannini et al. | |
| 2007/0262091 | A1 * | 11/2007 | Harper | A45D 34/04 222/207 |
| 2007/0267437 | A1 | 11/2007 | Nimmo et al. | |
| 2008/0272145 | A1 | 11/2008 | Nimmo et al. | |
| 2009/0045222 | A1 | 2/2009 | Nimmo et al. | |
| 2009/0047969 | A1 | 2/2009 | Lee et al. | |
| 2010/0133295 | A1 | 6/2010 | Chan et al. | |
| 2011/0060086 | A1 | 3/2011 | Rodgers et al. | |
| 2011/0108574 | A1 | 5/2011 | Nimmo et al. | |
| 2011/0130507 | A1 | 6/2011 | Leu et al. | |
| 2011/0262550 | A1 | 10/2011 | Klofta et al. | |
| 2012/0004347 | A1 | 1/2012 | Ratnayake et al. | |
| 2012/0097706 | A1 | 4/2012 | Nimmo et al. | |
| 2013/0072607 | A1 | 3/2013 | Schwartz | |
| 2013/0345647 | A1 | 12/2013 | Har-Shai | |
| 2014/0031468 | A1 | 1/2014 | Schwartz | |
| 2015/0307258 | A1 * | 10/2015 | Har-Shai | B65D 83/0061 222/212 |
| 2015/0368438 | A1 | 12/2015 | Schwartz et al. | |
| 2016/0340107 | A1 | 11/2016 | Har-Shai | |
| 2017/0260369 | A1 | 9/2017 | Schwartz | |

FOREIGN PATENT DOCUMENTS

| | | |
|---|---|---|
| CN | 102504361 | 6/2012 |
| DE | 4333627 | 4/1995 |
| DE | 19731362 | 1/1999 |
| DE | 102004028734 | 12/2005 |
| DE | 102010018890 | 11/2011 |
| EP | 0248755 | 12/1987 |
| EP | 0300886 | 1/1989 |
| EP | 0324289 | 7/1989 |
| EP | 0178573 | 2/1992 |
| EP | 1026102 | 8/2000 |
| EP | 1851135 | 7/2008 |
| EP | 1984279 | 11/2009 |
| EP | 2188191 | 6/2011 |
| EP | 2129598 | 4/2012 |
| EP | 2188962 | 10/2012 |
| EP | 2509267 | 10/2012 |
| EP | 2597834 | 5/2013 |
| FR | 2242158 | 3/1975 |
| FR | 2608137 | 6/1988 |
| FR | 2707264 | 1/1995 |
| GB | 1463336 | 2/1977 |
| GB | 2209056 | 4/1989 |
| GB | 2262312 | 6/1993 |
| GB | 2278823 | 12/1994 |
| JP | 59-071340 | 4/1984 |
| JP | 03-022558 | 3/1996 |
| JP | 2004-137431 | 5/2004 |
| WO | WO 88/00563 | 1/1988 |
| WO | WO 95/09784 | 4/1995 |
| WO | WO 01/15583 | 3/2001 |
| WO | WO 03/022711 | 3/2003 |
| WO | WO 2004/080841 | 9/2004 |
| WO | WO 2005/113660 | 12/2005 |
| WO | WO 2007/093889 | 8/2007 |
| WO | WO 2010/069341 | 6/2010 |
| WO | WO 2010/085979 | 8/2010 |
| WO | WO 2010/145677 | 12/2010 |
| WO | WO 2011/139545 | 11/2011 |
| WO | WO 2012/117401 | 9/2012 |
| WO | WO 2013/008241 | 1/2013 |
| WO | WO 2014/111939 | 7/2014 |
| WO | WO 2014/111940 | 7/2014 |

OTHER PUBLICATIONS

Communication Pursuant to Article 94(3) EPC dated Jul. 19, 2016 From the European Office Re. Application No. 14705582.6.

Advisory Action Before the Filing of an Appeal Brief dated Nov. 20, 2015 From the US Patent and Trademark Office Re. U.S. Appl. No. 13/949,456.

Communication Pursuant to Article 94(3) EPC dated Jan. 7, 2015 From the European Patent Office Re. Application No. 12714383.2.

Communication Pursuant to Article 94(3) EPC dated Sep. 24, 2015 From the European Patent Office Re. Application No. 12714383.2.

Communication Relating to the Results of the Partial International Search dated Jun. 4, 2014 From the International Searching Authority Re. Application No. PCT/IL2014/050059.

International Preliminary Report on Patentability dated Sep. 12, 2013 From the International Bureau of WIPO Re. Application No. PCT/IL2012/050063.

International Preliminary Report on Patentability dated Jul. 30, 2015 From the International Bureau of WIPO Re. Application No. PCT/IL2014/050059.

International Preliminary Report on Patentability dated Jul. 30, 2015 From the International Bureau of WIPO Re. Application No. PCT/IL2014/050060.

International Search Report and the Written Opinion dated Dec. 20, 2012 From the International Searching Authority Re. Application No. PCT/IL2012/050360.

International Search Report and the Written Opinion dated Jun. 23, 2014 From the International Searching Authority Re. Application No. PCT/IL2014/050060.

International Search Report and the Written Opinion dated Jul. 30, 2012 From the International Searching Authority Re. Application No. PCT/IL2012/050063.

(56) References Cited

OTHER PUBLICATIONS

International Search Report and the Written Opinion dated Sep. 30, 2014 From the International Searching Authority Re. Application No. PCT/IL2014/050059.
Office Action dated Jan. 11, 2016 From the Israel Patent Office Re. Application No. 220867 and Its Translation Into English.
Official Action dated Jun. 12, 2015 From the US Patent and Trademark Office Re. U.S. Appl. No. 13/949,456.
Official Action dated Nov. 14, 2014 From the US Patent and Trademark Office Re. U.S. Appl. No. 13/949,456.
Official Action dated Oct. 21, 2014 From the US Patent and Trademark Office Re. U.S. Appl. No. 14/002,774.
Official Action dated May 24, 2013 From the US Patent and Trademark Office Re. U.S. Appl. No. 13/546,228.
Official Action dated Feb. 27, 2015 From the US Patent and Trademark Office Re. U.S. Appl. No. 14/002,774.
Official Action dated Jul. 30, 2015 From the US Patent and Trademark Office Re. U.S. Appl. No. 14/002,774.
Official Action dated Dec. 31, 2015 From the US Patent and Trademark Office Re. U.S. Appl. No. 13/949,456.
Restriction Official Action dated Sep. 4, 2014 From the US Patent and Trademark Office Re. U.S. Appl. No. 13/949,456.
Ansarifar et al. "Optimising the Chemical Bonding Between Silanised Silica Nanofiller and Natural Rubber and Assessing Its Effects on the Properties of the Rubber", International Journal of Adhesion and Adhesives, 26(6): 454-463, Sep. 2006. Abstract.
Bai et al. "Reinforcement of Hydrogenated Carboxylated Nitrile-Butadiene Rubber With Exfoliated Graphene Oxide", Carbon, 49: 1608-1613, 2011.
Bhattacharya et al. "Tailoring Properties of Styrene Butadiene Rubber Nanocomposite by Various Nanofillers and Their Dispersion", Polymer Engineering and Science, 49(1): 81-98, Jan. 2009.
Das et al. "Nanocomposite Based on Chloroprene Rubber: Effect of Chemical Nature and Organic Modification of Nanoclay on the Vulcanizate Properties", European Polymer Journal, XP025628032, 44(11): 3456-3465, Nov. 1, 2008.
Das et al. "Reinforcement and Migration of Nanoclay in Polychloroprene/Ethylene-Propylene-Diene-Monomer Rubber Blends", Composites Science and Technology, 71: 276-281, 2011.
Huang et al. CN 101735493, Database WPI [Online], Thomson Scientific, XP002725326, Week 201050, Database Accession No. 2010-J38836, 2010. Abstract.
Kim et al. "Fabrication of Aligned Carbon Nanotube-Filled Rubber Composite", Scripta Materialia, XP002678869, 54: 31-35, 2006.
Kim et al. "SBR/Organoclay Nanocomposites for the Application on Tire Tread Compounds" Macromolcular Research. 17(10): 776-784, 2009.
Koo "Closite Additives," Polymer Nanocomposites: Processing, Characterization, and Applications, Chapter 2: pp.16-19, McGraw-Hill: New York, New York (2006).
Lv et al. CN 102504361, Database WPI [Online], Thomson Scientific, XP002725327, Week 201253, Database Accession No. 2012-J53639, 2012. Abstract.
Schwartz "Nanocomposites for Advanced Elastomers", The 4th International Conference on Nanotechnology for the Plastics & Rubber Industries, Ramat Gan, Israel, Feb. 2, 2009, 37 P., Feb. 2009.
Struktol "Struktol® TS 30, Struktol® TS 30-DL, Struktol® TS 35, Struktol® TS 35-DL. Tackifiers and Softeners", Technical Data Sheet, Schill + Seilacher Struktol Company of America, 1 P., 2004.
Zhang CN101058650, Database WPI [Online], Thomson Scientific, XP002725328, Week 200822, Database Accession No. 2008-D03393, 2008. Abstract.
Restriction Official Action dated Dec. 5, 2016 From the US Patent and Trademark Office Re. U.S. Appl. No. 14/761,388. (6 pages).
Communication Pursuant to Article 94(3) EPC dated Jul. 19, 2016 From the European Patent Office Re. Application No. 12714383.2.
Communication Pursuant to Article 94(3) EPC dated Sep. 27, 2016 From the European Patent Office Re. Application No. 14708959.3.
Official Action dated Sep. 21, 2016 From the US Patent and Trademark Office Re. U.S. Appl. No. 13/949,456.
Baharvand et al. "SBR Composites Reinforced with N-Isopropyi-N'-Phenyl-P-Phenylenediamine-Modified Clay",Chinese Journal of Polymer Science, 29(2): 191-196, Published Online Oct. 18, 2010.
Communication Pursuant to Article 94(3) EPC dated Jul. 18, 2017 From the European Patent Office Re. Application No. 14708959.3. (3 Pages).
Official Action dated Oct. 2, 2017 From the US Patent and Trademark Office Re. U.S. Appl. No. 15/230,425. (29 Pages).
Communication Pursuant to Article 94(3) EPC dated Mar. 16, 2017 From the European Patent Office Re. Applicaton No. 12714383.2. (8 Pages).
Communication Pursuant to Article 94(3) EPC dated Mar. 16, 2017 From the European Patent Office Re. Application No. 14705582.6. (9 Pages).
Office Action dated Mar. 15, 2017 From the Israel Patent Office Re. Application No. 220867 and Its Translation Into English. (6 Pages).
Official Action dated Feb. 22, 2017 From the US Patent and Trademark Office Re. U.S. Appl. No. 14/761,388. (34 pages).
Communication Pursuant to Article 94(3) EPC dated Apr. 26, 2018 From the European Patent Office Re. Application No. 14708959.3. (3 Pages).
Office Action dated Apr. 11, 2018 From the Israel Patent Office Re. Application No. 220867 and Its Translation Into English. (4 Pages).
Official Action dated May 22, 2018 From the US Patent and Trademark Office Re. U.S. Appl. No. 14/761,338. (16 pages).
Official Action dated May 23, 2018 From the US Patent and Trademark Office Re. U.S. Appl. No. 15/230,425. (14 pages).
Communication Pursuant to Article 94(3) EPC dated Nov. 6, 2017 From the European Patent Office Re. Application 14705582.6. (7 Pages).
Communication Pursuant to Article 94(3) EPC dated Dec. 8, 2017 From the European Patent Office Re. Application No. 12714383.2. (8 Pages).
Office Action dated Nov. 8, 2017 From the Israel Patent Office Re. Application No. 239990 and Its Translation Into English. (6 Pages).
Official Action dated Oct. 12, 2017 From the US Patent and Trademark Office Re. U.S. Appl. No. 14/761,388. (6 pages).
Communication Pursuant to Article 94(3) EPC dated Jul. 27, 2018 From the European Patent Office Re. Application No. 12714383.2. (6 Pages).
Office Action Dated Aug. 9, 2018 From the Israel Patent Office Re. Application No. 239989 and Its Translation Into English. (6 Pages).
Office Action dated Aug. 28, 2018 From the Israel Patent Office Re. Application No. 239990 and Its Translation Into English. (5 Pages).
Restriction Official Action dated Aug. 15, 2018 From the US Patent and Trademark Office Re. U.S. Appl. No. 15/607,544. (5 pages).
Communication Pursuant to Article 94(3) EPC dated Oct. 10, 2018 From the European Patent Office Re. Application No. 14705582.6. (6 Pages).
Communication Pursuant to Article 94(3) EPC dated Nov. 30, 2018 From the European Patent Office Re. Application No. 14708959.3. (3 Pages).
Official Action dated Dec. 3, 2018 From the US Patent and Trademark Office Re. U.S. Appl. No. 15/230,425. (16 pages).
Official Action dated Dec. 13, 2018 From the US Patent and Trademark Office Re. U.S. Appl. No. 14/761,388. (19 pages).
Official Action dated Nov. 14, 2018 From the US Patent and Trademark Office Re. U.S. Appl. No. 15/607,544. (27 pages).
Priolo et al. "Super Oxygen Barrier of Polymer—Clay Nano Brick Wall Thin Films", Sample 2010, New Materials and Processes for a New Economy, 5 Pages, May 17-20, 2010.

* cited by examiner

| | vulc |
|---|---|
| plate | 10'140 |
| autoclave after extruder | 25'150C |

Creep (%)=(dist after 1 year-25.4)*100/25.4

PROPELLANT-FREE PRESSURIZED MATERIAL DISPENSER

RELATED APPLICATIONS

This application is a National Phase of PCT Patent Application No. PCT/IL2014/050059 having International filing date of Jan. 16, 2014, which claims the benefit of priority under 35 USC § 119(e) of U.S. Provisional Patent Application Nos. 61/753,424 filed on Jan. 16, 2013, 61/753,428 filed on Jan. 16, 2013 and 61/753,433 filed on Jan. 17, 2013. The contents of the above applications are all incorporated by reference as if fully set forth herein in their entirety.

FIELD AND BACKGROUND OF THE INVENTION

The present invention, in some embodiments thereof, relates to a materials dispenser and, more particularly, but not exclusively, to devices for dispensing liquids, pastes, foams, and the like, under pressure.

Aerosol spray cans are known throughout modern society, and are used in a myriad of products found in food stores, pharmacies, tool shops, and more. Fire extinguishers also provide a stream of material under pressure.

Aerosol canisters typically deliver material pressurized to seven or eight bars. A few methods are popular. Single Compartment methods mix a deliverable material with a propellant (a pressurized gas), and spray both through a valve. Dual Compartment methods separate the deliverable material from the propellant to avoid interaction between them, to increase shelf life of the product, and for various other reasons. Some Dual Compartment methods use a bag for deliverable material. Some separate material from propellant using a piston barrier. In both cases a compartment with a compressed propellant is used to pressurize a compartment with a deliverable material, which can then be delivered under pressure through a valve. Practical considerations, and in some jurisdictions also laws and regulations require that containers for aerosol products using a propellant (typically pressurized to 7-8 bars) to be cylindrical in format, for safety reasons. Containers are also required to be metal or of thick glass or of rigid plastic, or in any case to be of sufficient strength and thickness to safely withstand this pressure. If made of metal other than aluminum (which is relatively expensive), containers are usually made out of TinPlate and coated with lacquers or other coatings to prevent them from rusting and releasing the pressure in unintended ways. As a result, aerosol containers are often relatively expensive to make, to transport, and to handle in bulk, are restricted to a standard shape, and are difficult to dispose of in an ecologically desirable manner.

For low pressure dispensing applications, the state of the art is generally that users use manual pressure to pump or squeeze products from containers, for example to get food and suntan lotion out of plastic squeeze bottles, or to get toothpaste and pharmaceuticals out of collapsible tubes, or press on a mechanical pump to deliver the product. In addition to the potential inconvenience attached to the use of many such packages, they suffer from the additional potential disadvantage that air entering such packages interacts with the material therein, reducing shelf life. An additional possible disadvantage is that it is often difficult or impossible to empty them completely, leading to either a messy operation or wastage of products, frustration of users, and/or unnecessary expense.

Additional background art includes U.S. Pat. No. 4,121,737, International Patent Application Publication No. WO9509784, U.S. Pat. No. 4,222,499, DE102004028734, U.S. Pat. No. 5,127,554, International Patent Application Publication No. WO2004080841, U.S. Pat. No. 2,966,282, GB2209056, International Patent Application Publication No. WO0115583, U.S. Pat. No. 3,981,415, EP0248755, FR2608137, U.S. Patent Application No. US2009045222, U.S. Patent Application No. US2006243741, GB2278823, U.S. Pat. No. 4,077,543, FR2707264(A1), U.S. Pat. Nos. 3,791,557, 5,111,971, 4,251,032, 5,927,551, 4,964,540, 5,060,700, 4,981,238, International Patent Application Publication No. WO/2010/145677, International Patent Application Publication No. WO/2010/085979.

SUMMARY OF THE INVENTION

According to an aspect of some embodiments of the present invention there is provided a device for dispensing a material under pressure, comprising: at least one elastic portion defining at least one wall of a chamber defining a volume within which the material is to be contained; at least one non-elastic portion coupled to the at least one elastic portion and affecting a geometry of one or both of the elastic portion and of the chamber; wherein, at least when the material is contained within the chamber, the at least one elastic portion is stretched so as to urge a reduction in volume of the chamber by at least 70%.

In an exemplary embodiment of the invention, the at least one non-elastic portion is rigid. Optionally, the at least one elastic portion is under tension when the chamber is empty of material. Optionally or alternatively, the at least one elastic portion directly applies compressive pressure to the volume. Optionally or alternatively, the at least one rigid portion directly applies compressive pressure to the volume.

In some exemplary embodiments of the invention, for example any of the embodiments as described above, the device comprises an outlet from the chamber defined in the at least one elastic portion. Optionally or alternatively, the device according, comprises an outlet from the chamber defined in the at least one non-elastic portion. Optionally or alternatively, the device, further includes an outlet disposed on the rigid portion.

In some exemplary embodiments of the invention, for example any of the embodiments as described above, the chamber applies a compressive force on the material in a direction which is within 20 degrees of a perpendicular to the outlet, when the material is dispensed from the chamber through the outlet.

In some exemplary embodiments of the invention, for example any of the embodiments as described above, the device further comprises: a valve attached at the outlet; wherein upon opening the valve, material is dispensed from the chamber.

In some exemplary embodiments of the invention, for example any of the embodiments as described above, the chamber is enclosed by the at least one elastic portion and the at least one rigid portion. Optionally, the at least one rigid portion comprises at least two rigid portions and wherein the at least one elastic portion interconnects the at least two rigid portions such that contraction of the at least one elastic portion reduces a separation between the at least two rigid portions. Optionally or alternatively, the at least one elastic portion is in the form of a band around the volume. Optionally or alternatively, the at least one elastic portion is minimally stretched, the at least two rigid portions contact each other to within a distance of 2 mm.

In some exemplary embodiments of the invention, for example any of the embodiments as described above, the chamber is defined between the at least one rigid portion and the at least one elastic portion. Optionally, the at least one elastic portion conforms to at least most of a chamber wall defined by the at least one rigid portion, when the at least one elastic portion is at a most relaxed state thereof.

In some exemplary embodiments of the invention, for example any of the embodiments as described above, the elastic portion is not flat when relaxed. Optionally, the elastic portion is hat-shaped.

In some exemplary embodiments of the invention, for example any of the embodiments as described above, the device further comprises a base on which the device stands. Optionally, the at least one elastic portion is configured to expand, when the chamber is filled, in a direction perpendicular to the base. Optionally or alternatively, the at least one elastic portion is configured to expand, when the chamber is filled, in a direction of the base.

In some exemplary embodiments of the invention, for example any of the embodiments as described above, the chamber is defined by at least two elastic portions facing each other and wherein the at least one rigid portion maintains a shape of the chamber along at least one dimension thereof.

In some exemplary embodiments of the invention, for example any of the embodiments as described above, the rigid portion is reinforced.

In some exemplary embodiments of the invention, for example any of the embodiments as described above, the at least two elastic portions approach each other to less than a distance of 2 mm over at least 50% of their area when the volume is empty.

In some exemplary embodiments of the invention, for example any of the embodiments as described above, the at least one rigid portion defines a volume for the at least two elastic portions to expand into without extending past a bounding geometry defined by at least one the rigid portion, the volume being at least 3 millimeters in a direction of expansion of at least one of the at least two elastic portions.

In some exemplary embodiments of the invention, for example any of the embodiments as described above, the at least one rigid portion is provided in two parts which clamp the at least two elastic portions therebetween.

In some exemplary embodiments of the invention, for example any of the embodiments as described above, the device includes more than one compressible chamber, each including at least one of the at least one elastic portion defining a wall thereof. Optionally, at least two of the chambers have different volume-pressure response curves. Optionally or alternatively, at least two of the chambers have different geometries.

In some exemplary embodiments of the invention, for example any of the embodiments as described above, the device comprises at least one bag for holding the material disposed within the chamber. Optionally, the bag has a geometry matching a geometry of the chamber over at least 70% of a surface of the bag. Optionally or alternatively, the bag includes one or more non-elastic expandable portion. Optionally or alternatively, the bag is reinforced over at least a portion of a surface thereof. Optionally, the reinforcement comprises a rigid section.

In some exemplary embodiments of the invention, for example any of the embodiments as described above, one or more portions of the chamber are covered with a low friction coating.

In some exemplary embodiments of the invention, for example any of the embodiments as described above, the chamber includes a quantity indicator, visible when the device is in use, indicating an amount of the material remaining to be dispensed.

In some exemplary embodiments of the invention, for example any of the embodiments as described above, the device comprises packaging enclosing at least part of the chamber. Optionally, the packaging includes a quantity indicator indicating an amount of the material remaining to be dispensed. Optionally, in any of the above embodiments, the quantity indicator comprises a window.

In some exemplary embodiments of the invention, for example any of the embodiments as described above, the package includes a volume for expansion of the chamber. Optionally or alternatively, the package includes a volume for expansion of the chamber to at least 90% of a designated filling volume. Optionally or alternatively, the package volume has a shape conforming to a shape of the chamber when expanded. Optionally or alternatively, the package is formed as an extension of the at least one rigid portion. Optionally or alternatively, the device comprises a bag support coupled to the package.

In some exemplary embodiments of the invention, for example any of the embodiments as described above, the at least one elastic portion has different resistance to stretching in different directions along a wall of the chamber.

In some exemplary embodiments of the invention, for example any of the embodiments as described above, at least one portion of the at least one elastic portion is non-planar.

In some exemplary embodiments of the invention, for example any of the embodiments as described above, at least one elastic portion has a varying thickness when at rest.

In some exemplary embodiments of the invention, for example any of the embodiments as described above, a portion of at least one elastic portion is reinforced with a non-expanding element.

In some exemplary embodiments of the invention, for example any of the embodiments as described above, one or more of the portions includes an impermeable coating.

In some exemplary embodiments of the invention, for example any of the embodiments as described above, the device comprises at least one impermeable layer between the material and the at least one elastic portion.

In some exemplary embodiments of the invention, for example any of the embodiments as described above, the non-elastic portion is flexible.

In some exemplary embodiments of the invention, for example any of the embodiments as described above, the at least one rigid portion maintains a geometry of the chamber along at least one dimension thereof.

In some exemplary embodiments of the invention, for example any of the embodiments as described above, the chamber is configured to apply a pressure of at least 6 bar.

According to an aspect of some embodiments of the present invention there is provided a device for dispensing a material under pressure, comprising:

at least one elastic portion defining at least one wall of a chamber with a volume;

a package surrounding at least a portion of the chamber and defining at least one quantity indicator indicating a position of at least a part of the chamber which part moves relative to the indicator when the chamber changes in volume.

According to an aspect of some embodiments of the present invention there is provided a device for dispensing material under pressure, comprising:

at least one elastic portion defining at least one wall of a chamber having a geometry;

a bag disposed within the chamber and having a geometry when full, matching a geometry of the chamber, over at least 70% of a surface of the bag, when tension in the elastic portion is uniformly distributed.

According to an aspect of some embodiments of the present invention there is provided a device for dispensing material under pressure, comprising:

at least one elastic portion defining at least one wall of a chamber;

a bag filled with material disposed within the chamber, wherein the bag is sealed at least at one end by a ring.

According to an aspect of some embodiments of the present invention there is provided a device for dispensing material under pressure, comprising:

at least one elastic portion defining at least one wall of a chamber;

a bag filled with material disposed within the chamber, and including at least one reinforced section where the bag is not supported by the chamber.

According to an aspect of some embodiments of the present invention there is provided a device for dispensing material under pressure, comprising:

at least one elastic portion defining at least one wall of a chamber with a volume for holding the material; and at least one non-elastic element attached to or embedded within the at least one elastic portion to interfere with extension of the at least one elastic element in at least one direction.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. In some cases elements in corresponding figures have corresponding numbers, which are not necessarily explicitly described.

In the drawings.

DESCRIPTION OF SPECIFIC EMBODIMENTS OF THE INVENTION

Figure 1:
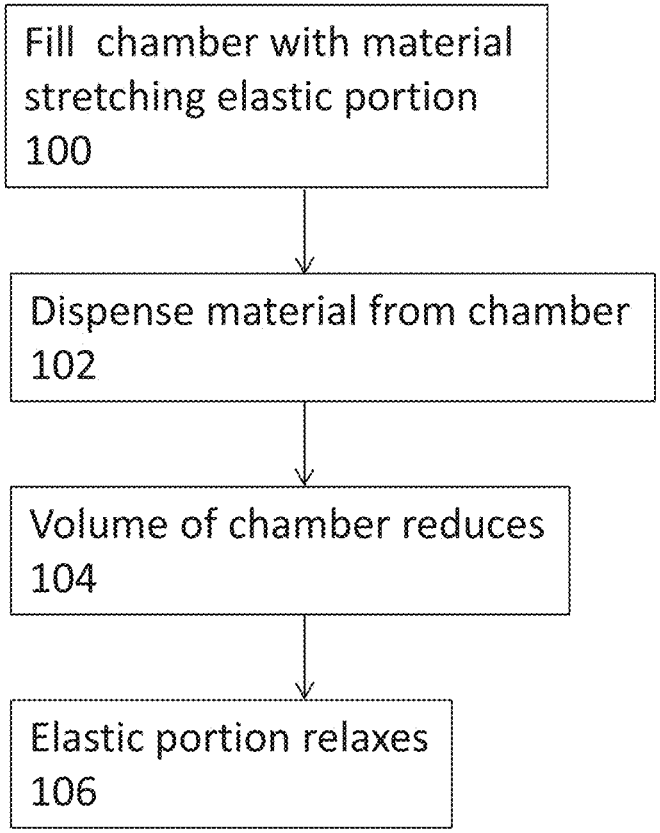
FIG. 1 is a flow chart of a method of dispensing material from a filled product distribution device, according to some embodiments of the invention.

The present invention, in some embodiments thereof, relates to a materials dispenser and, more particularly, but not exclusively, to devices for dispensing liquids, pastes, foams, and the like, under pressure.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Overview

An aspect of some embodiments of the invention relates to a material dispensing structure, for dispensing material under pressure from a chamber, including one or more elastic portion attached to one or more rigid (or otherwise non-elastic) portion where at least the elastic portion defines a wall of the chamber. In some embodiments, the rigid portion defines a shape of the elastic portion and/or the chamber, at least in one dimension, optionally maintain the shape and/or geometry thereof under different conditions of filling of the chamber. In an exemplary embodiment of the invention, stretching the elastic portion (e.g. by filling the chamber with material or product, increasing the chamber volume) creates compressive pressure on the chamber.

In some embodiments, upon dispensing material from the chamber, the elastic portion contracts and/or relaxes, decreasing the chamber volume.

In some embodiments, the material dispensing structure is part of a material dispensing device.

Some embodiments are aerosol dispensers which provide an alternative to prior art aerosol containers, for example, by providing a propellant-free device which stores contents at pressures appropriate for aerosol, and dispenses them through a valve.

In some embodiments the material dispensing structure is placed into and/or housed by a package. In some embodiments, devices do not require tough, metallic, cylindrical containers, a potential benefit being, increased packaging options for product branding and/or differentiation and/or the availability of softer and/or more flexible packaging materials.

In some embodiments, pressure within the chamber is greater than 6 bar when the device is full, for example between 3 and 9 bar, for example between 4 and 8 bar, and for example, between 2.5-6 bar when the device is nearly empty.

In some embodiments, the material is a liquid or paste or foam or powder or mixture or other fluidly deliverable substance.

In some embodiments, devices and/or structures of the invention provide pressurized dispensers and/or containers for dispensing food, cosmetics, creams, ointments, medicines, IV transfusion materials, and other materials, under low pressure (e.g. slightly above ambient atmospheric pressure, or between 1-2 bar, 2-3 bar or 2-4.5 or 2-6 bar), and/or at low delivery rates.

In some embodiments, devices and/or structures of the invention provide pressurized dispensers and/or containers for:

- self-dispensing food containers (e.g. for mayonnaise, ketchup, mustard, sauces, desserts, spreads, oil, pastry components),
- containers for cosmetics such as creams and lotions, skin care products and hair gels,
- industrial/technical applications such as paints, lacquers, glues, grease and other lubricants, sealants, pastes and other viscous materials,
- personal care products such as shaving, shower and shampooing gels, toothpaste, liquid soap and shampoo, sun care products,
- household products such as polishes and glass, bathroom and furniture and other cleaners, insecticides, air fresheners, and for plant irrigation,
- pharmaceutical and medical products such as medications (including dosage packages) and ointments, oral and nasal sprays,
- intravenous and intra-arterial transfusion of blood and/or fluids.

All the above are considered to be within the scope of some embodiments of the invention, however the above list is not to be considered limiting.

Some embodiments provide pressures of between 5-15 bar, useful for example in fire extinguishers and other specialized devices.

In some embodiments, stretching of the elastic portion exerts forces on the rigid portion to which the elastic portion is attached.

In some embodiments, material within the chamber exerts forces on the rigid portion.

In some embodiments, the rigid portion withstands forces applied to it, substantially maintaining a shape thereof, at least in one dimension. In some embodiments, the rigid portion is reinforced, e.g. by fins. A particular benefit of some embodiments of the invention, including a rigid portion which maintains a shape thereof, is the device can be designed to provide an area for labeling and/or advertising (e.g. a wide, flat or gently sloping surface).

In some embodiments, a shape-maintaining rigid portion is designed to be attractive, and/or easy to hold or use, and/or have a shape aiding stacking, and/or have a shape which enables close packing. For example, in some embodiments, material dispensing devices include shapes which pack closely (e.g. flat surfaces, cuboid), for example, for transportation and/or retail display volume efficiency.

In some embodiments the structure is placed inside a package and the rigid portion is designed to closely fit the packaging, a potential benefit being a high volume efficiency (e.g., >50%, 75%, 90% or smaller, or intermediate efficiencies) of material within the package.

In some embodiments, elastic forces of the elastic portion compress the chamber. In some embodiments, one or more chamber wall is defined by rigid portion's. In some embodiments, the rigid portion reactive forces (e.g. against pressurized material) compress the chamber. In some embodiments, compressive pressure on the chamber includes pressure actively applied by the rigid portion. In some embodiments devices, e.g. where one or more chamber wall is defined by a rigid portion, use reduced quantities of elastic material, compared to chambers defined only by elastic portions.

In some embodiments, a chamber is formed between one elastic portion and one rigid portion. In some embodiments a rigid portion surface defining a wall of the chamber is planar and/or an elastic portion surface defining a wall of the chamber is planar. In some embodiments the elastic portion and the rigid portion have approximately the same shape and/or size, e.g., from a top view. In some embodiments, the elastic portion is attached to the rigid portion along a continuous closed path on the elastic portion, e.g. edges of elastic portion and rigid portion are attached. In some embodiments an elastic portion surface defining a wall of the chamber is shaped (e.g., non-planar). In some embodiments, the elastic portion includes ridges and/or thicker areas and/or protruding and/or inlet shapes.

In some embodiments, the chamber is formed between more than one rigid portion and one elastic portion. In some embodiments, during dispensing and/or filling the rigid portions move with respect each other, decreasing and increasing a volume of the chamber, respectively.

In some embodiments, a device includes two rigid portions, connected by an elastic portion. In some embodiments, the rigid portions are approximately the same size and/or shape. In some embodiment, chamber walls defined by the rigid portions are planar, for example, rigid portions are sheets of material (e.g. disks). In some embodiments, the elastic portion is attached at a first edge to a perimeter of a first rigid portion and attached at a second edge to a perimeter of a second rigid portion. Optionally, filling of the chamber stretches the elastic portion, increasing a separation between the rigid portions.

In some embodiments, the chamber is defined by more than one elastic portion. In some embodiments, two elastic portions are attached to a rigid frame, the chamber being the volume enclosed between the elastic portions and, optionally, part of the rigid frame. Optionally, the elastic portions are of similar geometry (e.g. size and/or shape). Optionally, the rigid frame defines a general bounding geometry (e.g., cuboid) and includes one or more hollow area, the elastic portions optionally expanding into the hollow area. In some embodiments, two elastic portions are disposed between two rigid frames, attachment of the two rigid portions closing and/or sealing the elastic portions against each other, the chamber being formed between the two elastic portions.

An aspect of some embodiments of the invention relates to a delivery system in which a chamber is formed, at least in part by an elastic material and does not necessarily include a separate bag for containing a material to be dispensed from the chamber. Such a chamber may be sealed other than an outlet thereof. Optionally, a valve for dispensing the material is attached directly to the chamber. In an exemplary embodiment of the invention, the chamber includes one or more rigid parts and one or more elastic parts. Optionally or alternatively, the chamber includes one or more flexible (non-elastic) parts, instead of or in addition to the rigid parts, which optionally forms part of a wall of the chamber. Optionally, the valve is attached to a rigid part. Optionally or alternatively, the valve is attached to an elastic part thereof. Optionally or alternatively, the valve is attached to a flexible part.

In some embodiments of the invention a flexible non-elastic (e.g., at least in one direction) portion is formed by embedding fibers in an elastic material to limit and/or otherwise interfere with expansion thereof.

In some embodiments, the chamber is formed between more than one elastic portion and more than one rigid portion.

In some embodiments, a plurality of elastic portions have differing elasticity, for example, in some embodiments, one or more elastic part has an elasticity of up to two or up to three times more than that of another elastic part.

In some embodiments a rigid portion and/or an elastic portion includes an outlet connected to a chamber, through which material is dispensed. In some embodiments, a valve is coupled to the device, blocking the outlet. When the valve is opened, material is dispensed from the chamber.

In some embodiments active compressive forces on the chamber are parallel to a direction of dispensing of material through the outlet.

Optionally, the material is contained within a bag disposed inside the chamber and compressive pressure from the structure pressurizes the bag containing the material. In some embodiments, a bag includes or is coupled to a valve, through which, when the valve is opened, material is dispensed out of the bag.

In some embodiments the bag and valve are comprised in a "Bag-on-valve" (herein "BOV") module, a module well known in the art and used in many Dual Compartment aerosol product dispensers. In some embodiments, the well-known "Bag-in-can" (herein "BIC") structure is used.

In some embodiments, the chamber is sealed and/or is impermeable. In some embodiments, one or more part (e.g. elastic portion, rigid portion) includes a coating which is optionally impermeable (e.g. oxygen and/or humidity impermeable). A potential benefit being protection of the material from, for example, atmospheric oxygen. A further potential benefit being use of bags which are permeable and/or not sealed.

In some embodiments, forces on portions defining the chamber from the material therewithin (e.g. pressure of the material) are balanced by compressive forces on the chamber (e.g. elastic force of the elastic portion) meaning a bag therewithin experiences substantially no forces on the bag. A potential advantage being that the bag can be structurally weaker (e.g. thinner, less expensive) than gas pressure container bags of the art.

In some embodiments, the structure includes more than one chamber, each chamber being defined by one or more than one elastic portion and one or more than one rigid portion. Optionally, the chambers of multiple chamber devices have differing geometries (e.g. volume, size, shape). Optionally, pressures applied to different chambers can differ, for example, in some embodiments, one chamber has a thicker elastic portion, applying a higher pressure at that chamber. Optionally, a valve between chambers facilitates a pressure differential between chambers.

In some embodiments, the elastic portion is a sheet of material (e.g., elastomeric). In some embodiments, the elastic portion is a diaphragm. In some embodiments, the elastic portion is an extruded rubber-based (e.g., elastomeric) sleeve.

Optionally, the elastic portion is anisotropic and has, for example, differing elasticity in different directions, e.g. due to reinforcing fibers. In some embodiments, reinforcing fibers prevent and/or reduce elongation anisotropically. For example, in some embodiments, fibers prevent elongation of the elastic portion once the fiber has been stretched to a full fiber length.

In some embodiments, the elastic portion includes areas with different properties, from, for example, different material types, different material thickness, reinforcement.

In some embodiments, the chamber is filled under pressure and elastic portion's are stretched by filling the chamber e.g. through a one way valve. In some embodiments, filling of the chamber is by first stretching the elastic portions/s, then the chamber is filled with material, optionally at atmospheric pressure. In some embodiments, the chamber is stretched by insertion of more than one element and increasing a separation between the elements. In some embodiments, the chamber is stretched by coupling more than one element to the chamber and increasing a separation between the elements.

In some embodiments, a thickness of the elastic portion is 0.1 to 15 mm, or 0.5-7 mm or 1-4 mm. In some embodiments, a thick elastic portion, compressing a sufficiently small chamber (e.g. a filled chamber of less than 3 liters, less than 1 liter, less than 300 ml, less than 100 ml), is able to achieve higher pressures on the chamber. In some embodiments, a thick elastic portion, for example 5-10 mm, 2-20 mm, generates chamber pressures of 5-15 bar.

In some embodiments, a surface of an elastic portion defining a part of a chamber is 0.5-200 $cm^2$, or 1-50 $cm^2$, or 5-20 $cm^2$ or intermediate sizes in area.

In some embodiments, a filled volume of a chamber is 10-300 ml or 0.5-700 ml and, in some embodiments, up to 1 liter or 3 liters or more.

An aspect of some embodiments of the invention relates to an indicator as to the quantity of material within the chamber. Optionally, one or more portion of the device (e.g. container, package, cover, rigid portion) includes a quantity indicator. In some embodiments, the indicator comprises a window (e.g. a hole and/or transparent area) through which a user can ascertain a quantity of material within the device. In some embodiments, the user ascertains material levels by viewing a volume of the chamber, e.g. by viewing a geometry of the elastic portion. In some embodiments, the user ascertains material levels by viewing an indication of a separation, of the chamber from another portion of the device (e.g. package), which changes with material levels: For example, in some embodiments, the chamber retracts as it empties, moving away from a window quantity indicator, the user able to view through the window how close the chamber is to the window.

An aspect of some embodiments of the invention relates to a bag shaped to fit a chamber. In some embodiments, the bag includes one or more expanding (e.g., non-elastic) part.

An aspect of some embodiments of the invention relates to a reinforced bag, optionally allowing the bag to avoid rupture when not supported by a surrounding chamber.

An aspect of some embodiments of the invention relates to a bag constructed from a sheet or sleeve closed by a closing element, e.g. a ring.

An aspect of some embodiments of the invention relates to a reinforced elastic portion. In some embodiments, the elastic portion includes reinforcing fibers.

An aspect of some embodiments of the invention relates to devices including multiple chambers, at least one of which may have a different geometry and/or volume change response to pressure and/or material. Optionally, multiple outlets are provided, one for each of two or more chambers.

For simplicity of exposition, in some cases, reference is made to the "top" and "bottom" of a dispensing device or a component thereof. As used herein, "top" refers to a portion of a device near the outlet and/or valve of the device, and "bottom" refers to the opposite end of the device, so that the "top" and "bottom" of the device are defined with respect to the device structure without reference to the device's temporary position in space.

Method of Dispensing Material

FIG. 1 is a flow chart of a method of dispensing material from a product distribution device, according to some embodiments of the invention. At 100, a chamber of a product distribution device is optionally filled with material, stretching an elastic portion, compressing material within the chamber. In other embodiments, a bag or other object is placed within the chamber while the chamber is stretched. At 102, material is dispensed from the chamber (e.g. through a valve) and, at 104, the volume of the chamber is reduced thereby. At 106, upon reduction of the volume of the chamber, the elastic portion relaxes, at least partially.

Exemplary Single Elastic Portion Structures

In some embodiments, a chamber is defined between a single elastic portion and a single rigid portion.

Figure 2A:
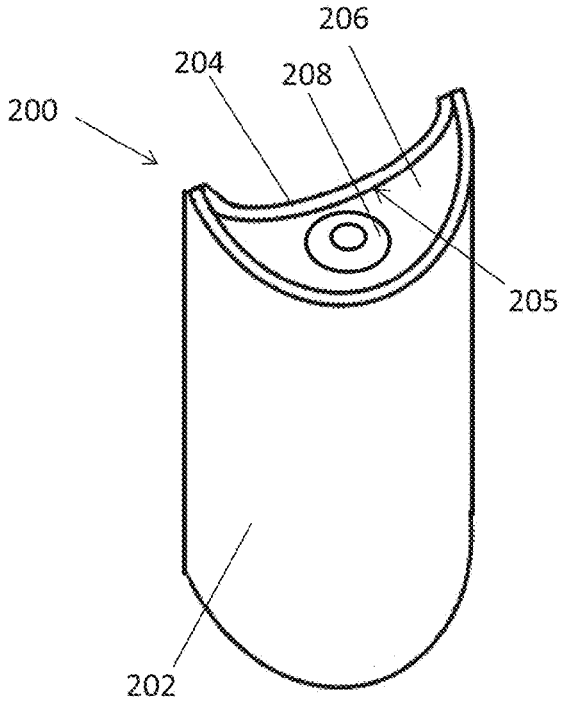
FIG. 2A is a simplified schematic of a filled product distribution device which comprises an elastic portion attached to a rigid portion, according to some embodiments of the present invention.

FIG. 2A is a simplified schematic of a filled product distribution device 200 which comprises an elastic portion 202 attached to a rigid portion 204, according to some embodiments of the present invention. Attachment of elastic portion 202 to rigid portion 204 creates a chamber therebetween. At least when device 200 is filled, elastic portion 202 is stretched and applies compressive pressure to the chamber. Attachment of elastic portion 202 to frame 204 is, for example, by screws, by gluing, by welding, by crimping, by elastic tension, or by any other attachment method. In some embodiments, elastic portion 202 is formed from a sheet of elastic material.

In some embodiments, a surface of a rigid portion and/or a surface of an elastic portion defining a part of the chamber is planar. In some embodiments, a surface of a rigid portion defining a part of the chamber is non-planar, for example convex. A potential benefit of rigid portions including convex parts is increased strength of the curved rigid part. FIG. 2A illustrates a rigid portion 204 including a convex surface 205 defining a wall of the chamber. A further potential benefit of a convex rigid part surface is, for example, the convex part facilitating stretched attachment of the elastic portion to the rigid portion.

In some embodiments, device 200 includes a bag 206 disposed inside the chamber. In some embodiments, bag 206 includes or is attached to a valve 208. Upon opening valve 208, material inside the bag is dispensed. In some embodiments, bag 206 is a classically shaped BOV.

In some embodiments, material is directly contained within the chamber and device 200 does not include a bag. In some embodiments a valve is directly attached to the chamber, for example sealed around an outlet.

In some embodiments, device 200 includes one or more, contractible (e.g. folding and/or elastic) portion which closes the chamber. For example, in some embodiments, element 206 is a contractible closing portion, which is attached to a top of rigid portion 204 and a top of elastic portion 202.

In some embodiments valve 208 is attached to closing portion 206. Alternatively, or additionally, a valve can be attached to elastic portion 202 and/or rigid portion 204. In some embodiments, the valve includes or is coupled to additional spraying and/or dispensing elements, as known in the art of dispensing.

In some embodiments, for example to assist substantially full (e.g. over 80%, over 90%, over 95%, over 99% or greater or intermediate percentages of a full chamber volume) dispensing without pinching of the bag closed around material, device 200 includes a rigid element within the bag. In some embodiments, rigid element is an elongated element standing length-ways inside bag 206 (and/or the chamber). In some embodiments the rigid element prevents the bag from collapse in a direction perpendicular to the direction of dispensing, potentially preventing trapping of material within the bag. In some embodiments, the rigid element is a tube or straw, optionally coupled to valve 208, optionally with holes along the tube length. In some embodiments one or more connection (e.g. hole at tube end, holes along tube length) between the valve and different portions the material within the bag facilitate dispensing of material adjacent to the connection, potentially preventing material from being trapped inside the bag.

Figure 2B:
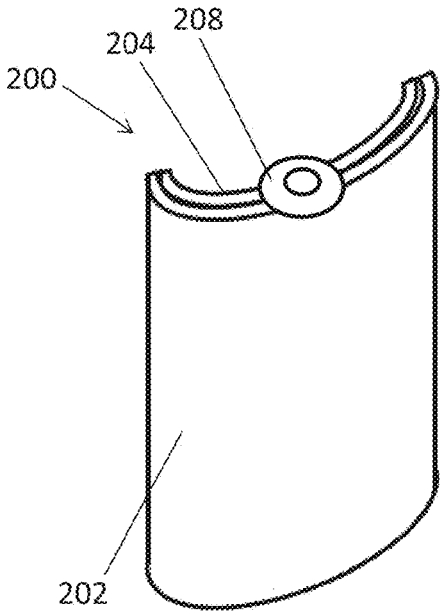
FIG. 2B is a simplified schematic of an empty product distribution device which comprises an elastic portion attached to a rigid portion, according to some embodiments of the invention.

FIG. 2B is a simplified schematic of an empty product distribution device 200 which comprises an elastic portion 202 attached to a rigid portion 204, according to some embodiments of the invention. Optionally, elastic portion 202 is stretched (e.g. in one or more dimension by 10%, by 20%, by 50% or greater or intermediate percentages of a relaxed dimension) even when the chamber between rigid portion 204 and elastic portion 202 is of no or low volume (e.g. less than 10% full, less than 5% full). A potential benefit being that device 200 is able to dispense substantially all (e.g. 80%, 85%, 90%, 95% or greater or intermediate percentages) of the material placed within the chamber. In some embodiments, the stretched elastic portion, applies pressure of up to 2 bar, 3 bar or 5 bar (e.g. to residual material, to the rigid portion) when the chamber is of no or low volume. In some embodiments, dispensing as the device empties (e.g. when chamber is less than 20% full, less than 10% full, less than 5% full, less than 1% full) is at over 2 bar or at over 3 bar or at over 5 bar.

In some embodiments, stretching of the elastic portion controls the movement (e.g. prevents free movement) of the elastic portion during dispensing, potentially preventing the elastic portion from trapping material which is not dispensed (e.g. trapping of material between an elastic portion and a rigid portion).

In some embodiments, during manufacture of devices, the elastic portion is stretched before attachment (e.g. to the rigid portion), and the elastic portion is stretched (e.g. under tension) when the device is empty.

Alternatively, in some embodiments, the chamber has a significant chamber volume (e.g. more than 5% of the filled chamber, more than 10% of the filled chamber, and/or more than 1 ml, more than 10 ml, more than 50 ml, more than 100 ml) when the elastic portion is maximally relaxed.

In some embodiments, bag 206 is contained within the chamber. In some embodiments, valve 208 at least partially protrudes above the chamber e.g. so that elastic portion 202 closes against rigid portion 204 without closing around valve 208.

Figure 2C:
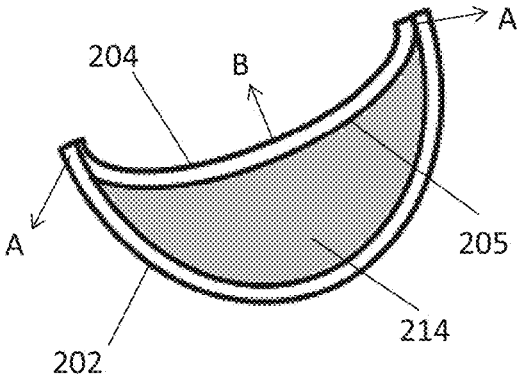
FIG. 2C is a simplified schematic of a cross sectional view of a filled product distribution device showing forces on a rigid portion, according to some embodiments of the invention.

In some embodiments, stretching of the elastic portion generates forces on the one or more rigid portion to which the elastic portion is attached. FIG. 2C is a simplified schematic of a cross sectional view of a filled product distribution device 200 showing forces A and B on a rigid portion 204, according to some embodiments of the invention. FIG. 2C illustrates forces which may act on the structure, in some implementations of the device illustrated in FIGS. 2A-B. Forces A and B act to straighten rigid portion 204 generating both compressive and tensile forces at different areas of rigid portion 204. In some embodiments, rigid portion 204 resists forces A and B and substantially maintains an original shape upon stretching of elastic portion 202. In some embodiments structural strength of rigid portion (and/or another portion of the device) means that the portion sufficiently withstands bending.

In some embodiments, the elastic portion is larger, at least in one dimension, at least when the elastic portion is maximally relaxed, than the rigid portion: Elastic portion 202 is attached around rigid portion 204 and a length of elastic portion 202 is larger than a length of rigid portion 204.

Figure 2D:
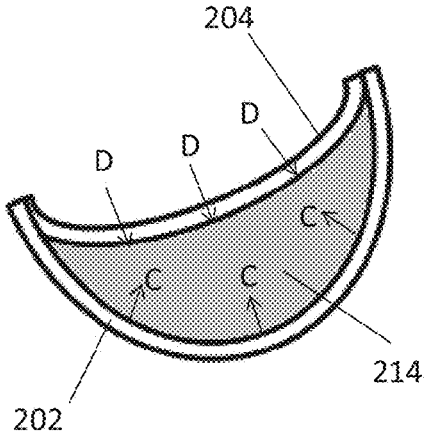
FIG. 2D is a simplified schematic of a filled product distribution device showing forces on a material within the chamber, according to some embodiments of the invention.

FIG. 2D is a simplified schematic of a filled product distribution device 200 showing forces C and D on a material 214 within the chamber, according to some embodiments of the invention. FIG. 2D illustrates forces which may act on the structure, in some implementations of the device illustrated in FIGS. 2A-B. Forces C on material 214 are elastic forces of elastic portion 202. Forces C cause material 214 to press against rigid portion 204, creating reactive forces D from frame 204 on material 214. In the embodiment illustrated in FIGS. 2A-2D the compressive forces on the material, (e.g. forces C and D) are perpendicular to a direction in which dispensed material exits the chamber (perpendicular to the plane of the outlet).

Alternatively, in some embodiments, compressive forces on the material are parallel to a direction in which dispensed material exits the chamber (e.g. in an embodiment where rigid portion 204 includes an outlet, embodiments illustrated in FIGS. 3A-D, FIG. 4, FIGS. 5A-D).

In some embodiments, the device (e.g. device 200) is placed within a package. In some embodiments, valve 208 protrudes outside the package, allowing material to be dispensed without opening the package. Optionally, the package has a similar shape and/or dimension to the device. Alternatively, in some embodiments, a shape and/or dimension of the package can deviate from that of the device, generating one or more empty space. In some embodiments, the device is attached at one or more point to the package. In some embodiments the package includes a removable top which covers the valve.

While element 204 has been described as rigid, it is noted that in some embodiments of the invention, for example, as shown in FIGS. 2A-D or in other embodiments described herein, at least part of a chamber wall (e.g., replacing part or all of element 204 and/or element 202) may be formed of a flexible, non-elastic (e.g., non-stretching) material. For example, polyethylene or nylon may be used. Optionally, such a material is strengthened to resist rupture. In an exemplary embodiment of the invention, such a flexible material will not maintain the shape of the chamber and/or elastic portion when not filled, but may form a wall thereof and/or assist in applying tensile forces between parts of the chamber and thereby affect its structure and/or reaction to internal pressure and/or compressive forces applied by elastic elements.

In some exemplary embodiments of the invention, for example as described herein above or hereinbelow, the percentage of chamber wall (defined by area of wall facing the chamber in a material-free state) formed of rigid material is between 10% and 100% (e.g., the elastic portion may lie outside the chamber when the rigid portions meet), for example, between 20% and 80%, for example, between 30% and 50%, or intermediate or larger or smaller percentages.

In some exemplary embodiments of the invention, for example as described herein above or hereinbelow, the percentage of chamber wall (defined by area of wall facing the chamber in a material-free state) formed of elastic material is between 10% and 100% (e.g., the entire chamber may be formed of elastic material (optionally absent a valve portion thereof)), for example, between 20% and 80%, for example, between 30% and 50%, or intermediate or larger or smaller percentages.

In some exemplary embodiments of the invention, for example as described herein above or hereinbelow, the percentage of chamber wall (defined by area of wall facing the chamber in a material-free state) formed of flexible substantially inelastic materials and/or materials which are inelastic in at least one direction is between 10% and 100% (e.g., the elastic material may lie outside the chamber when empty), for example, between 20% and 80%, for example, between 30% and 50%, or intermediate or larger or smaller percentages.

In some exemplary embodiments of the invention, for example as described herein above or hereinbelow, a bag or cover is provided to separate the material from the wall of the chamber (e.g., from at least some flexible, elastic and/or rigid portions thereof). Optionally, at least 10%, 30%, 50%, 80% and/or up to 100% or intermediate percentages of the walls of the chamber when full are covered by such a bag or cover.

Forces Parallel to Dispensing

In some embodiments, an elastic portion provides compressive forces parallel to the direction in which material is dispensed from a chamber (e.g. through an outlet). In some embodiments, a single elastic portion provides compressive forces parallel to the direction in which the material is dispensed.

In some embodiments, an elastic portion is attached to a rigid portion along a continuous closed path on the elastic portion (e.g. an edge around the elastic portion is attached to the rigid portion) the elastic portion, optionally facilitating the sealing of a chamber therebetween.

Figure 11A:
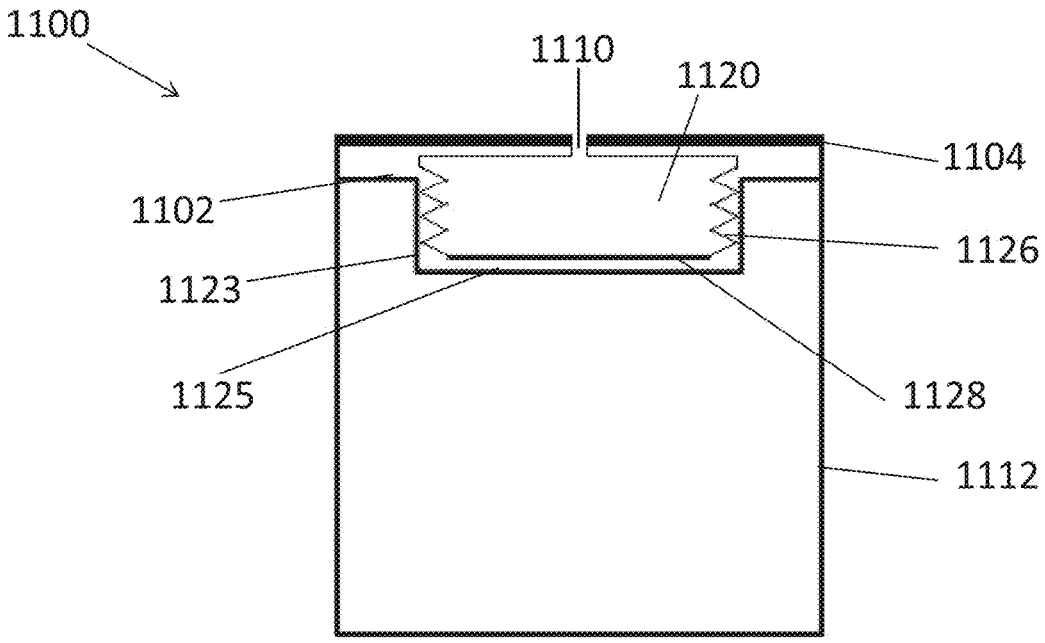
FIG. 11A is a simplified cross sectional view of an empty product distribution device including a bag with a rigid part and expanding walls, according to some embodiments of the present invention.
Figure 11B:
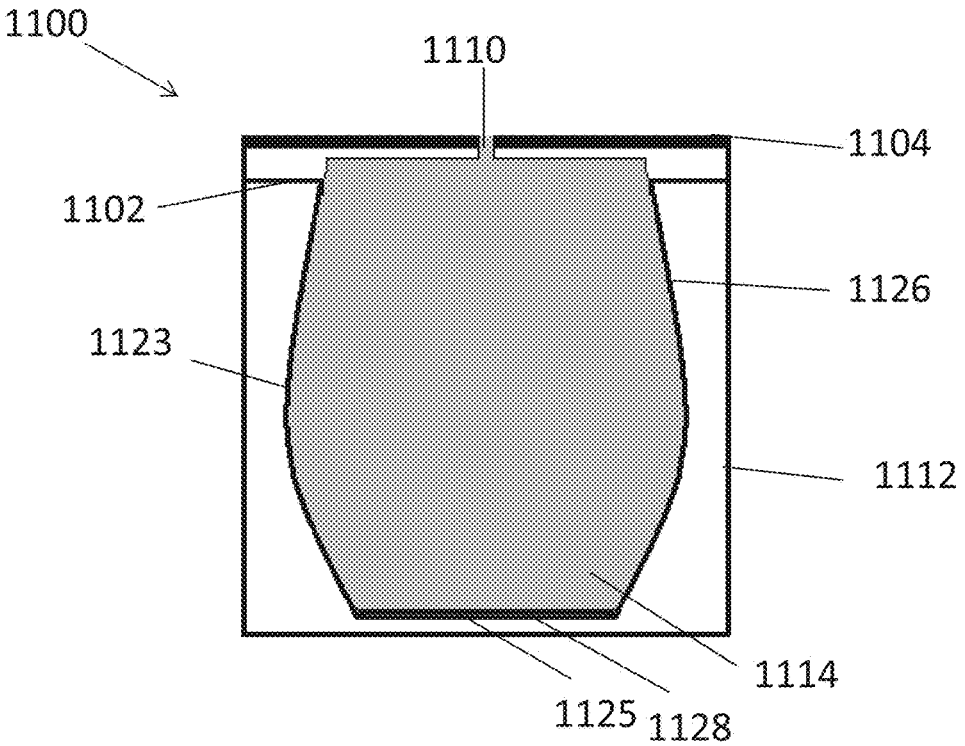
FIG. 11B is a simplified cross sectional view of a filled product distribution device including a bag with a rigid part and expanding walls, according to some embodiments of the present invention.

Alternatively, the elastic portion and rigid portion are both attached to a package. In FIGS. 11A-B, a hat-shaped elastic portion 1102 and a rigid disk 1104 are attached to package 1112 at package walls, a chamber 1120 is the volume enclosed therebetween.

Figure 3A:
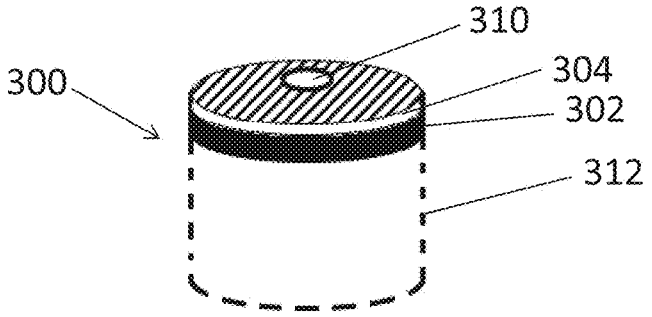
FIG. 3A is a simplified three dimensional schematic of an empty product distribution device which includes an elastic diaphragm attached to a rigid disk, according to some embodiments of the present invention.

In some embodiments, the elastic portion is a planar shape (e.g. an elastic diaphragm). In some embodiments, the rigid portion is a planar portion optionally matching a shape of the elastic portion (e.g. a disk). FIG. 3A is a simplified three dimensional schematic of an empty product distribution device 300 which includes an elastic diaphragm 302 attached to a rigid disk 304, according to some embodiments of the present invention. In some embodiments, an edge of diaphragm 302 is attached to an edge of rigid disk 304. In some embodiments, rigid disk 304 includes an outlet 310, through which material can be dispensed. Additionally or alternatively elastic diaphragm 302 includes an outlet, and/or there is an outlet between diaphragm 302 and disk 304.

In some embodiments, chamber is sealed, for example if the portions defining the chamber are impermeable and attached closely (e.g. in an air tight fashion) to each other. In some embodiments, chamber 220 is sealed e.g. if elastic portion 302 and rigid portion 304 are impermeable, closely attached to each other, and outlet 210 is sealed closed by valve 208. A potential benefit of a sealed chamber is exclusion of atmospheric oxygen, potentially protecting the material (e.g. extending material shelf life).

Optionally, product distribution device 300 includes an outer package or container, for example package 312 (illustrated by dashed lines). In some embodiments, package 312 provides a stable support for disk 304, elastic diaphragm 302 and material 314 within chamber. A shape of package 312 can be non-cylindrical (e.g. cuboid, irregular shapes such as flower shaped). For example, in some embodiments, the shape of package 312 is designed to be, e.g. easy to hold, aesthetically attractive, easy to stack. In some embodiments, the device includes a top (not illustrated) which optionally fits over the device e.g. fitting to the walls of package 312. In some embodiments, the package and/or the top are constructed of plastics, wood, glass, metals, combinations of materials, and any other device packaging materials of the art. In some embodiments, the package, optionally including the top, is less than 70%, less than 50%, less than 20% less than 10% or intermediate percentages of the filled device weight.

In some embodiments, a package into which the structure or device is placed optionally does not withstand pressure of pressurized material, and some embodiments may comprise external packages (e.g. 312) which are constructed of weaker, cheaper, and simpler materials (for example P.E.T, carton, glass, thin metal), and/or use simpler and more economical construction processes, than those which can be used by aerosol containers according to prior art.

In some embodiments, elastic portion stretches and/or expands such that the elastic portion comes into contact with one or more part of the package. Part/s that contact the package (and/or, in some embodiments, parts of the elastic portion which, through expansion, contact a rigid portion) may be flattened or otherwise shaped thereby.

Figure 3B:
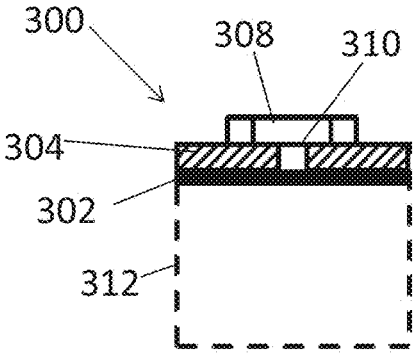
FIG. 3B is a simplified cross sectional view of an empty product distribution device which includes an elastic diaphragm attached to a rigid disk, according to some embodiments of the present invention.

In some embodiments, the chamber of empty device 300 has substantially no volume (e.g. less than 15%, 10% or 5% of a full device volume, e.g. less than 50 ml, less than 20 ml, less than 5 ml, less than 1 ml). FIG. 3B is a simplified cross sectional view of an empty product distribution device 300 which includes an elastic diaphragm 302 attached to a rigid disk 304, according to some embodiments of the present invention. Elastic diaphragm 302 and rigid disk 304 are in close contact, and the chamber therebetween has no or very low volume.

Figure 3C:
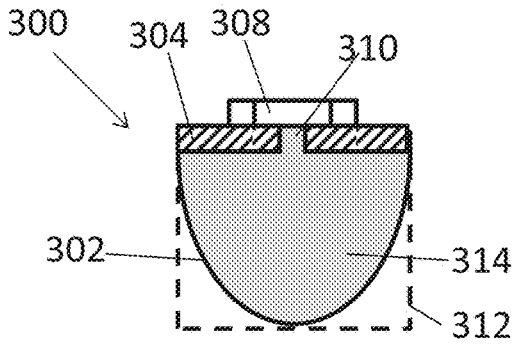
FIG. 3C is a simplified cross sectional view of a filled product distribution device which includes an elastic diaphragm attached to a rigid disk, according to some embodiments of the invention.

FIG. 3C is a simplified cross sectional view of a filled product distribution device 300 which includes an elastic diaphragm 302 attached to a rigid disk 304, according to some embodiments of the invention. Elastic diaphragm 302 is stretched and the chamber between rigid disk 304 and elastic diaphragm 302 is filled with material 312. In some embodiments, elastic diaphragm 302 has isotropic elastic properties and a shape of the stretched elastic diaphragm 302 is a dome shape. In some embodiments, elastic diaphragm has anisotropic elasticity, with higher elasticity in one or more direction. For example, a shape of the stretched elastic diaphragm 302 is a ridge shape.

In some embodiments, a valve 308 is attached to rigid disk 304 blocking outlet 310. Valve 308 controls dispensing of material 314 through outlet 310. In some embodiments a valve is attached to a portion defining the chamber (e.g. rigid portion, elastic portion) by gluing, screwing, forming as one piece, or any other valve attachment method of the art. In some embodiments a part of the valve is shaped to facilitate attachment to the device (e.g. triangular shaped valve shoulders attaching to triangular shaped outlet).

Figure 3D:
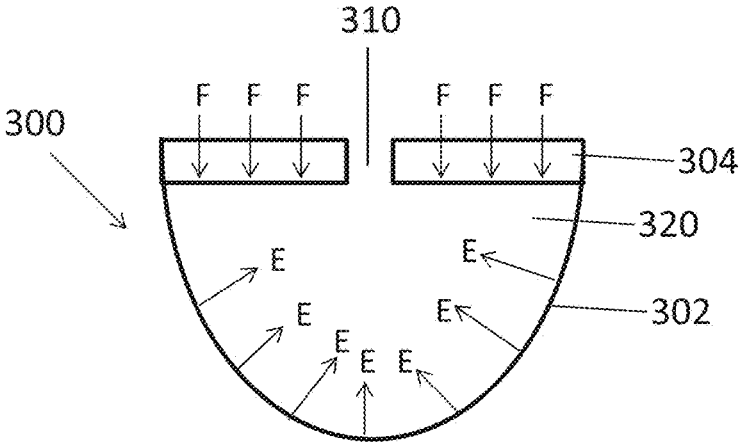
FIG. 3D is a simplified schematic of a filled product distribution device showing forces on a chamber (the material is not illustrated), according to some embodiments of the invention.

In some embodiments, stretching of the elastic portion produces compressive force on the material within the chamber. FIG. 3D is a simplified schematic of a filled product distribution device 300 showing forces E and F on a chamber 320 (the material is not illustrated), according to some embodiments of the invention. FIG. 3D illustrates forces which may act on the structure, in some implementations of the device illustrated in FIGS. 3A-C. Forces E on material 314 are elastic forces of elastic diaphragm 302. Forces C cause material 314 to press against disk 304, resulting in reactive compressive forces D from disk 304 on material 314. As outlet 310 is facing elastic diaphragm 302, each of forces E has a component perpendicular to outlet 310. A potential benefit of the compressive parallel forces on the material to the direction in which dispensed material exits the chamber is that forces acting to dispense material may be maximized.

In some embodiments, elastic diaphragm 302 and disk 304 are not attached to each other and an edge of diaphragm 302 and an edge of disk 304 are attached to packaging 312.

Figure 4:
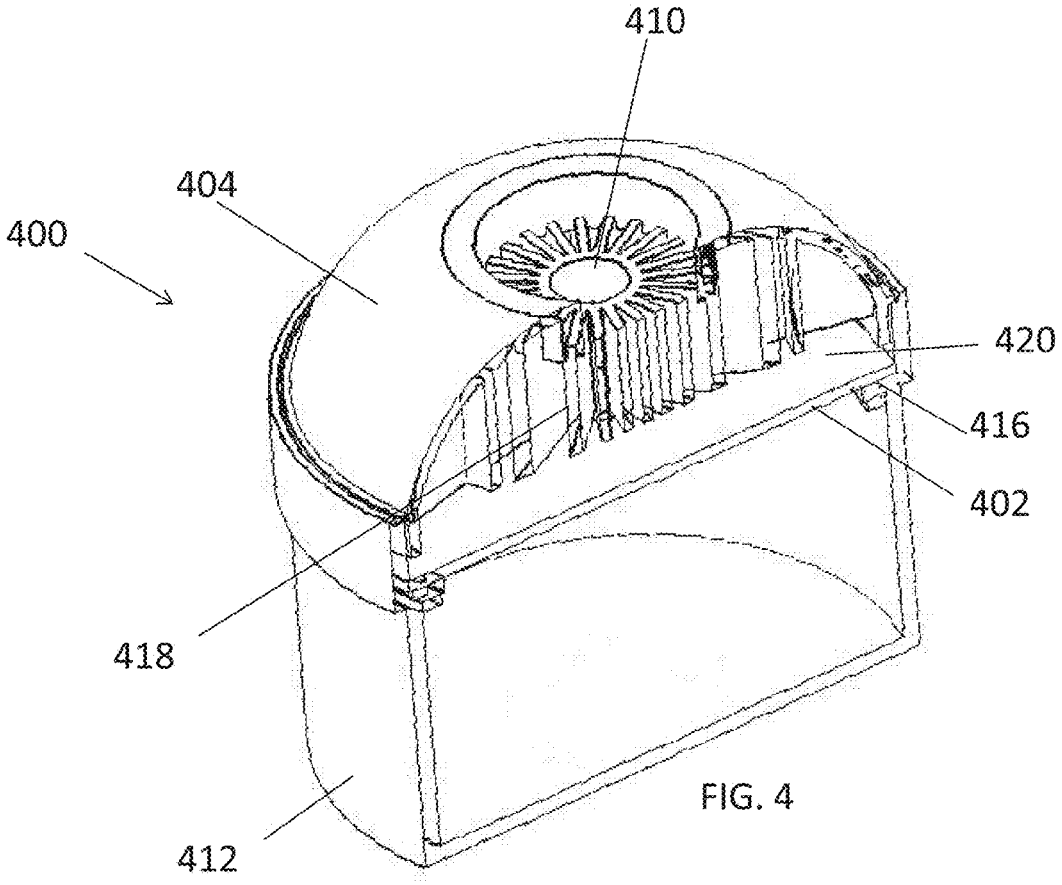
FIG. 4 is a simplified schematic section view of an exemplary empty product distribution device with a reinforced rigid portion.

Although illustrated in FIG. 3A-C as a disk, rigid portion, in some embodiments, has an alternative shape, e.g. oval, square, triangular, elongated, or any other shape. Likewise, the elastic portion, and/or package and/or other external packaging (e.g. a top) can have a variety of geometries and/or shapes, for example geometry that is easy to hold and/or aesthetically attractive and/or easy to stack In some embodiments, the rigid portion is reinforced, for example to maintain a shape thereof. FIG. 4 is a simplified schematic section view of an exemplary empty product distribution with a reinforced rigid portion 404. A device 400 includes an elastic diaphragm 402 and a dome shaped reinforced rigid portion 404, according to some embodiments of the invention. Elastic diaphragm 402 is attached to a package flange 416 and a chamber 420 is the space defined by elastic diaphragm 402, an upper portion of package 412 and rigid portion 404.

In some embodiments a bag (not illustrated) is placed in chamber 420 and a valve (not illustrated) is attached to the bag through a rigid portion outlet 410.

In some embodiments, the rigid portion is a solid-fill material. In some embodiments, the rigid portion is 0.5 mm-20 cm thick, or 1-10 mm thick, or 2-5 mm thick. In some embodiments, rigid portion includes one or more hollow area.

In some embodiments, one or more rigid part includes or is coupled to a non-chamber functional part, for example, a handle and/or a spout.

Optionally, rigid portion 404 includes fins 416. In some embodiments, fins 416 provide structural strength (e.g. to resist pressure of material) with a lower quantity of material than a solid-fill part prospectively providing a lighter and/or a less expensive part. In some embodiments, fins are denser and/or thicker at otherwise weak areas. For example, in the illustrated embodiment of FIG. 4, fins 416 are denser around outlet 410 optionally counteracting weakness due to the outlet. In some embodiments, other structure strengthening techniques of the art (e.g. struts, latticework, honeycomb) are used to provide sufficient strength to rigid portion's.

Optionally, device 400 does not include a bag and includes an additional portion (e.g. rigid and/or elastic and/or rubber) between fins 416 and chamber 420 which, for example, seals chamber 420 e.g. preventing material from entering spaces between fins 416.

Shaped Elastic Portion

Figure 5A:
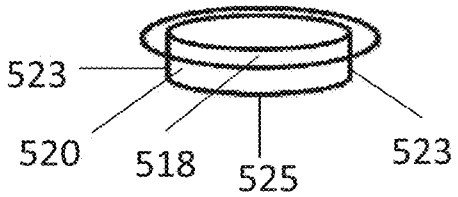
FIG. 5A is a simplified schematic view of a hat-shaped elastic portion, according to some embodiments of the invention.

In some embodiments, the elastic portion includes a three dimensional shape. FIG. 5A is a simplified schematic view of a hat-shaped elastic portion 502, according to some embodiments of the invention. Hat-shaped elastic portion 502 includes a brim 522 and a crown 524. Crown 524 includes crown walls 523 and a crown top 525.

Figure 5B:
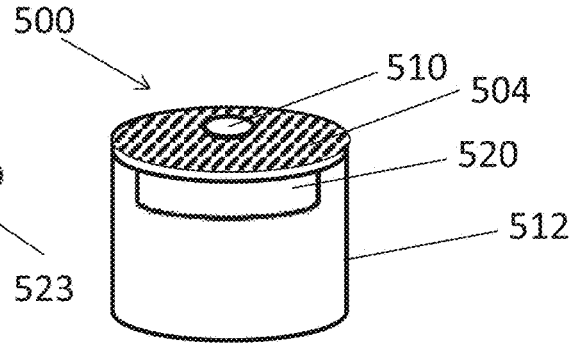
FIG. 5B is a simplified side view of an empty product distribution device which includes a hat-shaped elastic portion attached to a rigid portion, according to some embodiments of the present invention.

FIG. 5B is a simplified side view of an empty product distribution device 500 which includes a hat-shaped elastic portion 502 attached to a rigid portion 504, according to some embodiments of the present invention. Optionally, rigid portion 504 is a disk. Optionally, device 500 includes a package 512.

Empty device 500 (and other empty devices illustrated in the figures) is illustrated in a state before filling, entirely empty of material. In some embodiments, a previously filled device which has been used until empty (e.g. substantially no more material will dispense upon opening a valve), in some embodiments, retains some residual material within the device. In some embodiments, residual material volume is less than 10%, or less than 5%, or less than 1% of the filled material volume.

Figure 5C:
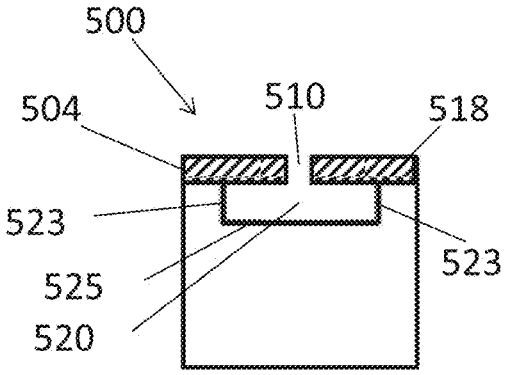
FIG. 5C is a simplified cross sectional view of an empty product distribution device which includes a hat-shaped elastic portion attached to a rigid portion, according to some embodiments of the present invention.

FIG. 5C is a simplified cross sectional view of an empty product distribution device 500 which includes a hat-shaped elastic portion 502 attached to a rigid portion 504, according to some embodiments of the present invention. In some embodiments, brim 518 is attached to rigid disk 504 and a volume of a chamber 520, when the device is empty of material, is the volume of crown 520.

In some embodiments, one or more part (e.g. crown walls, crown top, brim) of elastic portion 502 has different material properties, e.g. elasticity and/or rigidity, than one or more other part. For example, in order to control the shape of the elastic portion (e.g. when the chamber is filled and the elastic portion stretched).

Figure 5D:
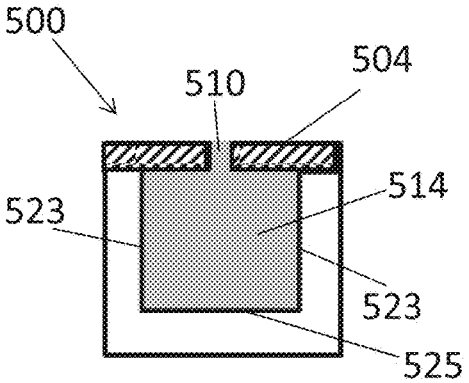
FIG. 5D is a simplified cross sectional view of a filled product distribution device which includes a hat-shaped elastic portion attached to a rigid portion, according to some embodiments of the present invention.

In some embodiments, crown walls 523 are more elastic than crown top 525, for example, so that filling chamber 520 causes crown walls 523 to extend more than crown top 525. FIG. 5D is a simplified cross sectional view of a filled product distribution device 500 which includes a hat-shaped elastic portion 502 attached to a rigid portion 504, according to some embodiments of the present invention. The chamber is filled with material 514 and crown walls 523 are stretched, whereas crown top 525 is optionally not stretched (crown top 525 has a flat shape). However, in some embodiments, crown top is elastic, for example, when the device is filled, the elastic portion has a dome shaped crown top.

In some embodiments, one or more part of elastic portion has anisotropic properties, e.g. elasticity. As illustrated in FIG. 5D, in some embodiments, crown walls 523 are elastic longitudinally (in a direction perpendicular to rigid disk 504) and substantially inelastic and/or less elastic radially. In some embodiments, longitudinal elasticity and reduced radial elasticity of crown walls 523 is achieved by reinforcing rings within crown walls, for example metal rings, reinforcing fibers (e.g. polyester fibers). Alternatively, in some embodiments, crown walls have anisotropic elasticity and, when filled, have a bulging shape.

Figure 5E:
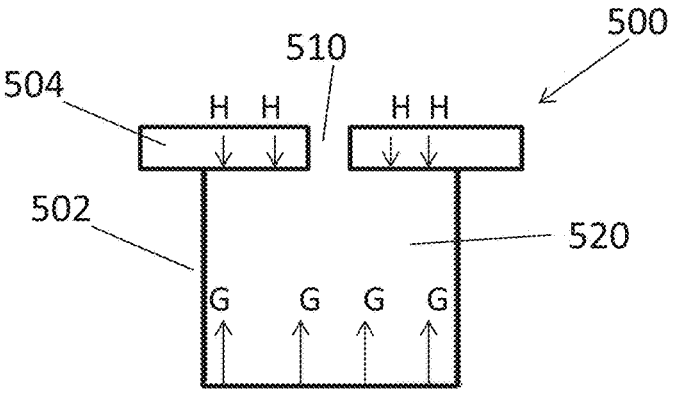
FIG. 5E is a simplified schematic of a filled product distribution device, including a hat shaped elastic portion attached to a rigid portion, showing forces on a chamber, according to some embodiments of the invention.

In some embodiments, stretching of the elastic portion produces compressive force on the material within the chamber. FIG. 5E is a simplified schematic of a filled product distribution device 500, including a hat shaped elastic portion 502 attached to a rigid disk 504, showing forces G and H a chamber 320, according to some embodiments of the invention (material within the chamber is not illustrated). FIG. 5E illustrates forces which may act on the chamber, in some implementations of the device illustrated in FIGS. 5A-D. Elastic crown walls 523 act to pull top 525 towards the outlet 510, generating forces G on material 514. Forces G cause material 514 to press against disk 504, resulting in reactive compressive forces H from disk 504 on material 514. As a plane of crown top is substantially parallel to outlet 510 forces G are substantially perpendicular to outlet 310.

Elastic Portion Properties and Shape

In some embodiments, elastic portions have different properties in different directions, for example, elastic modulus e.g. as described in FIGS. 5A-E. In some embodiments different properties of different parts of the elastic portion are, for example, provided by using differing thicknesses of the same material, and/or by using different materials, and/or by treating sections (e.g. vulcanization, reinforcing). Reinforcement can be, for example, by inserting or incorporation of wires (e.g. metal) and/or strings (e.g. cotton, polymer) and/or ribs (e.g. plastic).

In some embodiments, the elastic portion includes reinforcing fibers. In some embodiments, reinforcing fibers may act to limit the range of motion (e.g. stretching) of the elastic portion, optionally directionally.

Figure 16:
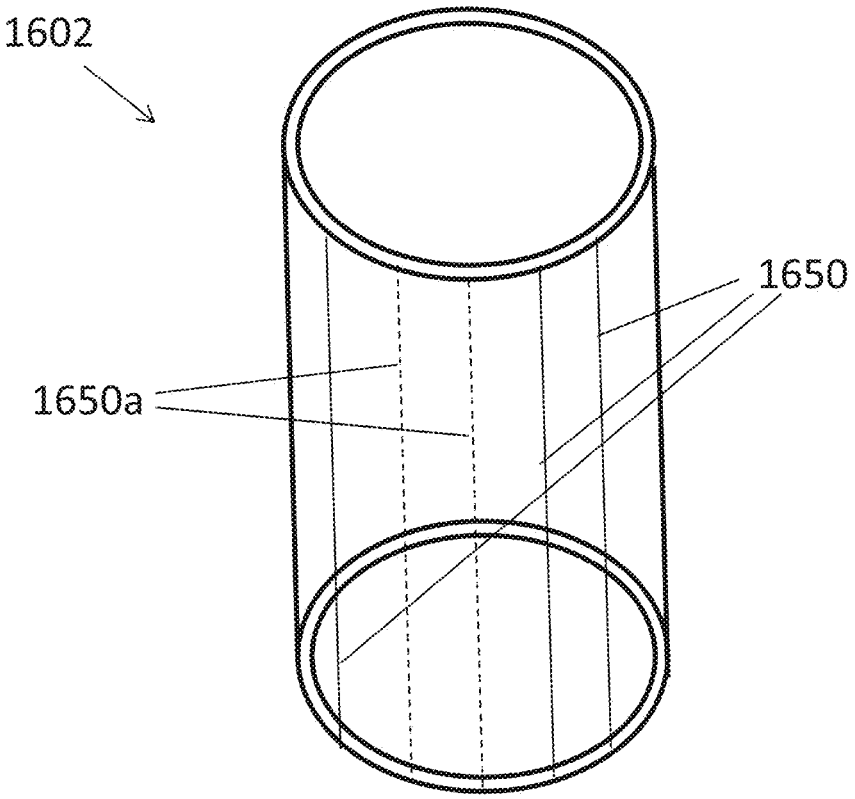
FIG. 16 is a simplified schematic of an elastic sleeve elastic portion which comprises non-elastic fibers, according to some embodiments of the present invention.

FIG. 16 is a simplified schematic of an elastic sleeve 1602 elastic portion which comprises non-elastic fibers, according to some embodiments of the present invention. Sleeve 1602 includes reinforcing fibers 1650, 1650*a* running longitudinally along sleeve 1602 and embedded in (e.g. as schematically illustrated by dashed lines 1650*a*) and/or attached to (e.g. as schematically illustrated by solid lines 1650) a rubber material comprised in sleeve 1602. In some embodiments, fibers 1650 include polyester or another substantially non-elastic material. Fibers 1650 allow sleeve 1602 to expand radially but substantially prevent sleeve 1602 from expanding longitudinally. In some embodiments, fiber reinforcing of a sleeve is in rings or partial rings around and/or within the sleeve.

Figure 6A:
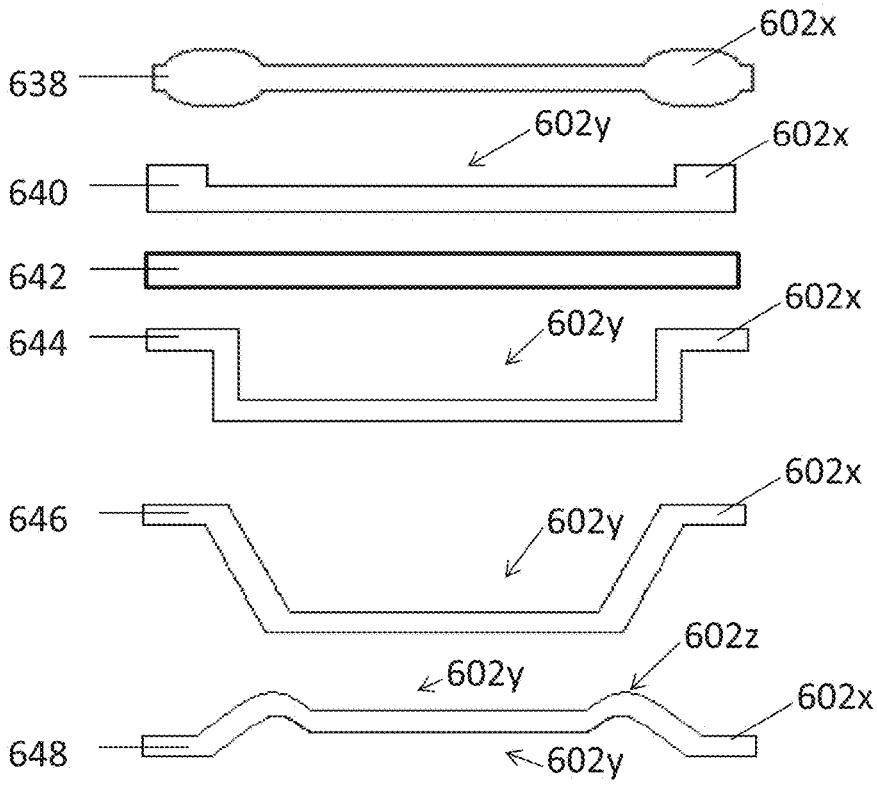
FIG. 6A is a simplified cross sectional view of several exemplary elastic portions, according to some embodiments of the invention.

Optionally, each elastic portion has one of a variety of cross sectional shapes, for example, in order for different parts of an elastic portion to have different properties (e.g. elasticity). FIG. 6A is a simplified cross sectional view of several exemplary elastic portions, according to some embodiments of the invention. Optionally, illustrated elastic portion cross sectional views are of relaxed elastic portions. FIG. 6A illustrates a ridged elastic portion 638, an elastic portion with an edge 640, a planar elastic portion 642, a hat-shaped elastic portion 644, a cup shaped elastic portion 646 and a rounded ridged elastic portion 648.

In some embodiments, thickened portion/s 602*x* of an elastic portion (e.g. 638, 602*x*) provide a reinforced surface for attachment of the elastic portion. In some embodiments, thickened portions facilitate stretched attaching of the elastic portion e.g. a thickened portion is held aiding stretching by pulling on another portion of the elastic portion.

In some embodiments, the elastic portion is shaped to form an inlet 602*y* (e.g. of elements 640, 644, 646, 648), optionally providing a space for a bag, for example, when the elastic portion is relaxed. For example, in some embodiments, a collapsed and/or empty and/or folded bag fits into hat shaped elastic portion 644 (e.g. as bag 1106 and elastic portion 1102 as illustrated in FIG. 11A).

The elastic portions illustrated by FIG. 6A are suitable for devices including a single elastic portion, devices including more than one elastic portion and devices including perimeter elastic portions. In some embodiments, ridges and/or edges 602*x* and/or features (e.g. bump 602*z*) which are optionally reinforced (e.g. thickened) provide a surface for attachment to a rigid portion and/or an external container. Although illustrated without an outlet, the elastic portions illustrated by FIGS. 6A-D are suitable for use in embodiments where the elastic portion includes one or more outlet.

Figure 6B:
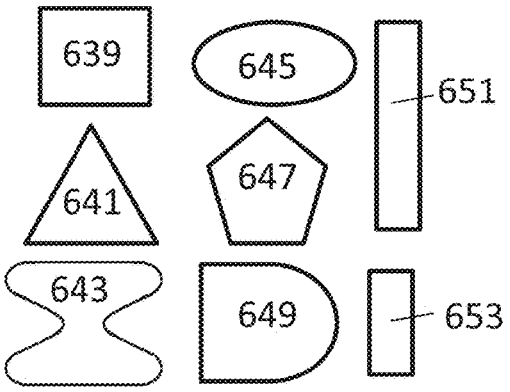
FIG. 6B is a simplified top view of several exemplary elastic portions, according to some embodiments of the invention.

In some embodiments, elastic portions have a variety of top view shapes including regular shapes e.g. circular, square, rectangular and irregular shapes e.g. flower, cloud. FIG. 6B is a simplified top view of several exemplary elastic portions, according to some embodiments of the invention. FIG. 6B illustrates elastic portions including a top view with; a square shape 639, a triangle shape 541, an hourglass shape 643, an oval shape 645, a pentagon shape 647, a D-shape 649, a rectangular shape 653, an elongated shape 651. The shapes illustrated in FIG. 6B are suitable, for example, for embodiments including one elastic portion (e.g. as illustrated in FIGS. 3A-D and FIGS. 5A-D) and embodiments including more than one elastic portion (e.g. as illustrated in FIGS. 22A-D).

Figure 6C:
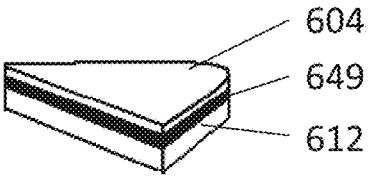
FIG. 6C is a simplified side view of a device with a D-shaped elastic portion, according to some embodiments of the invention.
Figure 6D:
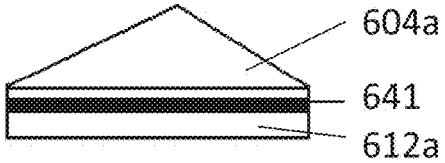
FIG. 6D is a simplified side view of a device with a triangle shaped elastic portion, according to some embodiments of the invention.

FIG. 6C is a simplified side view of a device with a D-shaped elastic portion 649, according to some embodiments of the invention. A rigid portion 604 and a package 612 optionally also have a D-shaped top view. Alternatively, in some embodiments, an elastic portion with a D-shaped top view (and, for example, any of the other top shapes illustrated in FIG. 6B) is attached to a rigid portion with a different top view shape. FIG. 6D is a simplified side view of a device with an elastic portion with a triangle shaped top view, according to some embodiments of the invention. A rigid portion 604*a* and a package 612*a* also have a triangle shaped top view.

Exemplary Embodiments Including Bags

In some embodiments, a bag is disposed within the chamber. Potential benefits of devices including bags include, ease of filling and/or ease of transport of the bags, potential use of existing bags (e.g. BOV, BIC) and/or associated infrastructure (e.g. filling, manufacture). An additional potential benefit of devices including bags is that a sealed and/or impermeable and/or inert bag means that the chamber does not need to be sealed and/or impermeable and/or inert.

In some embodiments, the bag includes or is attached to a valve. Upon opening the valve, material inside the bag is dispensed. In some embodiments, bag is a classically shaped BOV. In some embodiments, the bag is constructed with flexible sheets and/or laminates. In some embodiments, the bag is polypropylene (PP), polyethylene (PE), polyethylene terephthalate (PET), Nylon, Aluminum foil, or a combination thereof. In some embodiments, the bag is plastic (e.g. PE, PP) and is attached to a plastic valve (e.g. PE) by plastic welding.

Optionally, in some embodiments, at least part of a valve is compressed by the elastic portion (e.g. the valve is inside a chamber).

Exemplary Bags Shaped for Compatibility with a Chamber

BOV constructions are usually constructed from two flexible sheets joined around the edges, and are typically rolled around a central shaft, unrolling when filled. In some embodiments, bags deviate from traditional BOV construction and may be provided in any of a variety of shapes. Optionally, in some embodiments, the bag is shaped to be partially or fully congruent, with the shape of the chambers with which the bag is used, for example, for chamber shapes as described elsewhere in this document and/or illustrated in the figures e.g. sleeve. In some embodiments, shape congruency of the bag is to the chamber when the chamber is filled with material. In some embodiments, shape congruency of the bag is partial, where part of the bag is congruent with part of the chamber.

In some embodiments, shape congruency of the bag to the chamber is by the bag being of a similar shape to the chamber and/or the bag including expanding walls e.g. concertina walls. A potential advantage of devices including such chamber congruent bags is that, in some embodiments, the bag closely fits the chamber and use of the chamber volume for material is potentially able to be maximized A further potential advantage of such bags is that friction between the bag and the chamber during the filling process is reduced.

Figure 7:
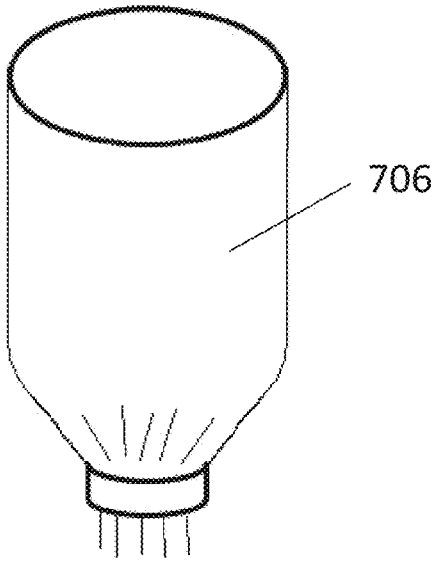
FIG. 7 presents a cylindrical bag, according to some embodiments of the invention.

FIG. 7 presents a cylindrical bag 706, according to some embodiments of the invention. In some embodiments, cylindrical bags are suitable for, for example, use with a chamber including a cylindrical shape (e.g. an elastic sleeve, device 1500 illustrated in FIGS. 15A-D) In some embodiments bag 706 is manufactured in a cylindrical shape, for example by extrusion. In some embodiments, bag 706 has a cylindrical cross-section along at least 70% of a bag length.

Figure 8:
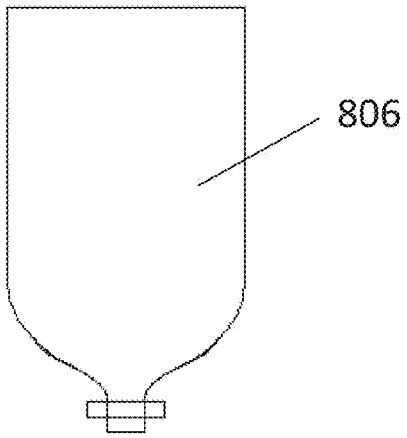
FIG. 8 shows a simplified side view of a bag including a tapered bottom, according to some embodiments of the invention.
Figure 9:
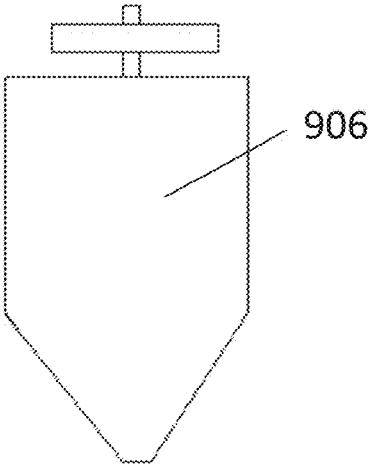
FIG. 9 shows a simplified side view of a shaped bag according to some embodiments of the invention.
Figure 10:
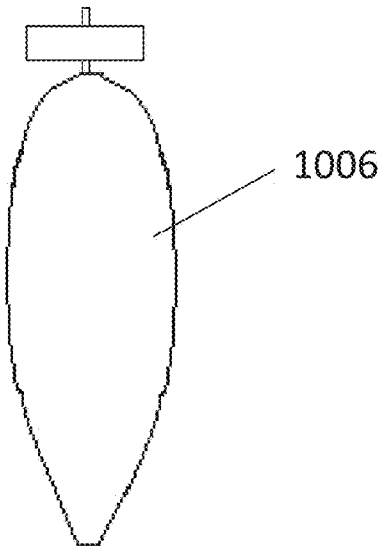
FIG. 10 shows a simplified side view of a shaped bag according to some embodiments of the invention.

In some embodiments, the bag includes a shaped configuration. FIG. 8 shows a simplified side view of a bag 806 including a tapered bottom, according to some embodiments of the invention. FIG. 9 shows a simplified side view of a shaped bag according to some embodiments of the invention. FIG. 10 shows a simplified side view of a shaped bag according to some embodiments of the invention. FIG. 9 and FIG. 10 show additional examples of shaped bags 906, 1006, including shapes tailored to fit shapes of, for example, chambers (e.g. an elastic sleeve) and/or packages and/or containers and/or for specific commercial applications. Bag 906 includes a pointed and/or cone shaped base and a flat top. Bag 106 includes a pointed and/or cone shaped base and a rounded and/or tapered top.

Exemplary Bags with Rigid Part(s) and/or Expanding Walls

In some embodiments, an elastic portion is stretched around one or more shape (e.g. defined by a bag within the chamber). In some embodiments, a bag with one or more bag rigid part (e.g. a rigid base), when filled stretches the elastic portion around the bag rigid part. In some embodiments, a rigid bag part prevents the elastic portion from stretching and/or collapsing to a particular shape, facilitating the use of, for example, a package and/or container. In some embodiments, a bag rigid part forms a bag reinforcement, as described elsewhere in this document.

FIG. 11A is a simplified cross sectional view of an empty product distribution device 1100 including a bag with a rigid part 1128 and expanding walls 1126, according to some embodiments of the present invention. In some embodiments rigid base 1128 maintains a part of elastic portion hat shape (e.g. a shape of the crown) when the elastic portion is stretched, upon filling device 1100. A potential benefit of maintaining or controlling an elastic portion shape (e.g. hat shape) is that a direction of compressive forces applied to the material by the elastic portion are controlled.

In some embodiments, expanding walls expand, for example, by unrolling and/or unfolding and/or stretching. Product dispensing device 1100 includes a bag, with concertina expanding walls 1126, which is placed into chamber 1120. In some embodiments, an outlet of the bag is connected to outlet 1110 and/or an outlet of the bag protrudes through outlet 1110. In some embodiments, the bag is attached to or includes a valve (not illustrated) through which pressurized material inside the bag is dispensed. When the bag is empty, as illustrated in FIG. 11A, expanding walls are, for example, relaxed and/or collapsed and/or folded. In some embodiments, the bag includes a rigid base 1128.

FIG. 11B is a simplified cross sectional view of a filled product distribution device 1100 including a bag with a rigid part 1128 and expanding walls 1126, according to some embodiments of the present invention. Concertina expanding bag walls 1126 are unfolded, stretched against the walls of elastic portion and the bag extends into stretched elastic portion. In some embodiments, the expanding walls are flattened against stretched elastic portion 1102, as illustrated in FIG. 11B. In the embodiment illustrated by FIG. 11B, a shape of a top of elastic portion 1125 is controlled by bag rigid base 1128, whereas elastic portion walls 1123 bulge.

Figure 11C:
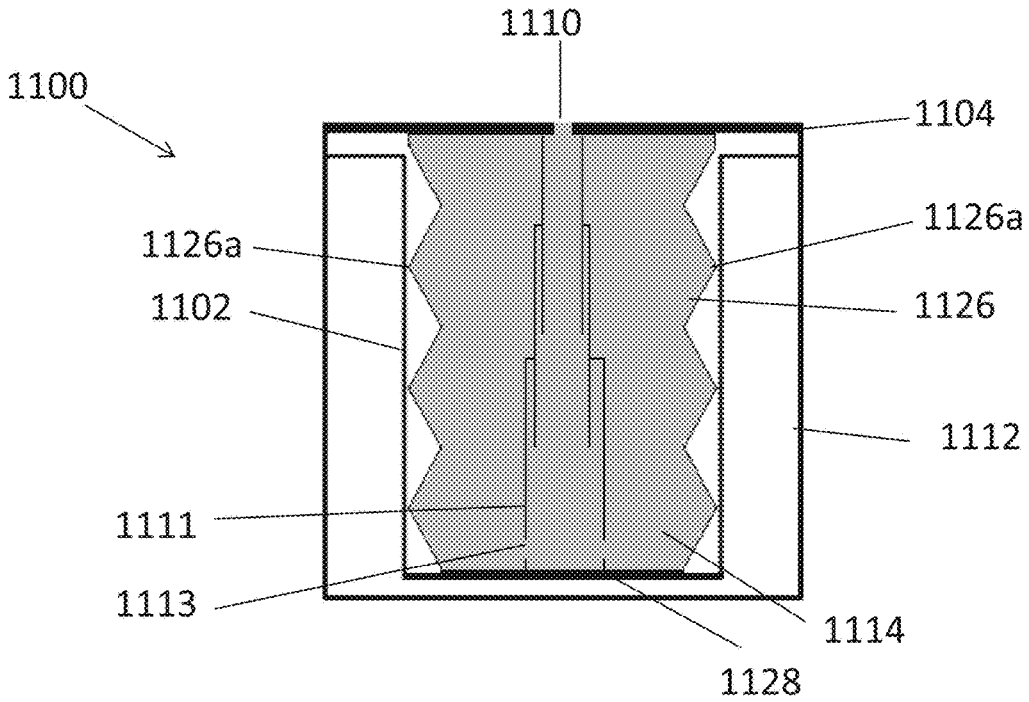
FIG. 11C is a simplified cross sectional view of a filled product distribution device including a bag with a rigid part and expanding walls, according to some embodiments of the invention.

Alternatively, in some embodiments, expanding walls are sufficiently stiff to maintain a concertina shape, upon filling of the chamber with material. FIG. 11C is a simplified cross sectional view of a filled product distribution device 1100 including a bag with a rigid part 1128 and expanding walls 1126, according to some embodiments of the invention.

In some embodiments, the bag is placed inside chamber 1120 (e.g. without attachment). In some embodiments, the bag is attached to one or more portion of device 1100 that define the chamber (e.g. elastic portion 1102, rigid portion 1104, package 1112). In some embodiments, one or more point 1126*a* of concertina expanding walls are attached to the elastic portion, optionally preventing the bag walls from meeting during dispensing and/or causing pinches and/or trapping of material within the bag. In some embodiments, the device includes a folding or telescopic rigid portion disposed within the chamber and/or bag. For example, telescopic straw 1111 optionally coupled to outlet 1110 and/or a valve blocking outlet (not illustrated). Optionally, the folding or telescopic rigid portion disposed within the chamber (e.g. telescopic straw 1111), assists dispensing of material from the base of the bag before dispensing of other portions of the material: For example, in some embodiments telescopic straw includes one or more inlet 1113.

In some embodiments, the bag is a closed structure and the bag includes or is attached to a valve (not illustrated). In some embodiments the bag is attached to a valve through outlet 1110 where the valve is disposed outside the chamber and the bag connects to the valve by a portion of the bag which extends out of the chamber, through the outlet. In some embodiments, the bag is filled, stretching elastic portion 1102. In some embodiments, concertina walls 1126 unfold as bag expands, e.g. upon filling with material.

Exemplary Bag Strengthening, Reinforcement

In some embodiments, a bag within the chamber is subject to different compression forces and/or different forces at different regions of the bag. In some embodiments, a bag within the chamber is reinforced at one or more area experiencing larger forces. In systems of the art using compressed gas propulsion, a BOV is typically subject to uniform compressive pressure on all sides. In contrast, in some embodiments, portions of a bag are supported (e.g. pressured) from the outside by a sleeve or chamber, while other portions are only partially supported or are unsupported meaning a part of the bag itself partially or fully resists forces of pressurized material from within the bag.

Figure 13:
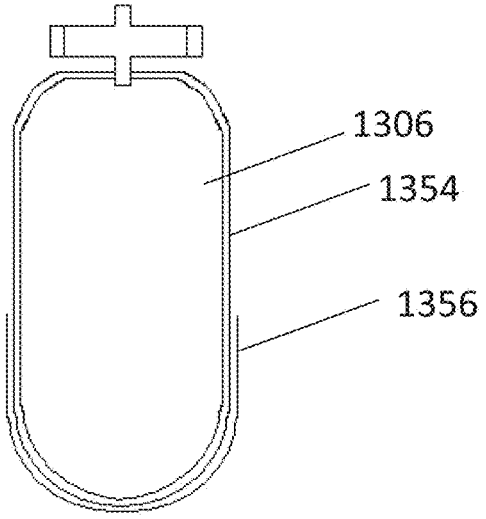
FIG. 13 is a simplified side view of a bag which includes reinforcing layers, according to some embodiments of the invention.

In some embodiments, the bag includes a reinforced (e.g. thickened) bag wall (in contrast to traditional BOV and similar known devices). FIG. 13 is a simplified side view of a bag 1306 which includes reinforcing layers, according to some embodiments of the invention. In some embodiments, bag is reinforced with a layer of PET. In an exemplary embodiment, layer 1354 is 0.1 mm thick and covers bag 1306.

In some embodiments, a partial reinforcing layer is provided, reinforcing selected portion's of the bag. For example, in an exemplary embodiment shown in FIG. 13, bag 1306 includes a partial reinforcing layer 1356 which reinforces lower portions of bag 1306.

In some embodiments, bag reinforcement is flexible and/or elastic.

In some embodiments, layers 1354 and 1356 are separately constructed and applied layers. In some embodiments, layers 1354 and 1356 are provided by thickening bag 1306.

Exemplary Bag Including Ring or Other Closing Element

Figure 12A:
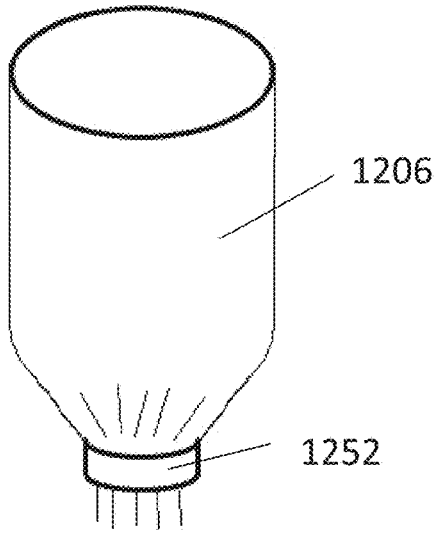
FIG. 12A is a simplified side view of a bag including a single ring, according to some embodiments of the invention.
Figure 12B:
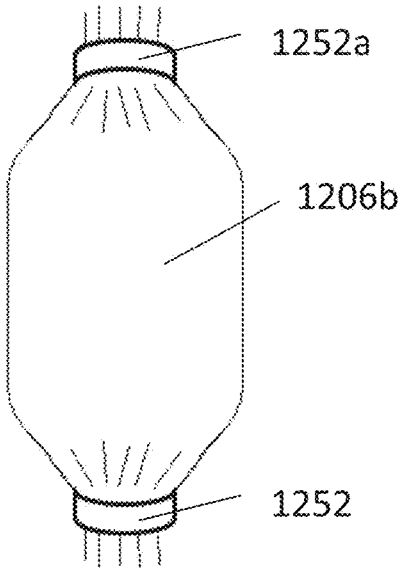
FIG. 12B is a simplified side view of a bag including two rings, according to some embodiments of the invention.

In some embodiments, the bag is closed (e.g. closed and/or sealed around a valve) at one or more end by a closing element (e.g. ring, staple, clip, clamp). FIG. 12A is a simplified side view of a bag 1206 including a single ring 1252, according to some embodiments of the invention. Although ring 1252 is shown installed on cylindrical bag 1206, it is to be understood that ring 1252 may be used with any bag, such as, for example a standard BOV. In some embodiments, the bag is optionally constructed from a sleeve, and is closed (e.g. closed around a valve) at both ends by a ring. FIG. 12B is a simplified side view of a bag 1206*b* including two rings 1252, 1252*a*, according to some embodiments of the invention.

In some embodiments, for example, as bags are generally constructed of thin material, the bag includes a reinforcing part, (e.g. ring). In some embodiments, bag 1206 includes a ring 1252, for example to provide support to the bottom of the bag.

Low Friction Surfaces

In some embodiments, the bag includes a low friction surface, for example, to assist smooth expansion and/or other movement of the bag within the sleeve or chamber. In some embodiments, a low friction surface assists bag portions in moving, against each other and/or portions defining the chamber (e.g. elastic portion, elastic sleeve), for example, when unrolling and/or unfolding. In some embodiments, the bag low friction surface is suitable for low friction contact with rubber.

In some embodiments, a bag low friction surface assists in fully dispensing material as the chamber is reduced in volume. In some embodiments, a low friction surface facilitates smooth movement of the bag, preventing the bag constricting at a point along the bag, and/or pinching, preventing a portion of the material remaining within the bag when dispensing is finished.

Figure 14:
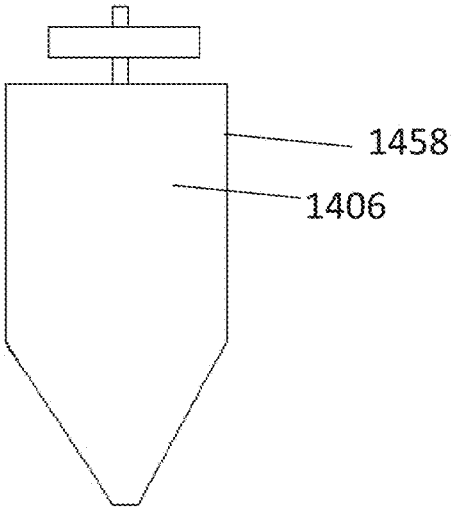
FIG. 14 is a simplified side view of a bag which includes a low-friction external surface, according to some embodiments of the invention.

FIG. 14 is a simplified side view of a bag 1406 which includes a low-friction external surface 1458, according to some embodiments of the invention. In some embodiments, external surface 1458 is provided by a low friction surface and/or layer and/or coating, for example Teflon®, silicone, by a lubricant e.g. silicone oil.

Alternatively or additionally, in some embodiments, a low-friction surface (e.g. by the methods described for bag low-friction surfaces) is provided on one or more portion defining the chamber, for example, to the rigid portion and/or the elastic portion e.g. sleeve.

Exemplary Structures with Multiple Rigid Portions

Figure 15A:
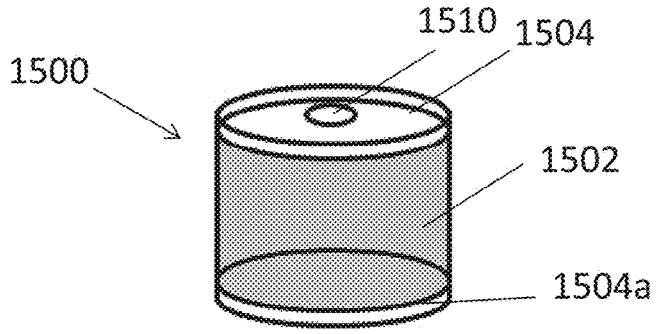
FIG. 15A is a simplified side view of a filled product distribution device which includes two rigid portions connected by an elastic portion, according to some embodiments of the invention.

In some embodiments, product distribution devices include more than one rigid portion attached to one or more elastic portions. FIG. 15A is a simplified side view of a filled product distribution device 1500 which includes two rigid portions connected by an elastic portion 1502, according to some embodiments of the invention. In some embodiments, two rigid sections are connected using a hinge (e.g. a living hinge) and an elastic portion, expansion of the chamber therebetween by opening of the hinge and expansion of the elastic portion.

In some embodiments, the rigid portions are substantially the same geometry (e.g. size and/or shape). In some embodiments, the rigid portions are of different geometry (e.g. size and/or shape). In some embodiments, a surface of the rigid portion defining the chamber is planar. In some embodiments, one or more rigid portion includes a hollow portion, optionally providing a space for the elastic portion's to expand into.

In some embodiments an elastic portion 1502 is attached between a disk-shaped first rigid portion 1504 and a disk-shaped second rigid portion 1504*a*. In some embodiments, elastic portion 1502 is an elastic sleeve. Alternatively, in some embodiments, elastic portion is, for example, an sheet of elastic material overlapping or attached at sheet ends. A chamber is the volume enclosed by elastic portion 1502, and the two rigid portions, 1504, 1504*a*.

In some embodiments, when device 1500 is filled, elastic sleeve 1502 is stretched and the chamber is compressed by the rigid portions 1504, 1504*a* and/or elastic portion 1502. Dispensing of material through a first rigid portion outlet 1510 results in relaxing of elastic sleeve 1502. In some embodiments, a thickness of first rigid disk 1504 and second rigid disk 1504*a* is approximately 4 mm, or 0.5-15 mm, 1-10 mm, 2-5 mm. In some embodiments, a thickness of the disks 1504, 1504*a* is sufficient to maintain a disk shape under applied forces. In some embodiments, elastic portion 1502 sheet thickness is approximately 1-2 mm.

Figure 15B:
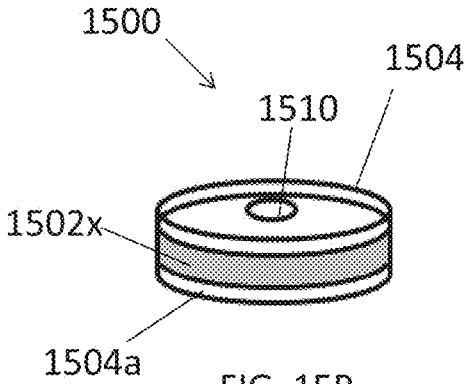
FIG. 15B is a side view of an empty or partially empty product distribution device including an elastic portion which is elastic longitudinally, according to some embodiments of the invention.

In some embodiments, elastic portion is anisotropic and has different elasticity in different directions. FIG. 15B is a side view of an empty or partially empty product distribution device including an elastic portion 1502*x* which is elastic longitudinally, according to some embodiments of the invention: As material is dispensed from the chamber, elastic portion 1502*x* shortens, contracting, for example contracting perpendicular to the plane of the sheet, reducing a separation between first rigid portion 1504 and second rigid portion 1504*a*. In some embodiments, compressive forces from the rigid portions on the chamber (and material), are substantially perpendicular to the rigid portions, and outlet 1510.

Figure 15C:
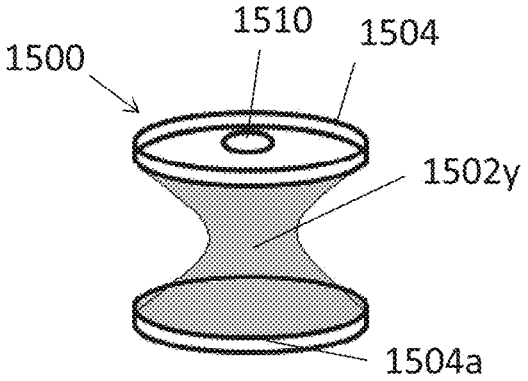
FIG. 15C is a side view of an empty or partially empty product distribution device including an elastic portion which is elastic radially, according to some embodiments of the invention.

FIG. 15C is a side view of an empty or partially empty product distribution device including an elastic portion 1502*y* which is elastic radially, according to some embodiments of the invention: As material is dispensed from the chamber, elastic portion 1502*y* narrows, retracting substantially perpendicular to a plane of the sheet or sleeve. Compressive forces on the chamber (and material), are parallel to the rigid portions, and outlet 1510.

Figure 15D:
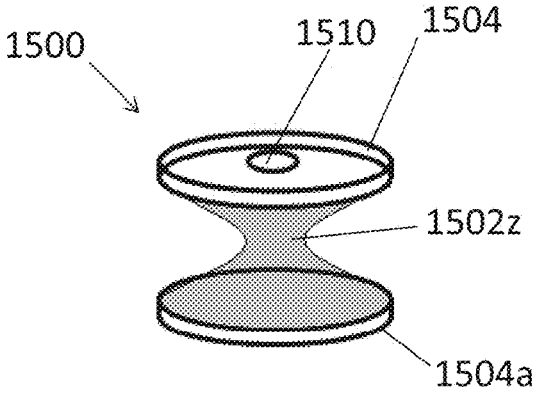
FIG. 15D is a side view of an empty or partially empty product distribution device including an elastic portion which is elastic both longitudinally and radially, according to some embodiments of the invention.

FIG. 15D is a side view of an empty or partially empty product distribution device including an elastic portion 1502*z* which is elastic both longitudinally and radially, according to some embodiments of the invention: As material is dispensed from the chamber, elastic portion 1502*z*, narrows and shortens. Compressive forces on the chamber (and material) are parallel and perpendicular to the rigid portions, and outlet 1510.

In some embodiments, the elastic portion twists as it expands and/or contracts. For example, in some embodiments, elastic portion 1502 twists during stretching and/or relaxing.

Exemplary Devices with Movable Rigid Portions and/or Perimeter Elastic Portion

In some embodiments, expansion of the elastic portion increases a separation between two or more rigid portions. In some embodiments, retraction of the elastic portion decreases the separation between two or more rigid portions. In some embodiments, an elastic portion connects perimeters of more than one rigid portion.

A potential benefit of such distribution devices including more than one rigid portion is that an area of an elastic portion with respect to a volume of the chamber can be reduced affording, for example, cost benefits.

Figure 17A:
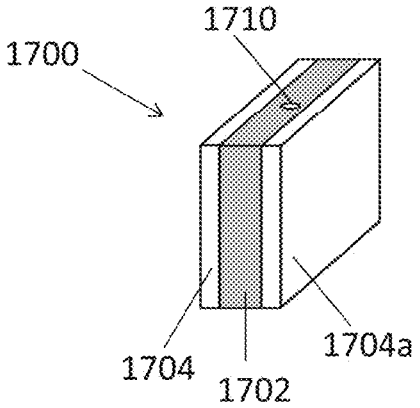
FIG. 17A is a simplified side view of a product distribution device including two rigid portions each connected at rigid portion perimeters by an elastic portion, according to some embodiments of the invention.

FIG. 17A is a simplified side view of a product distribution device 1700 including two rigid portions each connected at rigid portion perimeters by an elastic portion 1702, according to some embodiments of the invention. Elastic portion 1702 connects the perimeter of a first rigid portion 1704 to a perimeter of a second rigid portion 1704*a*. A chamber is enclosed by elastic portion 1702 and the two rigid portions 1704, 1704*a* Filling the chamber with material stretches elastic portion 1702 between the two rigid portions 1704, 1704*a* and increases a separation between the two rigid portions. Stretched elastic portion 1702 exerts forces on first and second rigid portions 1704, 1704*a* pulling the rigid portions together. The inwards force of rigid portions on the chamber exerts compressive force on the chamber (and material within).

Figure 17B:
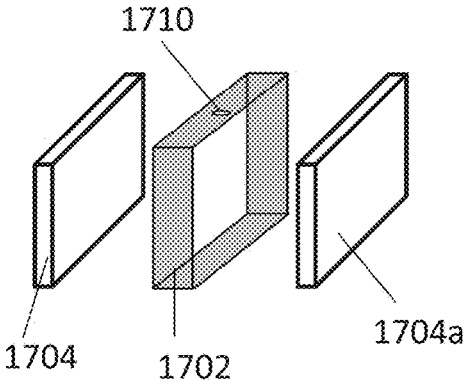
FIG. 17B is a simplified exploded view a product distribution device including two rigid portions each connected at a perimeter to an elastic portion, according to some embodiments of the invention.

In some embodiments, elastic portion 1702 includes an outlet 1710. In some embodiments, a valve is attached blocking outlet 1710. Upon opening the valve, material is dispensed from the chamber. FIG. 17B is a simplified exploded view of a product distribution device 1700 including two rigid portions each connected at a perimeter to an elastic portion 1702, according to some embodiments of the invention.

Figure 18A:
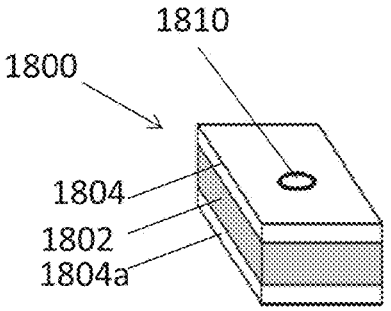
FIG. 18A is a simplified side view of a product distribution device including two rigid portions each connected at a perimeter to an elastic portion, according to some embodiments of the invention.
Figure 18B:
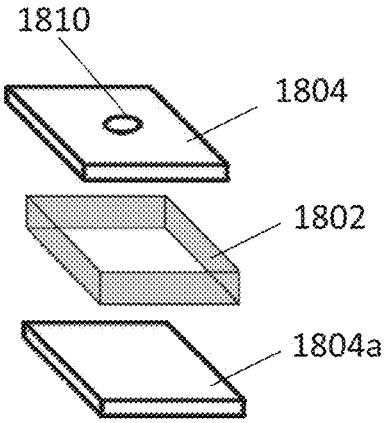
FIG. 18B is a simplified exploded view of a product distribution device including two rigid portions each connected at a perimeter to an elastic portion, according to some embodiments of the invention.

In some embodiments including more than one rigid portion, a rigid portion includes an outlet. FIG. 18A is a simplified side view of a product distribution device 1800 including two rigid portions each connected at a perimeter to an elastic portion 1802, according to some embodiments of the invention. FIG. 18B is a simplified exploded view of a product distribution device 1800 including two rigid portions each connected at a perimeter to an elastic portion 1802, according to some embodiments of the invention. First rigid portion 1804 includes an outlet 1810. In some embodiments, a valve is attached blocking outlet 1810. Upon opening the valve, material is dispensed from the chamber.

Some embodiments of product distribution devices including more than one rigid portion, for example the embodiments illustrated in FIGS. 17A-B and 18A-B, include a bag, disposed within the chamber, including or attached to a valve. Upon opening the valve, material is dispensed from the bag.

Figure 19A:
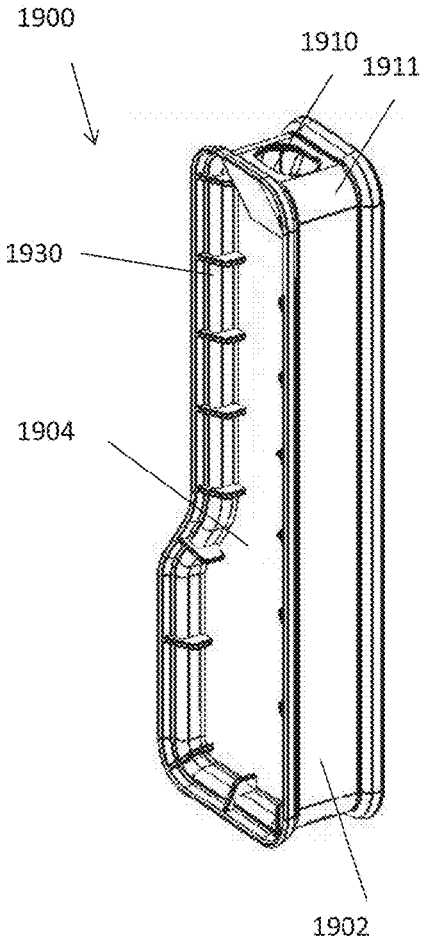
FIG. 19A is a simplified schematic side view of an exemplary product distribution device including two rigid portions each connected at a perimeter to an elastic portion, according to some embodiments of the invention.
Figure 19B:
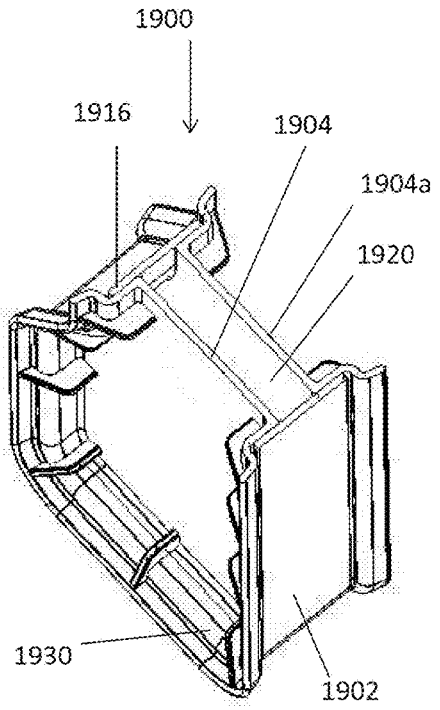
FIG. 19B is a simplified schematic section view an exemplary product distribution device including two rigid portions each connected at a perimeter to an elastic portion, according to some embodiments of the invention.
Figure 19C:
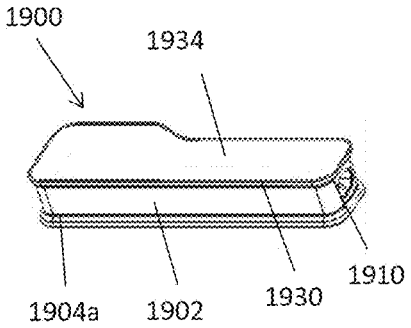
FIG. 19C is a simplified schematic side view of an exemplary product distribution device which includes a rigid portion cover, according to some embodiments of the invention.

FIG. 19A is a simplified schematic side view of an exemplary product distribution device 1900 including two rigid portions each connected at a perimeter to an elastic portion 1902, according to some embodiments of the invention. The embodiment illustrated in FIGS. 19A-C is similar to that illustrated in FIGS. 18A-B. A chamber is the volume enclosed by elastic portion 1902 and the two rigid portions 1904, 1904*a*.

In some embodiments, one or more rigid portion part is reinforced. In some embodiments, rigid portion 1904 includes a reinforced ridge 1930 (in some embodiments, rigid portion 1904*a*, includes a reinforced ridge, not visible in the illustration). In some embodiments, reinforced ridges (e.g. ridge 1930) provide structural strength to the rigid portions (e.g. rigid portion 1904) at attachment with elastic portion 1902. In some embodiments, elastic portion 1902 is attached stretched around the rigid portion, for example, rigid portion reinforced ridges resist compressive force of the elastic portion thereon. In some embodiments, reinforced ridges resist bending and/or breaking under applied pressure (e.g. from elastic portion and/or from pressurized material within chamber 1920). In some embodiments reinforced ridges provide structural strength to rigid portions using a smaller amount of material than reinforcing, for example, all of the rigid portion. In some embodiments, reinforced ridge is reinforced by thickening, honeycombing, reinforcing materials e.g. metal, or other structural reinforcing methods of the art.

In some embodiments, device 1900 includes a rigid part outlet connector 1911. In some embodiments, outlet connector 1911 reinforces the outlet, optionally preventing the outlet from closing.

FIG. 19B is a simplified schematic section view of an exemplary product distribution device 1900 including two rigid portions each connected at a perimeter to an elastic portion 1902, according to some embodiments of the invention. In some embodiments, rigid portions 1904 and 1904*a* each include a flat plate surrounded by reinforced ridge 1930. In some embodiments, reinforced ridge 1930 provides a surface, e.g. a flange 1916, for attachment of the rigid portions to elastic portion 1902: Elastic portion 1902 is attached between the flange of first rigid portion 1904 and the flange of second rigid portion 1904*a*.

FIG. 19C is a simplified schematic side view of an exemplary product distribution device 1900 which includes a rigid portion cover 1934, according to some embodiments of the invention. In some embodiments, rigid portion cover 1934 is a flat element attached to reinforced ridge 1930. In some embodiments, a gap between the plate section of rigid portions 1904 and 1904*a* allows the plate to distort or bend under pressure (e.g. upon filling device with material) without affecting an external visual shape of the rigid portions.

In some embodiments, when the device is empty, rigid portions e.g. 1904, 1904*a* are in close contact (e.g. with a separation between the surfaces of the rigid portions defining the chamber of less than 3 mm, less than 1 mm, less than 0.5 mm) In some embodiments, the elastic portion is attached at a distance (e.g., 1 mm, 2 mm, 3 mm, 5 mm or intermediate or greater distances) from the rigid portions surface which defines the chamber. For example, as illustrated in FIG. 19B, elastic portion 1902 is attached to flanges (e.g. element 1916), for example, as illustrated in FIG. 23B where elastic portions 2302 are attached to edges of rigid portions 2304, 2304*a*. Optionally, this allows the elastic portion to have a non-zero size, when the rigid portions contact each other. Optionally or alternatively, this allows the elastic portion to stretch by a smaller ratio, while still providing a usable chamber volume. For example, if a minimal chamber thickness is 1 mm, and the elastic band is 1 mm wide, then 100% elongation will provide only 1 mm of chamber increase in dimension. If, however, the band includes another 9 mm which overlap with the rigid portion but are allowed to stretch, a 50% elongation will already provide a 5 mm increase in chamber dimension.

Exemplary Devices with Movable Rigid Portions and/or End to End Connection

In some embodiments, both rigid portions and elastic portions move apart when elastic portions stretch or retract (e.g. when chamber is filled or when dispensing from the chamber). In some embodiments, product distribution devices include and/or the chamber is defined by more than one elastic portion and more than one rigid portion.

Figure 20A:
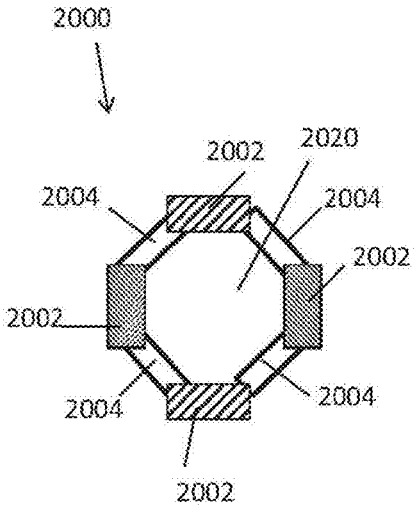
FIG. 20A is a simplified cross sectional view of an empty product distribution device where multiple elastic and rigid portions are attached end to end according to some embodiments of the invention.
Figure 20B:
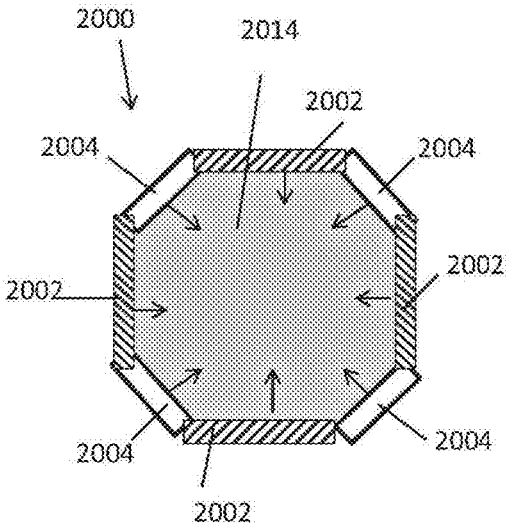
FIG. 20B is a simplified cross sectional view of a filled product distribution device product distribution device where multiple elastic and rigid portions are attached end to end, according to some embodiments of the invention.

In some embodiments rigid and/or elastic portions are attached end to end where, for example, two or more ends of each elastic portion are attached each to a different rigid portion. FIG. 20A is a simplified cross sectional view of an empty product distribution device 2000 where multiple elastic and rigid portions are attached end to end, according to some embodiments of the invention. Device 2000 includes four elastic portions 2002 and four rigid portions 2004. Each elastic portion is attached at a first and a second end to a different rigid portion and each rigid portion is attached at a first and second end to a different elastic portion. A chamber 2020, is the volume enclosed by the elastic and rigid portions. FIG. 20B is a simplified cross sectional view of a filled product distribution device 2000 where multiple elastic and rigid portions are attached end to end. Upon filling of the chamber with material 2014, elastic portions 2002 have stretched extending in length, moving themselves and rigid portions radially outwards. Elastic portions 2002 and rigid portions 2004 compress material within the chamber. Compressive forces on the material are illustrated by arrows.

In some embodiments, for example, before filling, and/or as the chamber reduces in volume during dispensing, one or more portion of the device folds or collapses. For example, in some embodiments, elastic portions of the embodiment illustrated by FIGS. 20A-B fold, reducing the volume of chamber 2020 to less than that illustrated in FIG. 20A.

In some embodiments, a rigid element (not illustrated), disposed inside chamber 2020, optionally filling chamber 2020 as illustrated in FIG. 20A. A potential benefit being a lower residual material volume after dispensing is finished.

Exemplary Chamber Defined by Elastic Portion/s

Figure 21A:
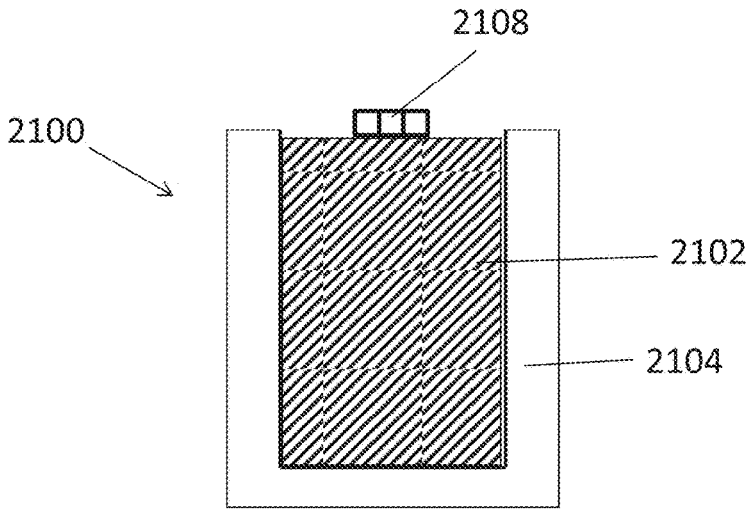
FIG. 21A is a simplified schematic side view of a product distribution device where a chamber is defined between two elastic portions attached to a rigid frame, according to some embodiments of the invention.
Figure 21B:
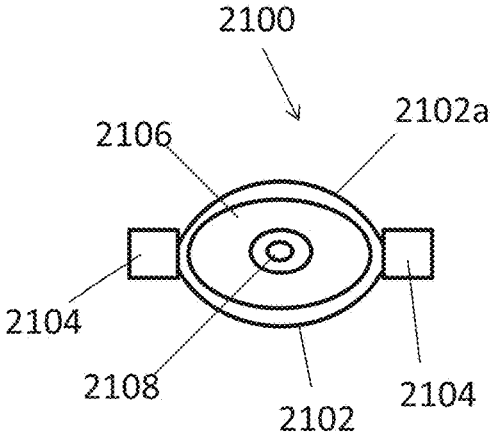
FIG. 21B is a simplified schematic top view of a product distribution device where a chamber is defined between two elastic portions attached to a rigid frame, according to some embodiments of the invention.
Figure 21C:
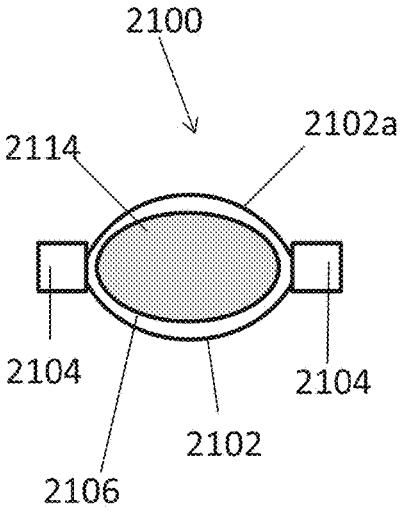
FIG. 21C is a simplified cross sectional view of a filled product distribution device where a chamber is defined between two elastic portions attached to a rigid frame, according to some embodiments of the invention.

In some embodiments, the chamber walls are defined by elastic portions only and a rigid portion defines the shape of the chamber. For example, a sleeve elastic portion, more than one elastic portion stretched between one or more rigid portion. In some embodiments, product distribution devices include more than one elastic portion. FIG. 21A is a simplified schematic side view of a product distribution device 2100 where a chamber is defined between two elastic portions attached to a rigid frame 2104, according to some embodiments of the invention. In some embodiments, rigid frame 2104 is u-shaped. FIG. 21B is a simplified schematic top view of a product distribution device 2100 where a chamber is defined between two elastic portions attached to a rigid frame 2104, according to some embodiments of the invention. FIG. 21C is a simplified cross sectional view of a filled product distribution device 2100 where a chamber is defined between two elastic portions 2102, 2102*a* attached to a rigid frame 2104, according to some embodiments of the invention. Bag 2106 is filled with material 2114.

In some embodiments, a first elastic portion 2102 and a second elastic portion 2002*a*, are both attached at sides and bases to rigid portion 2104, forming a pocket-like chamber shape therebetween.

Alternatively, in some embodiments, first elastic portion 2102 and second elastic portion 2102*a* are attached to rigid portion 2104 at the sides (and not at the base) of the elastic portions forming a bottomless chamber shape therebetween. In some embodiments, two or more elastic portions are attached within a package defining a chamber between the elastic portions.

Similarly, in some embodiments, an elastic sleeve is attached at one or more point to a rigid part, for example, an elastic sleeve is attached to rigid portion 2104 as illustrated in FIG. 21A.

Filling chamber 2120 stretches first elastic portion 2102 and second elastic portion 2102*a*, which apply compressive pressure to the chamber. In some embodiments, a bag 2106 including or attached to a valve 2108 is placed inside the chamber and the device is filled by filing the bag.

Figure 22A:
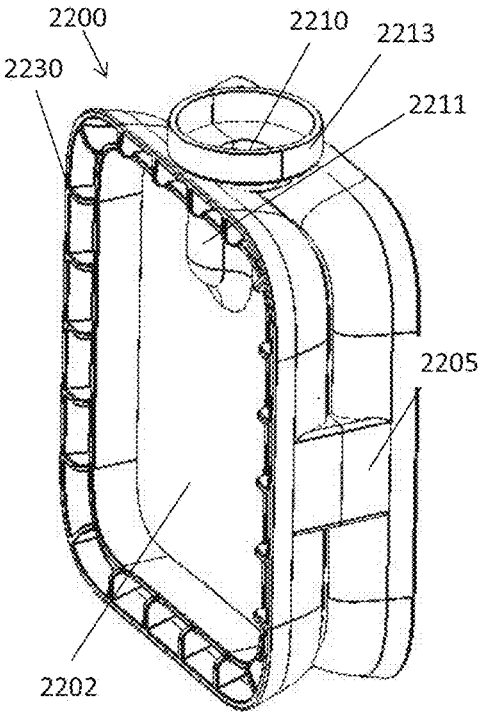
FIG. 22A is a simplified schematic side view of a product distribution device which includes a first elastic portion, a second elastic portion and a rigid portion, according to some embodiments of the invention.

FIG. 22A is a simplified schematic side view of a product distribution device 2200 which includes a first elastic portion 2202, a second elastic portion 2202*a* and a rigid portion 2204, according to some embodiments of the invention. Rigid portion 2204 includes an outlet 2210. In some embodiments, each rigid portion further includes reinforced walls 2230. In some embodiments, reinforced walls 2230 resist bending or distorting under applied pressure (e.g. from elastic portion and/or from pressurized material within chamber 1220).

In some embodiments, elastic portions include a bulge 2111.

In some embodiments, one or more part of a valve extends into the chamber. Bulge 2111 illustrates a shape of the elastic portion 2202, stretched around a part of a valve inserted into the chamber.

In some embodiments, bulge 2111 illustrates an outlet adaptor. In some embodiments outlet adaptor 2111 prevents pinching of elastic portions together before device 2100 is substantially empty of material. In some embodiments outlet adaptor 2111 provides a surface for attachment of a valve to the outlet and/or chamber. In some embodiments, outlet adaptor 2111 is a shaped or reinforced part of elastic portion 2102.

In some embodiments, device includes an outlet reinforcement 2113 which, in some embodiments, is ring shaped. In some embodiments, outlet reinforcement withstands pressures at the outlet, e.g. holding the outlet open, and/or assists connection to another component e.g. to a valve. In some embodiments, outlet reinforcement is a 2113 valve connector, as known in the art, for attachment of device 2200 to a valve.

Figure 22B:
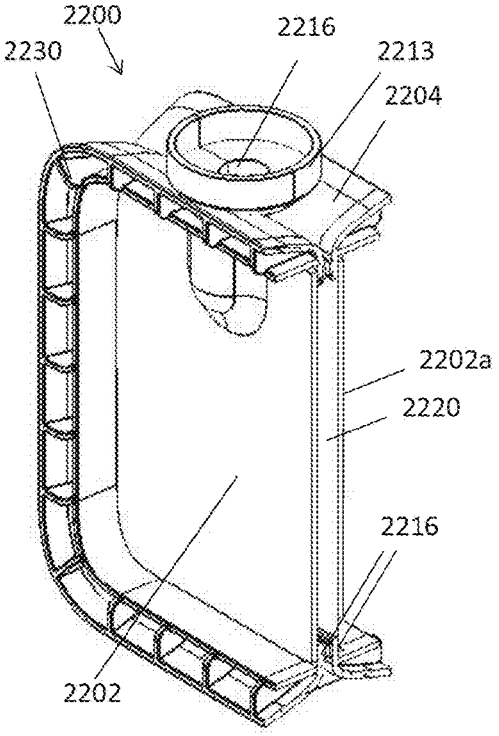
FIG. 22B is a simplified section view of a product distribution device which includes a first elastic portion, a second elastic portion and a rigid portion, according to some embodiments of the invention.

FIG. 22B is a simplified section view of a product distribution device 2200 which includes a first elastic portion 2202, a second elastic portion 2202*a* and a rigid portion 2204, according to some embodiments of the invention. A chamber 2220 is the volume enclosed by first elastic portion 2202, second elastic portion 2202*a* and rigid portion 2204.

In some embodiments rigid portion walls 2230 include two flanges 2216 to which the two elastic portions are attached. Alternatively, in some embodiments, one or more elastic portion is attached by pressure between two rigid components. For example, elastic portions 2102, 2102*a*, in some embodiments, are placed in between two halves of rigid portion 2104 by connecting the two halves of rigid portion together, for example, by closing and optionally clamping (e.g. by a clamp 2105).

Figure 22C:
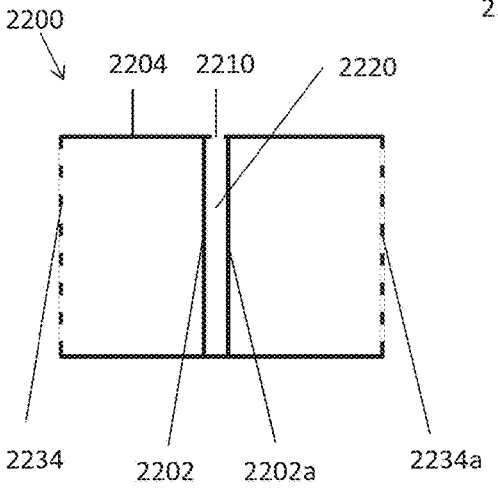
FIG. 22C is a simplified cross sectional view of an empty product distribution device which includes a first elastic portion, a second elastic portion and a rigid portion, according to some embodiments of the invention.

FIG. 22C is a simplified cross sectional view of an empty product distribution device 2200 which includes a first elastic portion 2202, a second elastic portion 2202*a* and a rigid portion 2204, according to some embodiments of the invention. Chamber 2220 is the volume enclosed between elastic portions 2202, 2202*a* and rigid portion 2204.

Figure 22D:
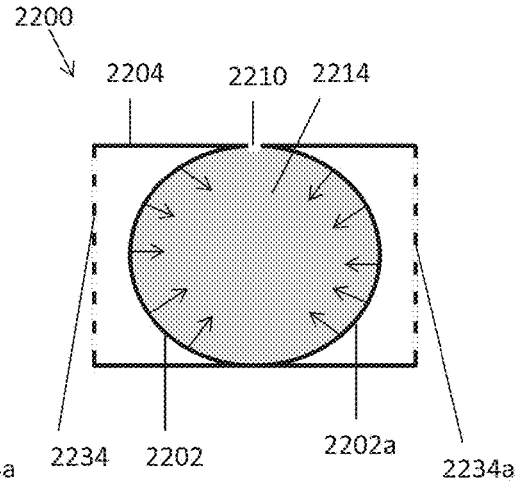
FIG. 22D is a simplified cross sectional view of a filled product distribution device which includes a first elastic portion, a second elastic portion and a rigid portion, according to some embodiments of the invention.

FIG. 22D is a simplified cross sectional view of a filled product distribution device 2200 which includes a first elastic portion 2202, a second elastic portion 2202*a* and a rigid portion 2204, according to some embodiments of the invention. Upon filling of the chamber with material 2214, first elastic portion 2202 and second elastic portion 2202*a* are stretched, compressing material within the chamber. Compressive forces of the elastic portions on the material are illustrated by arrows. Optionally, device 2200 includes a first rigid portion cover 2234 and a second rigid portion cover 2234*a*. In some embodiments, rigid portion covers 2234, 2234*a* are flat elements attached to rigid portion 2204. Covers 2234, 2234, in come embodiments, maintain a device external shape independent of stretching and retracting of the elastic portions. In some embodiments, device 2200 includes a bag placed inside the chamber and the bag is filled with material. In some embodiments, the bag includes or is attached to a valve through which material is dispensed.

Exemplary Multiple Chamber Devices

In some embodiments, product distribution devices include more than one chamber (e.g. two chambers, three chambers, or more than three chambers) each chamber defined by one or more elastic portion and one or more than one rigid portion.

Figure 23A:
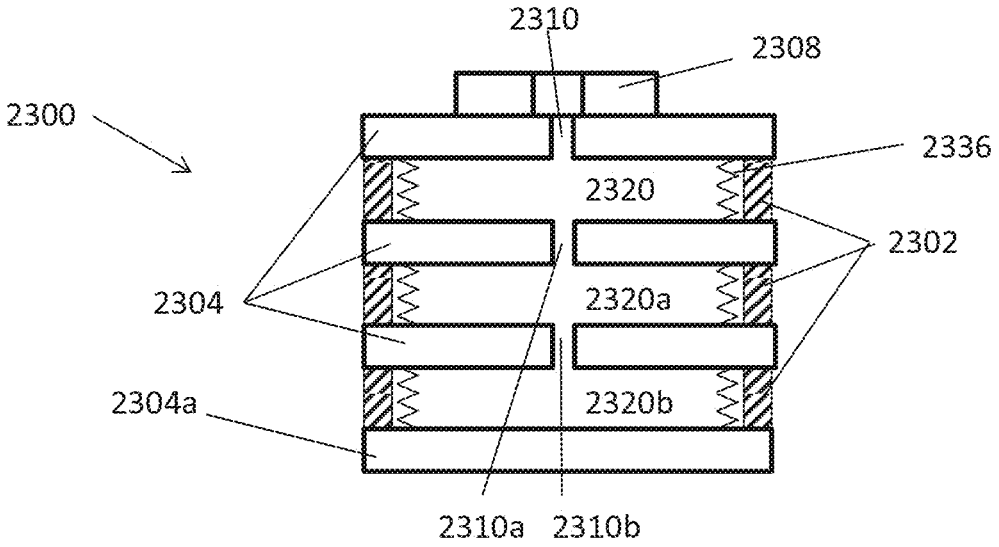
FIG. 23A is simplified cross sectional view of an empty device including three chambers, according to some embodiments of the present invention.
Figure 23B:
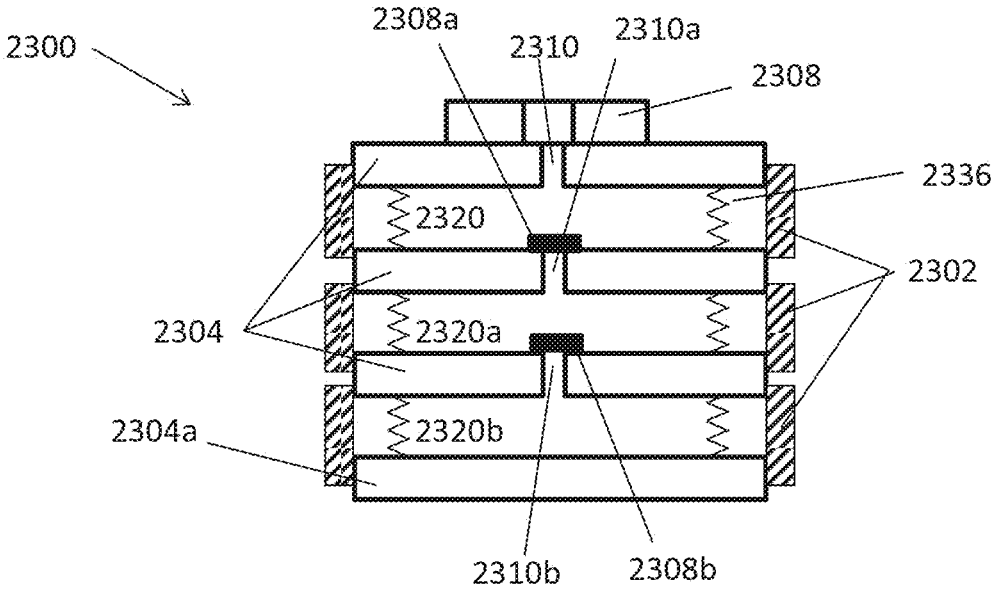
FIG. 23B is simplified cross sectional view of an empty device including three chambers, according to some embodiments of the present invention.

FIG. 23A is simplified cross sectional view of an empty device 2300 including three chambers, according to some embodiments of the present invention. FIG. 23B is simplified cross sectional view of an empty device 2300 including three chambers, according to some embodiments of the present invention. Device 2300 includes a first chamber 2320, a second chamber 2320*a* and a third chamber 2320*b*. Device 2300 further includes three elastic portions 2302 (e.g. elastic sleeves), a base rigid portion (e.g. a disk) 2304*a* and three rigid disks 2304, where each disk includes an outlet. Each elastic portion is attached between two disks. In some embodiments, elastic portions are attached to disk faces e.g. by stretching the elastic portion around the disks. Alternatively, as illustrated by FIG. 23B, elastic portions are attached to disk edges.

In some embodiments, each chamber is the volume enclosed by two disks and an elastic portion. Third chamber 2304*b* connects to second chamber through a third outlet 2310*b* and second chamber connects to first chamber through a second outlet 2310*a*. A valve 2308 is attached to first outlet 2310 and material is dispensed through valve 2308. In some embodiments, second and third outlets include one way valves which allow material to exit, but not enter second and third chambers 2320*a*, 2320*b*. In some embodiments, a device includes one or more valve between multiple chambers; device 2300 includes second valve 2308*a* and third valve 2308*b*.

A potential benefit of multiple chamber devices is the ability to combine elastic portion (e.g. sleeve) sections. A further potential benefit of multiple chamber devices is that, in some embodiments, different chambers have different pressures, e.g. due to different chamber shapes. In some embodiments, different chambers elastic portions' have different properties (e.g. elastic modulus, thickness) for example, providing different pressures to the different chambers. In some embodiments, multiple chambers dispense at different rates, for example due to different chamber pressures. In some embodiments, a multiple chamber device includes more than one outlet, optionally facilitating concurrent dispensing from more than one chamber.

Optionally, the chambers are lined with one or more bags. In some embodiments, the bags include concertina folded walls 2336. In some embodiments, bags are made of, for example, polypropylene (PP) and/or polyethylene (PE).

Figure 23C:
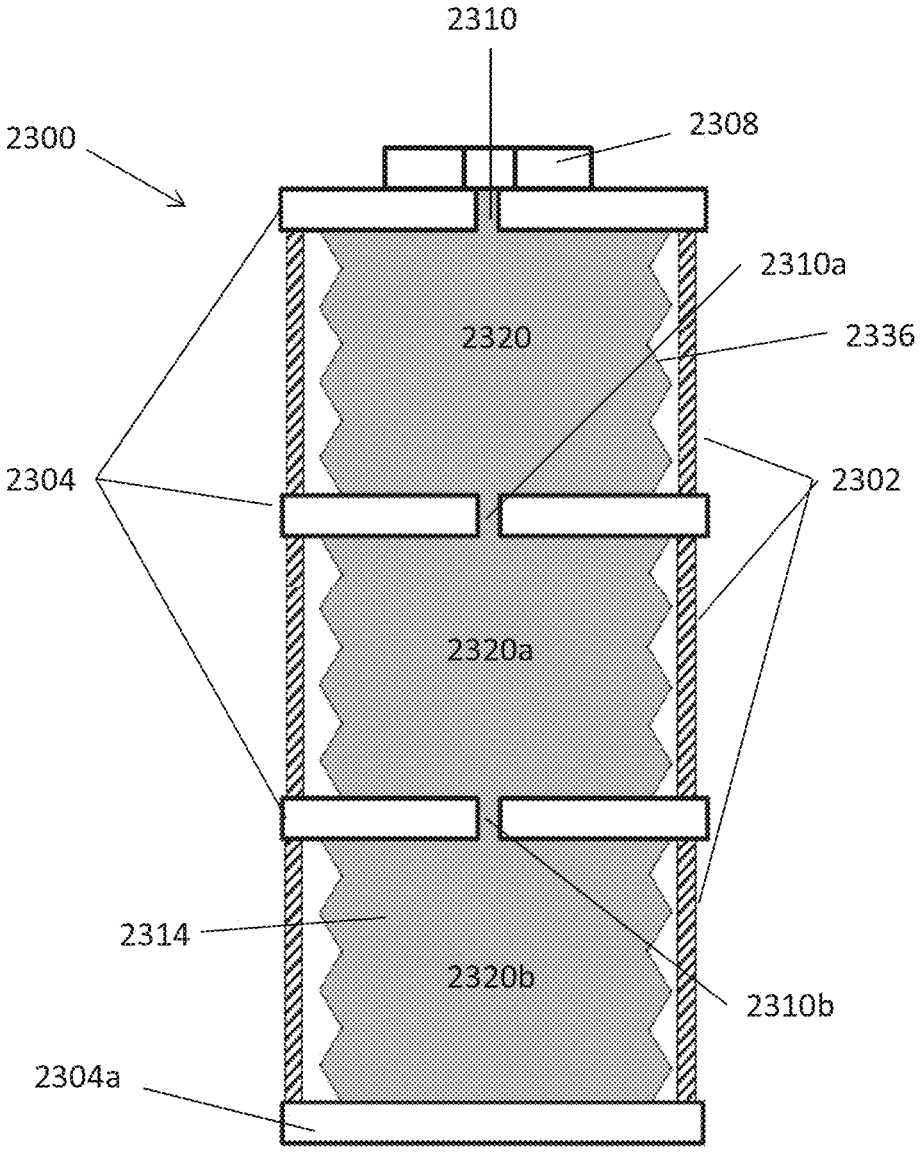
FIG. 23C is simplified cross sectional view of a filled device including three chambers, according to some embodiments of the invention.

FIG. 23C is simplified cross sectional view of a filled device 2300 including three chambers, according to some embodiments of the invention. Upon filling device 2300 with material 2314, elastic sleeves 2302 stretch, increasing separation between disks 2304, 2304*a*. Stretched sleeves 2302 exert pressure on disks 2304, 2304*a*, compressing chambers 2320, 2320*a*, 2320*b*. In some embodiments, upon filling of device 2300, concertina folding sheets 2336 extend by unfolding.

In some embodiments, product distribution devices with multiple chambers are be built by combining other devices described in this document. For example, device 1500 illustrated in FIG. 15A-B, device 1800 illustrated in FIGS. 18A-B.

Figure 24:
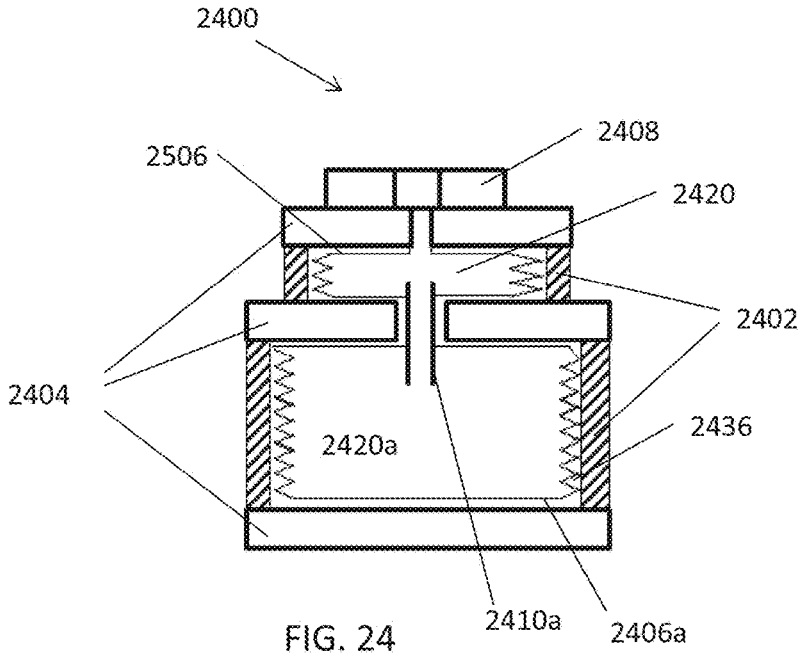
FIG. 24 is a simplified cross sectional view of an empty device different sized chambers, connected by a tube, according to some embodiments of the present invention.

Optionally, multiple chambers have different geometry (e.g. size, shape), a potential benefit being freedom of design thereof (e.g. for branding, marketing). Optionally, chambers and/or bags are attached by tubing. FIG. 24 is a simplified cross sectional view of an empty device 2400 including different sized chambers 2420, 2420*a*, connected by a tube 2410*a*, according to some embodiments of the present invention. Device 2400 includes two chambers 2420, 2420*a*. In some embodiments, bag 2406, 2406*a*, optionally with expanding walls and/or rigid bases are disposed within chambers 2420, 2420*a*. In some embodiments, a connecting device (e.g. tube 2410*a*) connects bags 2405, 2406*a*. Optionally, tube 2410*a* includes a valve.

In some embodiments, multiple chambers dispense sequentially. In some embodiments, multiple chambers dispense concurrently.

In some embodiments, multiple chambers do not share rigid portions, but are separate modules, for example, attached by tubing.

Exemplary Attachment Methods

In some embodiments, elastic portions are attached to rigid portions. In some embodiments, attachment is by screwing and/or gluing and/or crimping. In some embodiments, one or more elastic portion is clamped between two or more rigid portions. In some embodiments, tensile forces of a stretched elastic portion act to attach the elastic portion to a rigid portion. For example, in some embodiments, a sleeve elastic portion is stretched to fit a rigid portion therein, the tensile forces of the stretched elastic holding the rigid portion inside the sleeve. Optionally, the rigid portion includes a feature (e.g. ridges and/or bumps) to prevent the elastic portion from sliding or slipping off.

Figure 25A:
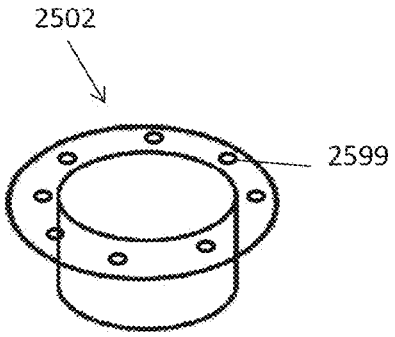
FIG. 25A is a simplified schematic of an exemplary attachment method, according to some embodiments of the invention.

FIG. 25A is a simplified schematic of an exemplary attachment method, according to some embodiments of the invention. An elastic portion 2502 (e.g. hat-shaped) includes attachment holes 2599 for attachment to a rigid portion and/or a package. In some embodiments, attachment through the holes is by screws. Optionally, one or more element (e.g. a washer) is placed between the screw head and the elastic portion. The washer optionally distributes the load of the screw over the elastic portion.

Exemplary Materials of Elastic Portion

In some embodiments, elastic portions are elastic or elastomeric material, optionally rubber-based.

In some embodiments, elastic portions are constructed of elastomeric materials including nano-composites, for example, as described and defined in further detail hereinafter.

Any elastomer can be used within the elastomeric material.

An elastomer is a viscoelastic polymer, which generally exhibits low Young's modulus (Tensile Modulus) and high yield strain compared with other materials. Elastomers are typically amorphous polymers existing above their glass transition temperature, so that considerable segmental motion is possible. At ambient temperatures, rubbers are thus relatively soft (E of about 3 MPa) and deformable.

Elastomers are usually thermosetting polymers (or copolymers), which require curing (vulcanization) for cross-linking the polymer chains. The elasticity is derived from the ability of the long chains to reconfigure themselves to distribute an applied stress. The covalent cross-linking ensures that the elastomer will return to its original configuration when the stress is removed. Elastomers can typically reversibly extend from 5% to 700%.

Synthetic elastomer is typically made by the polymerization of a variety of petroleum-based precursors called monomers. The most prevalent synthetic elastomers are styrene-butadiene rubbers (SBR) derived from the copolymerization of styrene and 1,3-butadiene. Other synthetic elastomers are prepared from isoprene (2-methyl-1,3-butadiene), chloroprene (2-chloro-1,3-butadiene), and isobutylene (methylpropene) with a small percentage of isoprene for cross-linking. These and other monomers can be mixed in various proportions to be copolymerized to produce elastomeric materials with a range of physical, mechanical, and chemical properties.

Natural rubber is known to be consisted mainly from isoprene monomers, and is typically characterized by high resilience (which reflects high elasticity), large stretch ratio, yet lower mechanical strength. By "natural rubber" reference is typically made to natural elastomers that form the rubber upon vulcanization. Such elastomers, in addition to being cost-effective and avoiding the need to synthesize elastomers, are further advantageous due to their properties (e.g., low viscosity and easy mixing) which facilitate their processing into rubbers.

Rubbery (elastomeric) materials may further include, in addition to a rubbery polymer or copolymer (elastomer), ingredients which may impart to the rubber certain desirable properties. The most commonly utilized ingredients are those that cause crosslinking reactions when the polymeric mix is cured (or vulcanized), and are usually consisting of sulfur and one or more "accelerators" (e.g., sulfenamides, thiurams or thiazoles), which make the sulfur cross-linking faster and more efficient.

Two other ingredients that play an important role in vulcanization chemistry are known as "activators" and commonly include zinc oxide and stearic acid. These compounds react with one another and with accelerators to form zinc-containing intermediate compounds, which play a role in the formation of sulfur crosslinks.

Many other materials can been added to rubbery materials, to produce elastomeric materials. The most commonly practiced materials, which are referred to herein and in the art as "fillers" or "reinforcing agents", include finely divided carbon black and/or finely divided silica.

Both carbon black (CB) and silica, when added to the polymeric mixture during rubber production, typically at a concentration of about 30-50 percents by volume, raise the elastic modulus of the rubber by a factor of two to three, and also confer remarkable toughness, especially resistance to abrasion, on otherwise weak materials such as natural rubber. If greater amounts of carbon black or silica particles are added, the modulus is further increased, but the strength may be lowered.

Reinforcement of rubbers with carbon black or silica may disadvantageously result in rubbers characterized by lower elongation, lower springiness (resilience) and decreased stiffness after flexing. Elastomeric composites containing carbon black and/or silica are thus relatively brittle at low temperatures.

To this effect, studies have focused in recent years on the developments of hybrid nanocomposites as an alternative to heavily filled elastomers. Such nanofillers are typically made of nanoparticles, such as nanoclays, which are clays modified so as to obtain clay complexes that are compatible with organic monomers and polymers (also referred to herein and in the art as compatibilizers).

Exemplary nanofillers are described in Das et al., European Polymer Journal 44 (2008) 3456-3465, available at www(dot)elsevier(dot)com/locate/europolj; Das et al. Composites Science and Technology, Issue 71 (2011), Pages 276-281, available at www(dot)elsevier(dot)com/locate/compscitech; Yoong Ahm Kim wt al. Scripta Materialia, Issue 54 (2006), Pages 31-35, available at www(dot)sciencedirect(dot)com; and Xin Bai, et al. Carbon, Volume 49, Issue 5, April 2011, Pages 1608-1613, available at www(dot)elsevier(dot)com/locate/carbon.

Nanoclays are easily compounded and thus present an attractive alternative to traditional compatibilizers. Nanoclays have been known to stabilize different crystalline phases of polymers, and to possess the ability of improving mechanical and thermal properties. For improved performance and compatibility, nanoclays are typically modified so as to be associated with organic moieties, and the modified nanoclays are often referred to as organomodified nanoclays. Organomodified nanoclays are typically prepared by treatment with organic salts. Negatively charged nanoclays (e.g., montmorillonites) are typically modified with cationic surfactants such as organic ammonium salts or organic phosphonium salts, and positively charged nanoclays (e.g., LDH) are typically modified by anionic surfactants such as carboxylates, sulfonates, etc.

U.S. patent application Ser. Nos. 13/546,228 and 13/949,456, which are incorporated by reference as if fully set forth herein, describe elastomeric composites comprising modified nanoclays made of a nanoclay, such as organomodified nanoclay, further modified so as to be in association with an amine-containing antioxidant and optionally also with a silyl-containing compound, such as mercaptosiloxane.

In some embodiments, elastomeric material as described herein is made of an elastomer as described herein.

In some embodiments, elastomeric material as described herein is made of an elastomeric composite comprising an elastomer, as described herein, and a filler and/or a nanofiller.

In some embodiments, threads or narrow bands or fibers or other connecting or elastic materials may be added to a rubber (an elastomer) or other material to enhance elastic characteristics. In some embodiments, nano-particles of clay or other materials are added to rubber as nanofillers. In general, rubbers having high ultimate elongation have low modulus. In some embodiments, a reinforcing material (e.g., filler and/or nanofiller) is incorporated in a rubber, to increase rigidity of the rubber while enabling a desired level of elongation (elasticity). In some embodiments nano-particles (nonofiller) are used as the reinforcing material.

Selection of quantity and type of nano particles and/or other reinforcing materials, and methods of processing them, may depend on desired performance characteristics and/or thickness or other desired physical characteristics of an apparatus designed for a particular application.

Elastomeric composites according to some embodiments of the present invention comprise nanofillers as described herein. In general, elastomeric composites which comprise nanofillers are also referred to herein and in the art as nanocomposites or elastomeric nanocomposites.

Hereinthroughout, the term "nanofiller" is used herein and in the art collectively to describe nanoparticles useful for making nanocomposites as described herein, which particles can comprise layers or platelet particles (platelets) obtained from particles comprising layers and, depending on the stage of production, can be in a stacked, intercalated, or exfoliated state.

In some embodiments, the nanofillers comprise particles of a clay material and are referred to herein and in the art as nanoclays (or NCs).

In some embodiments, the nanofiller is made of carbon and includes, for example, carbon nanotubes, graphene particles, and any other nanofiller as defined herein and as known in the art.

In some embodiments, the nanofillers are treated nanofillers, typically organomodified nanofillers, as described herein.

The elastomeric nanocomposite can comprise more than one type of a nanofiller.

Additional embodiments pertaining to a nanofiller are provided hereinbelow.

In some embodiments, the nanofiller is a nanoclay, as defined herein and/or is known in the art.

In some embodiments, the nanofiller is a modified nanofiller.

Modified nanofillers are nanofillers as described herein which have been treated so as to modify the surface thereof by inclusion of organic moieties (e.g., treated with cationic or anionic surfactants, or surface active agents, as described herein).

As used herein, the term "surfactant", which is also referred to herein interchangeably as "a surface-active agent" describes a substance that is capable of modifying the interfacial tension of the substance with which it is associated.

In some embodiments, the modified nanofiller includes organomodified nanoclays. In some embodiments, the nanoclay is montmorillonite.

In some embodiments, the nanoclay comprises montmorillonite treated with a cationic surfactant such as an organic ammonium salt or organic amminium salt.

Such cationic surfactants typically include primary, secondary or tertiary amines comprising at least one hydrocarbyl chain, preferably a hydrocarbyl that comprises at least 4 carbon atoms, or at least 5, 6, 7, 8, 9, 10, 11, 12, and even more carbon atoms.

In some of any of the embodiments described herein, elastomeric material comprises or is made of an elastomeric composite that comprises an elastomer and a modified nanoclay or a composition-of-matter comprising the nanoclay, as described, for example hereinbelow.

In some embodiments, the modified nanoclay is such that is treated with compounds that are typically used as antioxidants, and optionally further treated with a mercaptosilane, such as mercaptosiloxane. Such nanoclay hybrids are advantageous by for example, imparting higher tear and/or abrasion resistance to elastomeric composites containing same and by reducing ageing of the elastomeric composites. Further manipulations in the process of preparing nanoclay hybrids were also shown to improve performance of the nanoclays, when incorporated in an elastomeric composite.

In general, elastomeric composites as described in these embodiments were shown to exhibit improved properties over elastomeric composites containing a similar content of other modified nanoclays (e.g., devoid of an antioxidant). Exemplary improvements are demonstrated in elastic properties such as rebound (Yerzley resilience, tangent), tear resistance and ageing properties. In addition, lighter products are obtained for the same degree of reinforcement, as compared to elastomer composites with prior art components.

For example, it has been demonstrated that elastomeric composites containing the herein disclosed modified nanoclays exhibit very high tear resistance, even higher than 60 N/mm Elastomers, which do not contain NCs, and which are designed to have such high tear resistance, typically contain as much as 50-60 parts CB (carbon black), yet, may still fail to accomplish the desired mechanical properties. In contrast, in elastomeric composites as described herein, replacing up to 35 parts of the CB or about 30 phr silica, with merely about 15-20 parts NCs was found to achieve the same strength.

Herein throughout, the terms "parts" and "7 phr" are used interchangeably.

Herein throughout and in the art, "7 phr" refers to parts per hundred of rubber. That is, if Mr represents the mass of an elastomer or of a mixture of monomers for composing an elastomer (a rubber), and Mx represents the mass of a component added to the rubber, then the phr of this component is: $100 \times Mx/Mr$.

Herein throughout, an "elastomeric composite" refers to a composition comprising an elastomeric material (e.g., an elastomeric polymer or co-polymer, either before or after vulcanization (e.g., cross-linking)). The elastomeric composite may further comprise additional components, which are typically added to elastomeric polymer or co-polymer mixtures in order to provide elastomers such as rubbers. These include, for example, accelerators, activators, vulcanization agents (typically sulfur), and optionally dispersants, processing aids, plasticizers, fillers, and the like.

Elastomeric composites according to embodiments of the present invention comprise modified nanoclays as disclosed herein. In general, elastomeric composites which comprise nanoparticles such as the modified nanoclays as disclosed herein are also referred to herein and in the art as nanocomposites or elastomeric nanocomposites.

The phrase "elastomeric composite" as described herein refers to both a composition containing all components required for providing an elastomeric composite (e.g., before vulcanization is effected), and the composite product resulting from subjecting such a composition to vulcanization.

In some embodiments, "nanocomposite(s)" and "nanocomposite composition(s)" refer to a polymeric material (including copolymer) having dispersed therein a plurality of individual clay platelets obtained from a layered clay material.

In some embodiments, the elastomeric composite comprises a composition-of-matter which comprises a modified nanoclay, wherein the modified nanoclay comprises a nanoclay being in association with an amine-containing compound that features an antioxidation activity. The amine-containing compound is also referred to herein as "antioxidant".

The composition-of-matter can comprise a plurality of modified nanoclays, being the same or different, optionally in combination with organomodified nanoclays as described herein (which are not in association with an antioxidant as described herein) and/or with non-modified nanoclays.

The composition-of-matter may comprise one or more modified nanoclays in which a nanoclay is in association with one or more amine-containing compounds featuring an antioxidation activity, as defined herein.

As used herein, the phrase "association" and any grammatical diversion thereof (e.g., "Associated") describe associated via chemical and/or physical interactions. When association is via chemical interactions, the association may be effected, for example, by one or more covalent bonds and/or by one or more non-covalent interactions. Examples of non-covalent interactions include hydrogen bonds, electrostatic interactions, Van der Waals interactions and hydrophobic interactions. When associated via physical interactions, the association may be effected, for example, via absorption, entrapment, and the like.

A modified nanoclay as described herein or a composition-of-matter containing same are also referred to herein as "nanoclay hybrid".

Hereinthroughout, the term "nanoclay" (or NC) refers to particles of a clay material, useful for making nanocomposites, which particles can comprise layers or platelet particles (platelets) obtained from particles comprising layers and, depending on the stage of production, can be in a stacked, intercalated, or exfoliated state.

In some embodiments, the nanoclays comprise montmorillonite.

In some embodiments, the nanoclays are organomodified nanoclays, that is, nanoclays as described herein which have been treated so as to modify the surface thereof by inclusion of organic moieties (e.g., treated with cationic or anionic surfactants, or surface active agents, as described hereinabove).

In some embodiments, the nanoclay comprises montmorillonite treated with a cationic surfactant such as an organic ammonium salt or organic amminium salt. Such cationic surfactants typically include primary, secondary or tertiary amines comprising at least one hydrocarbyl chain, preferably a hydrocarbyl that comprises at least 4 carbon atoms, or at least 5, 6, 7, 8, 9, 10, 11, 12, and even more carbon atoms.

As used herein, a "hydrocarbyl" collectively encompasses chemical groups with a backbone chain that is composed of carbon atoms, mainly substituted by hydrogens. Such chemical groups include, for example, alkyls, alkenyls, alkynyls, cycloalkyls, aryls, alkaryl and aralkyls, as these terms are defined herein, and any combination thereof. Some of the hydrogen atoms can be substituted.

Exemplary cationic surfactants include salts of tallow amines.

Tallow is a hard fat consists chiefly of glyceryl esters of oleic, palmitic, and stearic acids (16-18 carbon chains). Tallow amines are tallow based alkyl amines, or fatty amines Non-limiting examples of tallow based alkyl amines include: Tallow amine (CAS RN: 61790-33-8), Hydrogenated tallow amine (CAS RN: 61788-45-2), Di(hydrogenated tallow)amine (CAS RN: 61789-79-5), Dihydrogenated tallow methyl amine (CAS RN: 61788-63-4), and N-(Tallow alkyl)dipropylenetriamine (CAS RN: 61791-57-9). Additional examples include, but are not limited to, hydrogenated tallow dimethyl benzyl amine, dihydrogenated tallow dimethylamine, hydrogenated tallow dimethylamine, N-2-ethylhexyl tallow amine, and methyl tallow, bis-2-hydroxyethyl.

Nanoclays modified by tallow amines or any other surface active agent can be modified by one or more of the salts described herein.

Exemplary commercially available organomodified nanoclays include, but are not limited to, Cloisite 10A, 15A, 20A, 25A and 30B of Southern Clays; Nanomer 1.31ps, 1.28E and 1.34 TCN of Nanocor. In general, the commercially available organomodified NCs are montmorillonites in which sodium ions are exchanged with ammonium or amminium ions.

In embodiments where the nanoclay comprises organomodified nanoclays, it may include one type of organomodified nanoclays or two or more types of differently modified nanoclays or a mixture of organomodified and non-modified nanoclays.

It is to be noted that when modified nanoclays, such as organomodified nanoclays, are utilized as the nanoclays of which the composition-of-matter as described herein comprises, these organomodified nanoclays are further modified by an amine-containing compound as described herein and hence are in association with both a surface active agent, as described herein (e.g., derived from a tallow ammonium salt), and with an amine-containing compounds as described herein. Embodiments of the present invention also encompass organomodified nanoclays in which the surfactant is an amine-containing compound as described herein. Such organomodified nanoclays are further treated with an amine-containing compound as described herein.

Herein, an "amine-containing compound featuring an antioxidation activity" is also referred to as "antioxidant".

As known in the art, and is used herein, an antioxidant is a substance which is added, typically in small quantities, to formulations or products which are susceptible to oxidation, so as to inhibit or slow oxidative processes, while being oxidized by itself or otherwise interacting with the oxidative species.

In the context of elastomeric compositions or composites, antioxidants are typically used for inhibiting or slowing oxidative degradation of the polymeric network. Oxidative degradation of polymers often occurs as a result of free radicals, and antioxidants of polymeric materials are often fee radical scavengers. Such antioxidants are often called antiozonates. Such antioxidants typically act by donating an electron or hydrogen atom to the formed radical, to thereby inhibit the free-radical degradation.

Herein, an antioxidant encompasses any anti-oxidant that is suitable for use in the elastomeric formulation/rubber fields.

In some embodiments, the antioxidant is a compound containing at least one amine group, as defined herein, and preferably two or more amine groups. Without being bound by any particular theory, it is assumed that such amine-containing compounds exhibit a dual effect: binding to the nanoclay (e.g., via one or more amine groups), and acting as an antioxidant (e.g., via one or more free, non-bound amine groups).

Binding to the nanoclay via more than one amine group in an amine-containing compound as described herein may improve the strength of the elastomeric composite containing the composition-of-matter.

Antioxidants containing one or more amine groups include, but are not limited to, compounds comprising stearically hindered amines, such as, for example, p-phenylene diamines (p-PDA), ethylene diurea derivatives, substituted dihydroquinolines, alkylated diphenyl amines, substituted phenolic compounds having one or more bulky substituents, as defined herein, diphenylamine-acetone reaction products, tris(nonyl phenyl) phosphates or amine compounds substituted by one or more alkyls and/or one or more bulky substituents, as defined herein. Other amine-containing compounds that exhibit antioxidation activity, preferably as free radical scavengers or as antiozonates in the rubber filed, are contemplated.

In some embodiments, the amine-containing compound is a para-phenylenediamine (p-PDA). In some embodiments, the p-PDA is a N,N'-disubstituted-p-phenylenediamine, including symmetrical N,N'-dialkyl-p-phenylenediamines and N,N'-diaryl-p-phenylenediamines, and non-symmetrical The N-alkyl, N'-aryl-p-phenylenediamines.

Non-limiting examples of p-PDAs which are suitable for use in the context of the present embodiments are depicted in Scheme 1 below.

Scheme 1

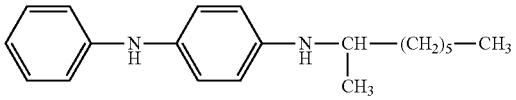

N-(1-Methylheptyl)-N′-phenyl-p-phenylenediamine (MHPPD)

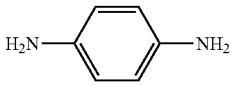

p-Phenylenediamine (PPD)

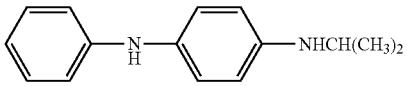

N-Isopropyl-N′-phenyl-p-phenylenediamine (IPPD)

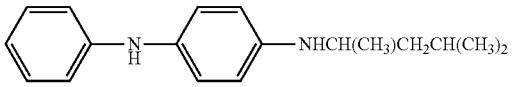

N-1,3-Dimethylbutyl-N′-phenyl-p-phenylenediamine (DMBPPD)

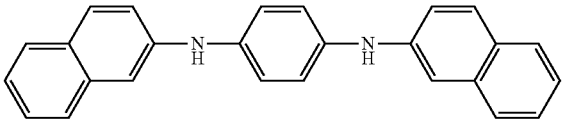

N,N′-Di-2-naphtyl-p-phenylenediamine (DNPD)

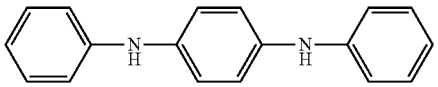

N,N′-Diphenyl-p-phenylenediamine (DPPD)

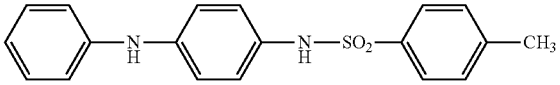

p′-(p-Toluenesulfonylamido)diphenylamine (TSDP)

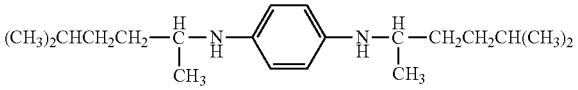

N,N′-Di(1,4-dimethylpentyl)-p-phenylenediamine (DMPPD)

Herein, ethylene diurea derivatives are compounds which can be collectively represented by the general formula:

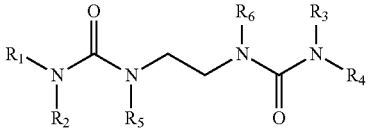

wherein:

$R_1$, $R_2$, $R_3$ and $R_4$, and/or $R_5$ and $R_6$ are each independently selected from the group consisting of hydrogen, alkyl, alkenyl, alkynyl, cycloakyl, aryl, alkaryl, aralkyl, alkenyl, alkynyl, each being optionally substituted as defined herein, and optionally and preferably, at least one of $R_1$, $R_2$, $R_3$ and $R_4$, and/or $R_5$ and $R_6$ is a bulky substituent, as described herein.

An exemplary bulky substituent in the context of these embodiments is 3,5-dihydrocarbyl-4-hydroxyphenylalkyl group.

In some embodiments, the antioxidant is a p-PDA, such as IPPD or DMBPPD (also referred to as 6PPP).

In some embodiments, the antioxidant is an amine substituted by one or more alkyl and/or other bulky substituents. Such antioxidants include, for example, tertiary amines such as triethylamine or any other amine substituted by 3 hydrocarbyl groups, as defined herein, whereby each hydrocarbyl group can independently be of 2-24 carbon atoms, such as, N,N-dimethyldodecan-1-amine (DDA; CAS number: 83855-88-1); and primary amines such as, but not limited to, dodecylamine.

As used herein, the phrase "bulky", in the context of a substituent, describes a group that occupies a large volume. A bulkiness of a group is determined by the number and size of the atoms composing the group, by their arrangement, and by the interactions between the atoms (e.g., bond lengths, repulsive interactions). Typically, lower, linear alkyls are less bulky than branched alkyls; bicyclic molecules are more bulky than cycloalkyls, etc.

Exemplary bulky groups include, but are not limited to, branched alkyls such as tert-butyl, isobutyl, isopropyl and tert-hexyl, as well as substituted alkyls such as triphenylmethane (trityl) and cumaryl. Additional bulky groups include substituted or unsubstituted aryl, alkaryl, aralkyl, heteroaryl, cycloalkyl and/or heteroalicyclic, as defined herein, having at least 6 carbon atoms.

In some embodiments, a bulky substituent comprises more than 4 atoms, more than 6 atoms, preferably more than 8 atoms, or more than 12 atoms.

The term "amine" describes a —NR'R" group, with R' and R" being hydrogen, alkyl, cycloalkyl or aryl, as defined herein. Other substituents are also contemplated. The term "amine" also encompasses an amine group which is not an end group, such as, for example, a —NR'— group, in which R' is as defined herein.

The term "alkyl", as used herein, describes a saturated aliphatic hydrocarbon including straight chain and branched chain groups. In some embodiments, the alkyl group has 1 to 20 carbon atoms. Whenever a numerical range; e.g., "1-20", is stated herein, it implies that the group, in this case the alkyl group, may contain 1 carbon atom, 2 carbon atoms, 3 carbon atoms, etc., up to and including 20 carbon atoms. In some embodiments, the alkyl is a lower alkyl having 1 to 4 carbon atoms. The alkyl group may be substituted or unsubstituted, as indicated herein.

The term "alkenyl", as used herein, describes an alkyl, as defined herein, which contains a carbon-to-carbon double bond.

The term "alkynyl", as used herein, describes an alkyl, as defined herein, which contains carbon-to-carbon triple bond.

The term "cycloalkyl" describes an all-carbon monocyclic or fused ring (i.e., rings which share an adjacent pair of carbon atoms) group where one or more of the rings does not have a completely conjugated pi-electron system. The cycloalkyl group may be substituted or unsubstituted, as indicated herein.

The term "aryl" describes an all-carbon monocyclic or fused-ring polycyclic (i.e., rings which share adjacent pairs of carbon atoms) groups having a completely conjugated pi-electron system. The aryl group may be substituted or unsubstituted, as indicated herein.

The term "heteroaryl" describes a monocyclic or fused ring (i.e., rings which share an adjacent pair of atoms) group having in the ring(s) one or more atoms, such as, for example, nitrogen, oxygen and sulfur and, in addition, having a completely conjugated pi-electron system. Examples, without limitation, of heteroaryl groups include pyrrole, furane, thiophene, imidazole, oxazole, thiazole, pyrazole, pyridine, pyrimidine, quinoline, isoquinoline and purine.

The term "heteroalicyclic" or "heterocyclyl" describes a monocyclic or fused ring group having in the ring(s) one or more atoms such as nitrogen, oxygen and sulfur. The rings may also have one or more double bonds. However, the rings do not have a completely conjugated pi-electron system. Representative examples are piperidine, piperazine, tetrahydrofurane, tetrahydropyrane, morpholino and the like.

The term "alkaryl", as used herein, describes an alkyl substituted by one or more aryls. Examples include benzyl, cumaryl, trityl, and the like.

The term "aralkyl", as used herein, describes an aryl substituted by one or more alkyls. Examples include toluene, styrene, and the like.

Each of the alkyl, alkenyl, alkynyl, cycloalkyl, aryl, alkaryl, aralkyl, heteroalicyclic and heteroaryl groups described herein may be substituted by one or more substituents, whereby each substituent group can independently be, for example, halogen, alkyl, alkoxy, cycloalkyl, alkoxy, nitro, amine, hydroxyl, thiol, thioalkoxy, thiohydroxy, carboxy, amide, aryl and aryloxy, depending on the substituted group and its position in the molecule. Additional substituents are also contemplated The term "halide", "halogen" or "halo" describes fluorine, chlorine, bromine or iodine.

The term "haloalkyl" describes an alkyl group as defined herein, further substituted by one or more halide(s).

The term "hydroxyl" or "hydroxy" describes a —OH group.

The term "thiohydroxy" or "thiol" describes a —SH group.

The term "thioalkoxy" describes both an —S-alkyl group, and a —S-cycloalkyl group, as defined herein.

The term "thioaryloxy" describes both an —S-aryl and a —S-heteroaryl group, as defined herein.

The term "alkoxy" describes both an —O-alkyl and an —O-cycloalkyl group, as defined herein.

The term "aryloxy" describes an —O-aryl, as defined herein.

The term "carboxy" or "carboxylate" describes a —C(=O)—OR' group, where R' is hydrogen, alkyl, cycloalkyl, alkenyl, aryl, heteroaryl (bonded through a ring carbon) or heteroalicyclic (bonded through a ring carbon) as defined herein.

The term "carbonyl" describes a —C(=O)—R' group, where R' is as defined hereinabove.

The above-terms also encompass thio-derivatives thereof (thiocarboxy and thiocarbonyl).

The term "thiocarbonyl" describes a —C(=S)—R' group, where R' is as defined hereinabove.

A "thiocarboxy" group describes a —C(=S)—OR' group, where R' is as defined herein.

A "sulfinyl" group describes an —S(=O)—R' group, where R' is as defined herein.

A "sulfonyl" group describes an —$S(=O)_2$—R' group, where Rx is as defined herein.

A "carbamyl" group describes an —OC(=O)—NR'R" group, where R' is as defined herein and R" is as defined for R'.

A "nitro" group refers to a —$NO_2$ group.

A "cyano" or "nitrile" group refers to a —C≡N group.

As used herein, the term "azide" refers to a —$N_3$ group.

The term "sulfonamide" refers to a —$S(=O)_2$—NR'R" group, with R' and R" as defined herein.

The term "phosphonyl" describes an —O—$P(=O)(OR')_2$ group, with R' as defined hereinabove.

The term "phosphinyl" describes a —PR'R" group, with R' and R" as defined hereinabove.

In some embodiments, any of the compositions-of-matter described herein comprises additional components, being either in association with the nanoclay or with the moieties being in association with the nanoclay, as described herein.

In some embodiments, the composition-of-matter further comprises a silyl-containing compound. In some embodiments, the silyl-containing compound is in association with the nanoclay, as described herein.

As used herein, a "silyl-containing compound" is a compound which comprises one or more Si atoms, whereby the Si atom is substituted by one or more organic substituents.

In some embodiments, the silyl containing compound is a siloxane-containing compound, comprising a Si atom substituted by one or more hydroxy or alkoxy groups, as defined herein. Such compounds may react, via condensation, with free hydroxy groups on the surface of the nanoclay.

In some embodiments, the silyl-containing compound or the siloxane-containing compound comprises a sulfur-containing moiety, such as, but not limited to, a moiety that comprises a thiol group, as a substituted of the Si atom. An exemplary such substituent is a thioalkyl, such as, for example, an alkyl, as described herein (e.g., ethyl, propyl, butyl, etc.) substituted by one or more thiol groups or sulfide groups.

Silyl-containing compounds or siloxane-containing compounds which comprise a sulfur-containing substituent are also referred to herein as mercaptosilanes or mercaptosiloxanes. Such compounds are advantageous since the sulfur moiety may participate in the vulcanization of an elastomeric composition containing the composition-of-matter.

In some embodiments, the silyl-containing compound comprises one or more siloxanes (e.g., triorthosilicate) substituted by one or more alkyl sulfides or thioalkyls.

An exemplary silyl-containing compound is bis(triethoxysilylpropyl)tetrasulfane (TESPT).

In some embodiments, additional components are added during modification of a nanoclay and hence are included in the composition-of-matter as described herein.

In some embodiments, the composition-of-matter further comprises an accelerator.

Exemplary accelerators which are suitable for use in the context of embodiments of the present invention include, but are not limited to, TBBS, MBS, CBS, MBT, TMDM, and any other accelerator that is usable in the elastomer industry.

In some embodiments, silica is added to the composition-of-matter as described herein. Compositions-of-matter comprising silica provide improved reinforcement when added to elastomeric composites, as discussed and demonstrated hereinafter.

According to some embodiments of the present invention, a process of preparing a composition-of-matter as described herein is generally effected by reacting (e.g., by mixing) a nanoclay (either non-treated or an organomodified nanoclay, as described herein) and an amine-containing compound (an antioxidant) as described herein, in a solvent.

When the modified nanoclay is further in association with a silyl-containing compound, as described herein, the process is generally effected by reacting (e.g., by mixing) the nanoclay (either non-treated or an organomodified nanoclay, as described herein), the amine-containing compound and the silyl-containing compound.

In some embodiments, the nanoclay used in the process as described herein is an organomodified nanoclay, as described herein, which is further treated with an amine-containing compound as described herein.

An organomodified nanoclay can be a commercially available nanoclay or be synthetically prepared and then used in the process as described herein.

In some embodiments, the nanoclay and the amine-containing compound are first reacted and then the silyl-containing compound is added and the reaction is continued.

In cases where the reaction is performed in an organic solvent, the process further comprises adding water, prior to, concomitant with, or subsequent to the addition of the silyl-containing compound. Without being bound by any particular theory, it is assumed that the addition of water facilitates generation of free hydroxy groups within the silyl-containing compound, which can then react with free hydroxy groups on the nanoclay surface.

Additional ingredients, if present, can also be added, either concomitant with or subsequent to, mixing the nanoclay and the antioxidant.

For example, an accelerator, as defined herein, can be added to a mixture of the nanoclay and the antioxidant, and then, upon reacting this mixture (by, e.g., mixing) a silyl-containing compound is added and reaction is continued.

In another example, silica is added after mixing a nanoclay and an antioxidant, and optionally an accelerator, and after further mixing, the silyl-containing compound is added. In some embodiments, such mixing is performed for about 10 hours, at elevated temperature (e.g., 80-100° C.).

In some embodiments, the silyl-containing compound is added with water and/or an acid (e.g., acetic acid). When acid is added, it is such that generates pH of about 3 in the reaction mixture. Exemplary acids include Ufacid and acetic acid (glacial). It is noted, however, that preferably, an acid is not added.

In some embodiments, reacting any of the components described herein, and in any combination thereof (e.g., by mixing a reaction mixture containing these components or combination thereof) is effected at elevated temperature. In some embodiments, the temperature is determined by the boiling temperature of the solvent. In some embodiments, reacting is effect at a temperature that ranges from 50° C. to 150° C., or from 50° C. to 100° C., or from 60° C. to 100° C.

In some embodiments, the reacting (e.g., by mixing) is effected for a time period that ranges from 2 hours to 30 hours, or from 2 hours to 20 hours, or from 2 hours to 15 hours, or from 5 hours to 10 hours. Higher reaction times are also contemplated and may depend on the presence and nature of additional components.

If ingredients are added to the reaction mixture after initially mixing the nanoclay and the antioxidant (and optionally an accelerator), the initial mixing can be effected for 1-3 hours (e.g., 2 hours), and then, upon adding further reactants, for additional 2-10 hours (e.g., 7 hours), depending on the nature of the additional component.

Other conditions (e.g., time and temperature of mixing) are also contemplated.

Mixing can be effected using any methods known in the art of synthetic chemistry. An exemplary system is depicted in FIG. 1.

Once the reaction is stopped by e.g., cooling, the obtained reaction mixture can be dried, to thereby obtain the composition-of-matter.

As discussed in detail in the Examples section that follows, the solvent in which the process is effected can be any of an organic solvent and a mixture of organic solvent and water.

Suitable organic solvents include, but are not limited to, polar solvents such as acetone, chloroform, alcohols, and the like.

In some embodiments, the organic solvent is a non-flammable solvent such as, but not limited to, isopropyl alcohol and/or chloroform.

In some embodiments, when a mixture of an organic solvent as described herein and water is used, the organic solvent:water ratio can range from 5:1 to 1:5, or from 3:1 to 1:3 or from 2:1 to 1:2, including any intermediate ratios between these values, or is 1:1.

Without being bound by any particular theory, it is assumed that treating nanoclays, including organomodified nanoclays, in an organic solvent, renders modification of the nanoclays more efficient as it enables efficient dispersion of particles in the solvent, thus rendering the surface thereof accessible to further association with the antioxidant and any of the other components within the composition-of-matter.

In some embodiments, the elastomeric composite generally comprises an elastomer (e.g., a polymer or a copolymer, in its vulcanized form, or as a mixture of monomers before vulcanization) and any of the compositions-of-matter described herein.

The elastomeric composites can further comprise additional components that are commonly used in elastomeric formulations, such as a vulcanization agent (e.g., sulfur), activators (e.g., zinc oxide, stearic acid), accelerators (e.g., MBS, TBBS, and processing aid agents such as dispersants, retarders, processing oils, plasticizers, and the like.

As discussed herein, elastomeric composites as described herein are advantageously characterized by mechanical and/or rheological properties which are at least similar if not superior to corresponding elastomeric composites in which prior art nanoclays are used, while including a reduced or even nullified amount of a filler such as carbon black.

In some embodiments, the amount of the modified nanoclays or of a composition-of-matter containing same ranges from 5 phr to 50 phr, preferably from 5 to 30 phr, or from 5 to 25 phr, or from 7.5 to 25 phr, or from 10 to 25 phr, or from 7.5 to 15 phr, or from 10 to 15 phr. Any value therebetween is contemplated.

In some embodiments, the elastomeric composite is devoid of a filler such as carbon black.

In some embodiments, the elastomeric composite comprises silica as a filler. In some of these embodiments, the silica is included in the composition-of-matter as described herein. In some embodiments, the elastomeric composite is devoid of additional silica.

By "devoid of" it is meant that the amount of the filler is less than 1 weight percents or one phr, less than 0.1 weight percents or phr, and even less than 0.01 weight percents or phr.

In some embodiments, an elastomeric composite as described herein comprises a filler such as carbon black, yet, an amount of the filler is lower than acceptable by at least 20%, for example, by 20%, by 30%, by 40% and even by 50% or more.

In some embodiments, an elastomeric composite that comprises a lower amount of a filler as described herein exhibits substantially the same performance as an elastomeric composite with an acceptable filler content.

That is, for example, considering an averaged acceptable CB content of 30 phr, an elastomeric composite as described herein exhibits the same performance when comprising 30 phr, 15 phr and even 10 phr or lower amount of CB.

In another example, if an elastomeric composite that is designed to have a certain tear resistance comprises 50 phr CB, when such an elastic composite comprises a composition-of-matter as described herein, it exhibits the same tear resistance, yet comprises 40 phr, or 30 phr, or 20 phr or even a lower amount of CB.

In exemplary embodiments, elastomeric composites including modified nanoclay hybrids as described herein, which comprise SBR as the elastomer, and which are devoid of CB or any other filler that is added to the elastomeric compositions, exhibit one or more of the following exemplary mechanical properties:

Shore A hardness higher than 50;

Tensile strength higher than 10 MPa;

Elongation of at least 400%, or at least 450%;

Modulus at 200% elongation of at least 3 MPa, or at least 3.5 MPa;

Tear resistance of at least 30 N/mm; and

Elasticity (Yerzley) of at least 75%.

In exemplary embodiments, elastomeric composites as described hereinabove in which silica is added to the composition-of-matter, exhibit one or more of the following exemplary mechanical properties:

Shore A hardness higher than 50;

Tensile strength higher than 11 MPa;

Elongation of at least 400%;

Modulus at 200% elongation of at least 4 MPa;

Tear resistance of at least 40 N/mm; and

Elasticity (Yerzley) of at least 75%.

In further exemplary embodiments, elastomeric composites as described hereinabove, which further include CB, in an amount of 15 phr, exhibit one or more of the following exemplary mechanical properties:

Shore A hardness of about, or higher than, 70;

Tensile strength higher than 20 MPa;

Elongation of at least 400%;

Modulus at 200% elongation of about, or higher than, 10 MPa;

Tear resistance of at least 50 N/mm, or at least 55 N/mm, or at least 60 N/mm; and Elasticity (Yerzley) of at least 75%.

In some embodiments, the elastomeric composite comprises SBR as the elastomer.

Other suitable elastomers include, but are not limited to, an isoprene elastomer, a polybutadiene elastomer, a butadiene acrylonitrile elastomer, an EPDM elastomer, a natural rubber, an ethylene norbornene elastomer, and any combination thereof. Any other elastomer is also contemplated.

The performance of elastomeric composites comprising such elastomers and a composition-of-matter as described herein, can be improved similarly to the above-described improvement of an SBR elastomer.

In some embodiments, the elastomeric material comprises, or is made of, an elastomeric composite that comprises an elastomer that comprises natural rubber, which have been manipulated so as exhibit improved mechanical performance (e.g., high elastic modulus and low relaxation, namely, long-lasting high elastic modulus), while maintaining high elasticity, and while avoiding the use of high amount of fillers such as carbon black.

Such elastomeric composites can be made from natural rubber (mainly), which include a filler such carbon black, in an amount lower than 50 parts (or phr), nanofillers such as nanoclays, preferably modified nanoclays, and which exhibit long-lasting high elastic modulus, while maintaining high elasticity. Such elastomeric composites can be further manipulated by selecting type and amounts of the nanofillers, and other components of elastomeric composites, such as, but not limited to, vulcanizing agent (e.g., sulfur), combination of accelerators, plasticizers, retarders, and processing aids, so as to achieve desirable rheological and mechanical properties.

In some embodiments, the mechanical properties of such elastomeric composites are as defined in the Examples section that follows and/or as commonly acceptable in the related art.

In general, the elastomeric composites made of natural rubber (mainly) as exemplified herein exhibit high mechanical strength, yet high elasticity, and both these properties are long-lasting, as reflected in low relaxation or, alternatively, in low creep rate or creep % change per year or per several years (e.g., 3 years).

In some embodiments, high elasticity can be reflected as high elongation, as defined herein, high Yerzley elasticity, and/or low tangent.

In some embodiments, high elasticity is reflected as high elongation, e.g., of % elongation higher than 200%, or higher than 300%, as described herein.

In some embodiments, high mechanical strength is reflected by high elastic modulus (e.g., M200), high toughness (work), and/or high Tear resistance.

In some embodiments, low relaxation is reflected as small change in elastic modulus per a time period, as indicated herein, hence defined by long-lasting elastic modulus.

Alternatively, low creep rate or low change in creep (%), as defined and described herein, is indicative for low relaxation.

In some embodiments, the elastomeric composite comprises an elastomer that comprises natural rubber, a nanofiller and a filler, the filler being in an amount lower than 50 parts per hundred rubber (phr).

In some embodiments, the elastomer comprises at least 50 phr natural rubber, at least 60 phr natural rubber, at least 70 phr natural rubber, at least 80 phr, 85 phr, or 90 phr natural rubber, or a higher content of natural rubber.

The natural rubber can be of any source, and of any type of fraction of that source. Any of the commercially natural rubbers are contemplated.

In some embodiments, the natural rubber is Standard Malaysian Rubber (SMR) such as, for example, SMR 10 and/or SMR CV60. Any other natural rubber is also contemplated.

In some of embodiments, the elastomer is made of a mixture of natural rubber at the indicated content and additional one or more polymers and/or copolymers (additional one or more elastomers). The additional polymer(s) and/or copolymer(s) can be any elastomer useful for producing rubbery materials including any mixture of such elastomers.

In some embodiments, the additional polymer is polybutadiene.

In some embodiments, the total content of the additional polymer(s) and/or copolymer ranges from 1 phr to 50 phr, depending on the content of the natural rubber, such that the total content of the elastomers is 100 phr.

In exemplary embodiments, the elastomer comprises 90 phr natural rubber, as described herein, and 10 phr of the other elastomer(s) as described herein.

In exemplary embodiments, the elastomer comprises 90 phr natural rubber, as described herein, and 10 phr polybutadiene.

Such elastomers are typically characterized by high elasticity yet low modulus.

For example, natural rubber has modulus of elasticity (Young Modulus) of about 20 MPa, Tensile strength of about 17 MPa and % elongation about 500.

In some embodiments, an elastomeric composite which comprises natural rubber as described in any one of the embodiments described herein, is exhibiting one or more of the following characteristics:

an elongation of at least 200%;

an elastic modulus, at 200% elongation (M200), higher than 10 MPa; and a relaxation lower than 15% change in M200 within one year and/or an average creep rate lower than 2 mm/day.

In some embodiments, the elongation is higher than 200%, and can be at least 250%, at least 300%, at least 350%, at least 400%, including any value therebetween, and including values higher than 400%. In some of any of the embodiments described herein, the elastomeric composite exhibits elongation that ranges from about 300% to about 480%, or from about 300% to about 450%, or from about 350% to about 480%, or from about 370% to about 480%, or from about 390% to about 480%, or from about 400% to about 450%, including any value between these ranges.

In some embodiments, an elastomeric composite comprising a natural rubber as described herein, exhibits an elastic modulus M200 higher than 10 MPa, or higher than 11 MPa, or higher than 12 MPa, or even higher than 13 MPa. Higher values are also contemplated.

In some embodiments the elastic composite exhibits an elastic modulus M200 that ranges from 8 MPa to 15 MPa, or from 8 MPa to 13 MPa, or from 9 MPa to 13 MPa, or from 10 MPa to 12 MPa, or from 10 MPa to 13 MPa. Any subranges between these ranges and any value between these ranges are also contemplated. Exemplary values of elastic modulus M200 are presented in the Examples section that follows.

In some embodiments, an elastomeric composite comprising a natural rubber as described herein, exhibits % elongation higher than 200%, as described in any one of the embodiments relating to elongation, and which further exhibits elastic modulus M200 higher than 10 MPa or an elastic modulus as described in any one of the embodiments relating to elastic modulus.

In some embodiments, elastomeric composites as presented herein advantageously exhibit high modulus M200 and low stress relaxation, as described herein.

As used herein, the term "stress relaxation", which is also used herein simply as "relaxation", describes time dependent change in stress while maintaining a constant strain. Stress of strained elastomeric composite decreases with time due to molecular relaxation processes that take place within the elastomer.

In some embodiments, relaxation is defined as the change in % of the elastic modulus during a time period (e.g., a year). In some embodiments, relaxation is defined as the change in % of the elastic modulus M200 during a time period (e.g., a year).

In some embodiments, an elastomeric composite which comprises natural rubber as described herein, exhibits a relaxation of 15% (change in M200) or lower, within a year. In some embodiments, the relaxation of the composite is 10% (change in M200) or lower, within a year. It is noted that relaxation of elastomeric composites is typically exponential, and is lowered within time. In some embodiments, relaxation is of an average of 10% (change in M200) per year. In some embodiments, the relaxation of the composite is 20% (change in M200) or lower, e.g., 15% or lower, per two years.

A relaxation characteristic of an elastomeric composite can be reflected also by creep or creep rate. As used herein, "creep" represents the time dependent change is strain while maintaining a constant stress. In some embodiments, creep is presented as the change in the strain of an elastomeric composite within 3 years (upon application of a stress); or as the percentage in the change of strain within 3 years (upon application of a stress, as described in the Examples section that follows).

In some embodiments, the elastomeric composite exhibits a creep rate lower than 300 mm/3 years, or lower than 280 mm/3 years or lower than 250 mm/3 years and optionally even lower than 230 mm/3 years.

In some embodiments, the values of the creep as provided herein are given when an elastomeric specimen comprising an elastomeric composite as described herein is subjected to a stress of about 110 or 110.61 $Kg/cm^2$.

The above values are for a creep as measured as described in the Examples section that follows.

In some embodiments, elastomeric composites as presented herein advantageously exhibit high modulus M200, as described in any one of the embodiments presented herein, high % elongation, as described in any one of the embodiments presented herein, and low stress relaxation and/or creep, as described in any one of the embodiments as presented herein.

In some embodiments, an elastomeric composite made of natural rubber as described herein are further characterized by one or more of the following:

A Yerzley elasticity which is higher than 65%, and can be, for example, 70%, 75%, 80%, including any value therebetween, and even higher;

A toughness (Work) of the composition which is higher than 4 Joules, or higher than 5 Joules, and can be, for example, any value between 4 to 7 Joules or 5 to 7 Joules or 4 to 6 Joules; and A Tear resistance of the elastomeric composite which is higher than 50 N/mm, and can be 55, 60, 65, 70 N/mm and even higher, including any value between the indicated values.

In some embodiments, the composite exhibits all of the characteristics described hereinabove, including any combination of specific embodiments of the characteristics described hereinabove.

In some embodiments, an elastomeric composite made of natural rubber as described in any one of the embodiments described herein further comprises a filler.

In some embodiments, the filler is carbon black (CB). However, any other suitable filler, for example, silica or amorphous silica, is contemplated.

In some embodiments, the amount of CB (or any other filler) in an elastomeric composite as described herein is lower than 50 phr, and can be, for example, 48, 45, 42, 40, 35, 30, 25, 20 phr (including any value between these values) and even lower.

In some embodiments, an amount of carbon black or any other filler in the elastomeric composition is about 40 parts per hundred rubber.

In some embodiments, an amount of carbon black or any other filler in the elastomeric composition is about 30 parts per hundred rubber.

In some embodiments, an amount of carbon black or any other filler in the elastomeric composition is about 20 parts per hundred rubber.

In some embodiments, the elastomeric composite further comprises a nanofiller, as defined herein.

In some embodiments, an amount of the nanofiller is in a range of from 5 phr to 30 phr, or from 5 phr to 20 phr, or from 10 phr to 25 phr, or from 10 phr to 20 phr, including any subrange and value therebetween.

In some embodiments, a ratio between the amount of the nanofiller and the amount of the filler is 1:5, or 1:3 or 1:2 or 1:1.8, or even 1:1, including any value therebetween and including any subrange between 1:5 to 1:1.

In some embodiments, a ratio between the amount of the nanofiller and the amount of the filler is 1:3. In some of these embodiments, an amount of the filler (e.g., CB) is 40 phr and an amount of the nanofiller is 13.33 phr.

In some embodiments, a ratio between the amount of the nanofiller and the amount of the filler is 1:1. In some of these embodiments, an amount of the filler (e.g., CB) is 20 phr and an amount of the nanofiller is 20 phr.

In some embodiments, a ratio between the amount of the nanofiller and the amount of the filler is about 1:8 or about 1:76. In some of these embodiments, an amount of the filler (e.g., CB) is 30 phr and an amount of the nanofiller is 17 phr. The nanofiller can be any nanofiller as described herein and/or is known in the art.

In some embodiments, the nanofiller is a nanoclay, as defined herein and/or is known in the art.

In some embodiments, the nanofiller is a modified nanofiller as described herein.

In some embodiments, the modified nanofiller includes organomodified nanoclays. In some embodiments, the nanoclay is montmorillonite.

In some embodiments, the nanoclay comprises montmorillonite treated with a cationic surfactant such as an organic ammonium salt or organic amminium salt.

Exemplary commercially available organomodified nanoclays include, but are not limited to, Cloisite 10A, 15A, 20A, 25A and 30B of Southern Clays; Nanomer 1.31ps, 1.28E and 1.34 TCN of Nanocor. In general, the commercially available organomodified NCs are montmorillonites in which sodium ions are exchanged with ammonium or amminium ions.

In all embodiments where the nanofiller comprises organomodified nanoclays, it may include one type of organomodified nanoclays or two or more types of differently modified nanoclays or a mixture of organomodified and non-modified nanoclays.

In some embodiments, the nanofiller is a nanoclay as described herein, including an organomodified nanoclay, which is further modified so as to be in association with a an amine-containing compounds that exhibits an antioxidation activity. Such a nanoclay is a nanoclay hybrid as described herein or a composition-of-matter comprising the modified nanoclay or the nanoclay hybrid.

In some embodiments, these modified nanoclays are prepared in a non-flammable solvent, such as, for example, a mixture of water and isopropyl alcohol. See, for example, RRA 202-1 and RRA 206-2.

In some embodiments, the modified nanoclays are as described in U.S. patent application Ser. Nos. 13/546,228 and 13/949,456, which are incorporated by reference as if fully set forth herein.

Modified nanofillers which are nanoclays or nanoparticles in association with an antioxidant (an amine-containing compound which exhibits an antioxidation activity) and a silyl-containing compound, as described herein, or compositions-of-matter comprising the same, are also referred to herein collectively as nanohybrids or as hybrid nanoclays.

In some of any one of the embodiments described herein, an amount of the nanofiller (any of the nanofillers as described herein) ranges from 10 phr to 15 phr. In some embodiments, it is 13.33 phr.

In some of any one of the embodiments described herein, an amount of the nanofiller (any of the nanofillers as described herein) ranges from 10 phr to 20 phr or from 15 phr to 20 phr. In some embodiments, it is 17 phr.

In some of any one of the embodiments described herein, an amount of the nanofiller (any of the nanofillers as described herein) ranges from 10 phr to 30 phr or from 15 phr to 25 phr. In some embodiments, it is 20 phr.

In some embodiments, an amount of a nanofiller which is a nanoclay in association with an antioxidant and with a silyl-containing compounds as described herein ranges from 10 phr to 15 phr. In some embodiments, it is 13.33 phr. In some embodiments, an amount of a nanofiller which is a nanoclay in association with an antioxidant and with a silyl-containing compounds as described herein ranges from 10 phr to 20 phr or from 15 phr to 20 phr. In some embodiments, it is 17 phr.

In some embodiments, an amount of a nanofiller which is a nanoclay in association with an antioxidant and with a silyl-containing compounds as described herein ranges from 20 phr to 30 phr or from 15 phr to 25 phr. In some embodiments, it is 20 phr.

In some embodiments, an elastomeric composite comprises a natural rubber (mainly), as described herein in any of the respective embodiments, and further comprising a filler in an amount lower than 50 phr, as described in any one of the respective embodiments herein, and a nanofiller, as described in any one of the respective embodiments described herein. Any combination of the embodiments described herein for a natural rubber, a filler and a nanofiller, and an amount thereof is contemplated.

In some of these embodiments, the nanofiller is a modified nanofiller as described herein, and in some embodiments, it comprises a nanoclay in association with an antioxidant and with a silyl-containing compounds as described herein.

In some embodiments, an elastomeric composite comprises a natural rubber (mainly), and further comprising a filler in an amount lower than 50 phr, as described in any one of the respective embodiments herein, and a nanofiller which comprises a nanoclay in association with an antioxidant and with a silyl-containing compounds, as described in any one of the respective embodiments described herein. Any combination of the embodiments described herein for a filler and a nanofiller, and an amount thereof is contemplated.

As demonstrated in the Examples section that follows, elastomeric composites as described herein, which exhibit the above-indicated performance and/or characteristics, may be such that comprise 40 phr CB and 13.33 phr of a nanofiller, for example, a nanofiller which is a nanoclay in association with an antioxidant and optionally also in association with a silyl-containing compound, as described herein. Elastomeric composites as described herein, which exhibit the above-indicated performance and/or characteristics, may also be such that comprise 20 phr CB and 20 phr of a nanofiller, for example, a nanofiller which is a nanoclay in association with an antioxidant and optionally also in association with a silyl-containing compound, as described herein. Elastomeric composites as described herein, which exhibit the above-indicated performance and/or characteristics, may also be such that comprise 30 phr CB and 17 phr of a nanofiller, for example, a nanofiller which is a nanoclay in association with an antioxidant and optionally also in association with a silyl-containing compound, as described herein.

In some embodiments, an elastomeric composite comprises an elastomer that comprises natural rubber, as defined herein, carbon black and a modified nanofiller, wherein an amount of said carbon black is 40 phr and an amount of the modified nanofiller ranges from 10 phr to 15 phr. In some embodiments, an amount of the modified nanofiller is 13.33 phr.

In some embodiments, an elastomeric composite comprises an elastomer that comprises natural rubber, as defined herein, carbon black and a modified nanofiller, wherein an amount of said carbon black is 20 phr and an amount of the modified nanofiller ranges from 10 phr to 30 phr or from 15 phr to 25 phr. In some embodiments, an amount of the modified nanofiller is 20 phr.

In some embodiments, an elastomeric composite comprises an elastomer that comprises natural rubber, as defined herein, carbon black and a modified nanofiller, wherein an amount of said carbon black is 30 phr and an amount of the modified nanofiller ranges from 10 phr to 20 phr or from 15 phr to 20 phr. In some embodiments, an amount of the modified nanofiller is 17 phr.

In some of these embodiments, the modified nanofiller comprises nanoclay in association with an antioxidant and optionally also in association with a silyl-containing compound, as described herein in any of the respective embodiments.

In some embodiments, such elastomeric composites exhibit one or more of the following characteristics:

an elongation of at least 200%, as defined in any one of the respective embodiments herein;

an elastic modulus, at 200% elongation, higher than 10 MPa, as defined in any one of the respective embodiments herein;

a relaxation lower than 15% change in M200, as defined in any one of the respective embodiments herein; and/or a creep rate lower than 300 mm/3 years, as defined in any one of the respective embodiments herein.

In some embodiments, such elastomeric composites exhibit one or more of the following characteristics:

an elongation of at least 200%, as defined in any one of the respective embodiments herein;

an elastic modulus, at 200% elongation, higher than 10 MPa, as defined in any one of the respective embodiments herein;

a relaxation lower than 15% change in M200, as defined in any one of the respective embodiments herein; and/or a creep rate lower than 300 mm/3 years, as defined in any one of the respective embodiments herein;

Yerzley elasticity higher than 65%, or higher than 70%, as defined in any one of the respective embodiments herein;

a toughness of at least 4 Joules, as defined in any one of the respective embodiments herein; and a tear resistance of at least 50 N/mm, as defined in any one of the respective embodiments herein.

Any one of the elastomeric composites described herein can further comprise a vulcanizing agent, a vulcanization activator and an accelerator, as commonly practiced in rubbery materials.

The combination of a vulcanization agent, activator and accelerator, and optionally other components as described herein, is also referred to herein and in the art as a vulcanization system.

In some embodiments, the vulcanizing agent is sulfur.

In some embodiments, an amount of sulfur ranges from 1.50 to 2.50 phr.

In some embodiments, an amount of said sulfur is 1.80 phr.

In some embodiments, a vulcanization activator comprises stearic acid and zinc oxide, at amounts commonly used (e.g., 1-5 phr for each).

In some embodiments, a vulcanization activator comprises or consists of 5 phr zinc oxide and/or 2 phr stearic acid.

In some of any of the embodiments described herein, the vulcanization system comprises sulfur in an amount ranging from 1.50 to 2.50 phr, or from 1.50 to 2.0 phr, zinc oxide in an amount of 1.0 to 5.0 phr, or 3.0 to 5.0 phr, and stearic acid in an amount of 1.0 to 5.0 phr, or 1.0 to 3.0 phr.

In some of any of the embodiments described herein, the vulcanization system comprises sulfur in an amount of 1.80 phr, zinc oxide in an amount of 5.0 phr and stearic acid in an amount of 2.0 phr.

The accelerator (also referred to as accelerant) can be any suitable accelerator or a combination of accelerators practiced in rubbery materials and/or described herein.

Exemplary accelerators comprise sulfenamide, guanidine, thiuram and/or thiazole compounds.

Exemplary accelerators comprise benzothiazole-containing accelerators such as, for example, MBS; thiuram-containing accelerators such as, for example, TMTM; and guanidine-containing accelerators such as, for example, DPG, and any combination thereof.

Exemplary accelerators comprise MBS, DPG and/or TMTM.

In some of any of the above-described embodiments, the accelerator comprises a mixture of MBS, DPG and/or TMTM.

In some of any of the above-described embodiments, in such a mixture, each accelerator is in an amount ranging from 0 to 2 phr, including any subrange and/or value therebetween.

In some embodiments, an amount of DPG is from 0.1 to 1.5 phr, for example, from 0.5 to 1.5 phr (e.g., 1.2 phr).

In some embodiments, an amount of DPG is from 0.1 to 1 phr, for example, from 0.2 to 0.6 phr (e.g., 0.4 phr, 0.5 phr, 0.55 phr).

In some embodiments, an amount of TMTM is from 0 to 1 phr, for example, 0.2 to 0.5 phr (e.g., 0.3 phr). In some embodiments, the accelerator does not include TMTM.

In some embodiments, an amount of MBS is from 0.2 to 2 phr, for example, 1 phr to 2 phr (e.g., 1.8 phr).

In some embodiments, the accelerator comprises 1.80 phr MBS and 1.2 phr DPG.

In some embodiments, the accelerator comprises 1.80 MBS and 0.4-0.6 phr DPG.

In some of the above embodiments, the accelerator further comprises TMTM, in an amount of 0.3 phr.

In any of the above-described embodiments, the elastomeric composite (or the vulcanization system) further comprises processing aids, plasticizers and/or retarders. Such agents are desired for facilitating processing the composite (e.g., by extrusion) and/or for contributing to the desired mechanical performance of the composite.

The amount and type of such agents, as well as of the vulcanization agent and accelerants, in some embodiments, is selected so as to achieve desired rheological properties, such as scorch time, mV and the like, for facilitating processing, while not compromising, and optionally contributing to, the mechanical performance of the composite, as defined herein.

Suitable plasticizers can be, for example, DOS or plasticizers of the Cumar family (coumarone indole resins). Any other plasticizers known as useful in the elastomeric industry are also contemplated.

In some embodiments, an amount of the plasticizer is from 0.5 to 2 phr, for example, from 1 to 2 phr (e.g., 1.5 phr), including any subranges and values therebetween.

Suitable retarders can be, for example, PVI. Any other retarders known as useful in the elastomeric or rubber industry are also contemplated.

A suitable amount of a retarder can be from 0.5 to 1.5 phr (e.g., 1 phr), or from 0.05 phr to 2 phr, or from 0.05 phr to 1 phr, or from 0.05 phr to 0.5 phr, or from 0.1 to 0.5 phr, or from 0.1 to 0.3 phr (e.g., 0.2 phr), including any subranges or values therebetween.

Suitable processing aids can be, for example, soap-like materials, such as fatty-acid soaps or soaps of other hydrophobic materials. Exemplary processing aids are zinc soaps of fatty acids or fatty acid-esters. Calcium salts and zinc-free agents are also contemplated. Any processing aid useful in the elastomer or rubber industry is contemplated.

A "processing aid" is also referred to herein and in the art as "processing agent" or "processing aid agent".

Exemplary processing aids are the commercially available Struktol WB16 and Struktol ZEH or ZEH-DL, or any commercially available or equivalent thereof.

Struktol ZEH or ZEH-DL are processing aids that may also act as activators in a vulcanization system.

In some of any one of the embodiments described herein, an amount of the processing aid ranges from 1.0 to 5.0 phr, or from 2.0 to 5.0 phr, or from 3.0 to 5.0 phr, or from 4.0 to 5.0 phr.

In exemplary embodiments, the processing aid comprises Struktol WB16 in an amount of 3.0 phr, and Struktol ZEH is an amount of 1.3 phr, whereby any commercially available or other equivalent of these agents is contemplated.

It is to be noted that the composition of the vulcanization system in any one of the elastomeric composites described herein may affect the mechanical characteristics of the composite, and that by manipulating the type of amount of the components of the vulcanization system (namely, the vulcanization agent, activator, accelerator, plasticizer, retarder and processing aid), control of the final characteristics of the elastomeric composite can be achieved.

In some of any one of the embodiments described herein for an elastomeric composite as described herein, which comprises natural rubber (mainly) as an elastomer, a filler and a nanofiller, the elastomeric composite may further comprises a vulcanization system which comprises:

Sulfur, in an amount as described herein in any one of the respective embodiments;

Zinc oxide and stearic acid, in an amount as described herein in any one of the respective embodiments;

A mixture of accelerators, the types and amounts of which are as described herein in any one of the respective embodiments;

A plasticizer, in an amount and/or type as described herein in any one of the respective embodiments;

A retarder, in an amount and/or type as described herein in any one of the respective embodiments; and A processing aid, in an amount and/or type as described herein in any one of the respective embodiments.

Exemplary elastomeric composites as described herein comprise a vulcanization system which comprises:

Sulfur—about 1.80 phr;

Zinc oxide—about 5.0 phr;

Stearic acid—about 2.0 phr;

An accelerator which comprises at least a benzothiazole and a guanidine-type accelerators, and optionally a thiuram-type accelerator, wherein an amount of a benzothiazole accelerator (e.g., MBS) is about 1.8 phr; and an amount of the guanidine-type accelerator (e.g. DPG) is about 0.4-0.6 phr; and an amount of the thiuram-type accelerator, of present, is about 0.1-0.3 phr;

A retarder (e.g. PVI)—about 0.2 phr;

A plasticizer (e.g., Cumar 80)—about 1.5 phr; and Processing aids which comprise agents such as Struktol WB 16 and Struktol ZEH—about 3.0 phr and about 1.30 phr, respectively.

In some embodiments, the above-described vulcanization system is included in an elastomeric composite that comprises 30 phr carbon black, and 17 phr modified nanofiller which includes nanoclay in association with an antioxidant and a silyl-containing compounds as described herein (e.g., RRA 206-2).

In some of any one of the embodiments described herein, an elastomeric composite as described herein further comprises a silyl-containing compound as described herein. An exemplary silyl-containing compound is a mercaptosilane or mercaptosiloxane, as described herein (e.g., Si69).

An amount of the silyl-containing compound can range from about 1.0 to 5.0 phr, or from about 1.5 phr to 5.0 phr, or from 1.5 phr to 3.5 phr The above-described elastomeric composites are characterized by any one of the characteristics described herein, including any one of the embodiments thereof.

Additional ingredients in the elastomeric composite can be selected from dispersants, coloring agents and reinforcing agents (such as reinforcing fibers).

Any of the elastomeric composites as described herein can be prepared by any method known in the art, including any type of extrusion and any type of molding.

In some embodiments, the elastomeric composites are prepared by mixing all of its components, in any order.

In some embodiments, the elastomeric composites are prepared by adding the activator(s) as described herein, after all other components are mixed.

In some embodiments, the elastomeric composites are prepared by first mixing an elastomer with a nanofiller and a filler, then adding all components of a vulcanization system except from the activator(s), and then adding the activator(s) (e.g., zinc oxide and stearic acid).

Exemplary Materials of Other Portions

In some embodiments, rigid portions are constructed of, for example, plastics, (e.g. PP and/or PE and/or PET), metal, glass, wood, composite materials and combinations thereof.

In some embodiments, one or more of the portions defining the chamber (e.g. rigid portion, elastic portion, closing portion) include an impermeable (e.g. impermeable to oxygen) and/or inert (e.g. to the material) layer or coating, for example to prevent chemical reaction between the portion and the material. In some embodiments, the bag includes an impermeable (e.g. impermeable to oxygen) and/or inert (e.g. to the material) layer or coating.

Bag with Non-Metallic Components

In many existing pressurized material dispensing devices, bags for materials (BOV bags for example) comprise aluminum layers which serve inter alia to prevent contact between a propellant and/or atmospheric oxygen and a deliverable material. Other prior art designs, for example BICAN® containers, use no aluminum but require a environment non-friendly propellant (Liquified Propellant Gas (LPG))

Figure 25B:
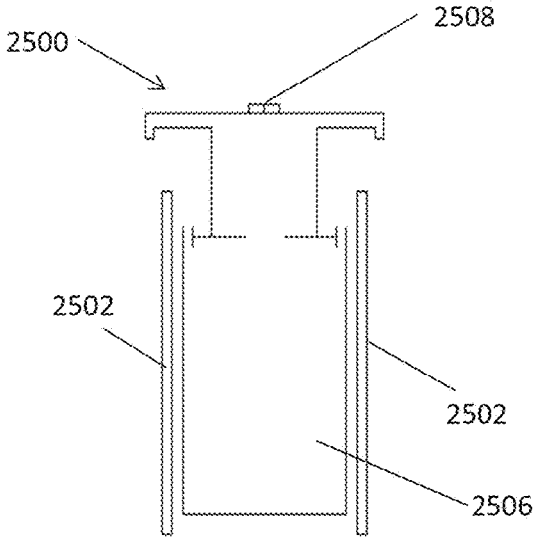
FIG. 25B is a simplified cross sectional view of a product distribution device including a non-metallic bag, according to some embodiments of the invention.

In contrast, in some embodiments, the chamber is impermeable and/or the chamber is sealed, facilitating use of a non-metallic bag e.g. a nylon bag. FIG. 25B is a simplified cross sectional view of a product distribution device 2500 including a non-metallic bag. Device 2500 includes portions defining a chamber 2003 (e.g. a sleeve), non-metallic bag 2506 and a valve 2508. In some embodiments, bag 2506 includes substantially no metal (e.g. aluminum). For example, less than 1% metal, less than 0.1% metal, less than 0.01% metal. For example less than 1% aluminum, less than 0.1% aluminum, less than 0.01% aluminum.

Exemplary Quantity Indicator

In some embodiments, the device includes one or more indicator as to the quantity of material within the chamber. In some embodiments, the indicator is one or more window or (e.g. a 'peephole' and/or transparent area), for example to enable a user to see a position of a part of the chamber (e.g. the elastic portion) and/or a separation of one part of the chamber to a package, the position and/or separation optionally indicating material levels within the device.

In some embodiments, one or more rigid portions include one or more windows. In some embodiments, a cover (e.g. cover 1834, 2234, 2234*a*) and/or package (e.g. package 312, 512) include one or more window which is, for example, a transparent section and/or a hole in the package or cover.

Figure 26:
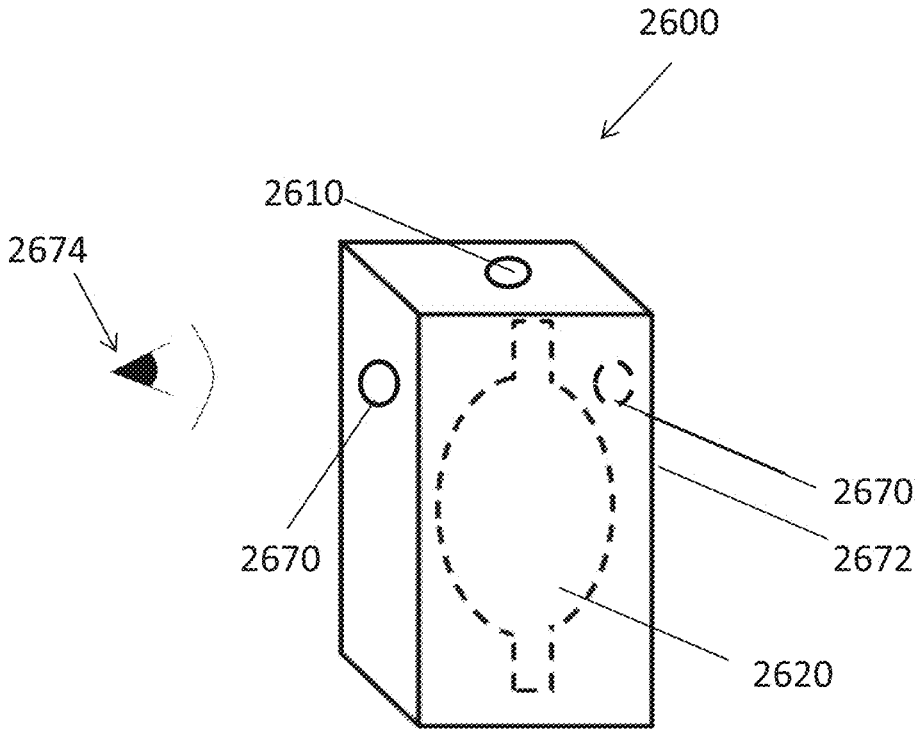
FIG. 26 is a simplified side view of a device including a container with two quantity indicators, according to some embodiments of the invention.

FIG. 26 is a simplified side view of a device 2600 including a package 2672 with two quantity indicators 2670. Chamber 2620 is disposed inside package 2672. In some embodiments, windows 2670 enable a user 2674 to visually appreciate the degree of fullness or emptiness of a product package, e.g. by looking at the size of the chamber which, in some embodiments, reduces as product is dispensed. In some embodiments window/s 2670 are light-admitting opening/s. A degree of obscuring of the light-admitting opening depends on the degree of expansion of the elastic portion (e.g. sleeve), which degree of expansion is a function of the degree of fullness or emptiness of the chamber.

Figure 27A:
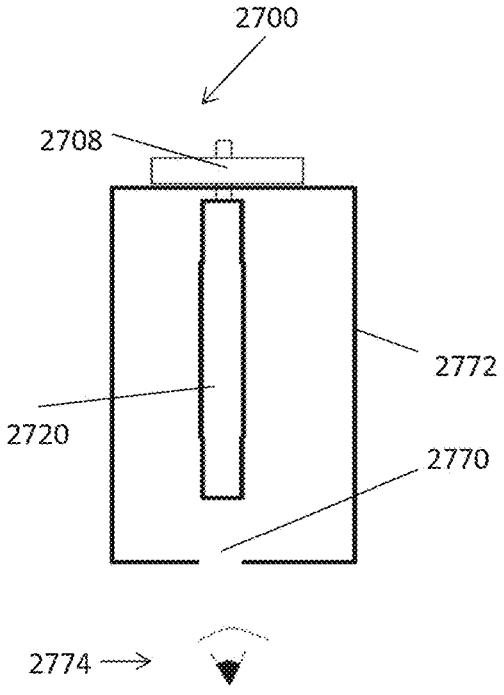
FIG. 27A is a simplified cross sectional view of an empty exemplary embodiment of a device including a container with a window, according to some embodiments of the invention.
Figure 27B:
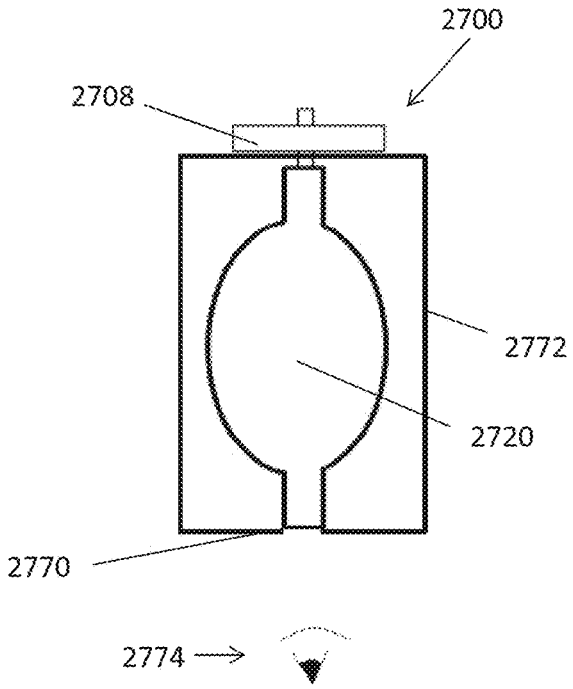
FIG. 27B is a simplified cross sectional view of a filled exemplary embodiment of a device including a container with a window, according to some embodiments of the invention.

FIG. 27A is a simplified cross sectional view of an empty exemplary embodiment of a device 2700 including a package 2772 with a window quantity indicator 2770, according to some embodiments of the invention. FIG. 27B is a simplified cross sectional view of a filled exemplary embodiment of a device 2700 including a package 2772 with a window 2770, according to some embodiments of the invention. In some embodiments, filling the chamber causes a portion of the chamber (e.g. the elastic portion) to approach window 2270, in some embodiments, filling of the chamber progressively obscures and/or otherwise optically interacts with the window and in some embodiments the window is totally obscured the when device 2700 is fully expanded.

Figure 27C:
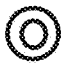
FIG. 27C is a simplified view of a view through the window of FIG. 27A, according to some embodiments of the invention.
Figure 27D:
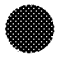
FIG. 27D is a simplified view through the window of FIG. 27B, according to some embodiments of the invention.

FIG. 27C is a simplified view of a view through the window of FIG. 27A, according to some embodiments of the invention. FIG. 27D is a simplified view through the window of FIG. 27B, according to some embodiments of the invention.

Alternatively, in some embodiments, the quantity indicator is an element coupled to the chamber e.g. protruding through a window in a package, the extent of protrusion indicating the quantity of material within the chamber.

Device Support

In some embodiments, the device includes a support which holds or supports one or more portion of the device (e.g. the bag). Optionally, a support supporting a bag prevents expulsion and/or sliding of a bag from the chamber. Optionally, a support supports one or more portion of the device (e.g. bag) within a container and/or package and/or cover. In some embodiments the support is attached to the container and/or package and/or cover. In some embodiments, a support holds a bag within the chamber.

Figure 28A:
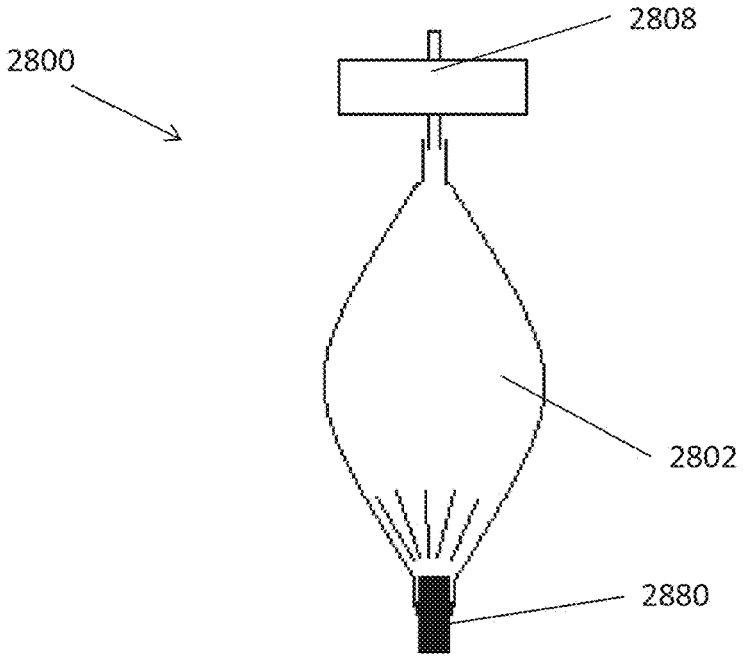
FIG. 28A is a simplified side view of a device including a support, according to some embodiments of the invention.
Figure 28B:
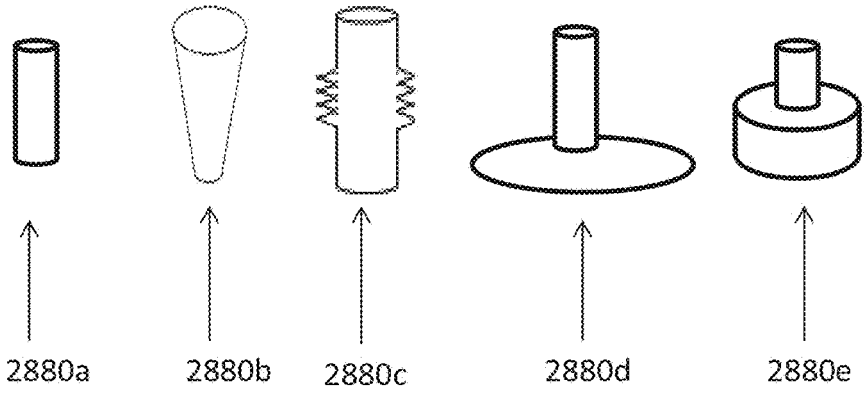
FIG. 28B is a simplified side view of optional forms of plug, according to some embodiments of the invention.

FIG. 28A is a simplified side view of a device 2800 including a support, according to some embodiments of the invention. Device 2800 includes an elastic sleeve 2802. A bag inside the elastic sleeve (not illustrated) includes or is attached to a support plug 2880. Support plug 2880 is positioned at the end of sleeve 2802. Optionally, support plug 2880 supports sleeve 2802 within a container (not shown). In some embodiments support plug is 4-25 mm long. FIG. 28B is a simplified side view of optional forms of plug 2880, according to some embodiments of the invention. Optionally, plug is cylindrical 2880*a* and/or is cone shaped 2880*b* and/or has serrated walls 2880*c* and/or includes a base 2880*d* and/or includes a pin inside a cup 2880*e*.

Exemplary Usage

Figure 29A:
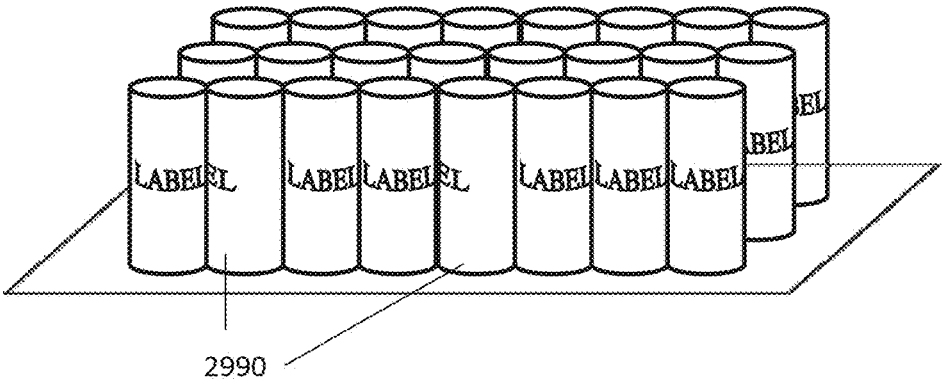
PRIOR ART FIG. 29A
FIG. 29A is a simplified schematic illustration of existing can product dispensing devices on a shelf in a retail environment.

A potential benefit of some embodiments is that product dispensing devices can have a wider range of geometries than existing product dispensing devices. FIG. 29A is a simplified schematic illustration of existing can product dispensing devices on a shelf in a retail environment. Cylindrical cans, without placing the cans in an additional packaging which would result in packaging volume inefficiency, do not provide a large surface for labels and/or easily readable and/or visible. In contrast, in some embodiments, product dispensing devices provide a large area for clear labeling and/or advertisement without introducing packaging with large volumes of space not filled with material when the device is filled (e.g. more than 5% or 10% or 20% or 50% packaging and/or device space not filled with material).

Figure 29B:
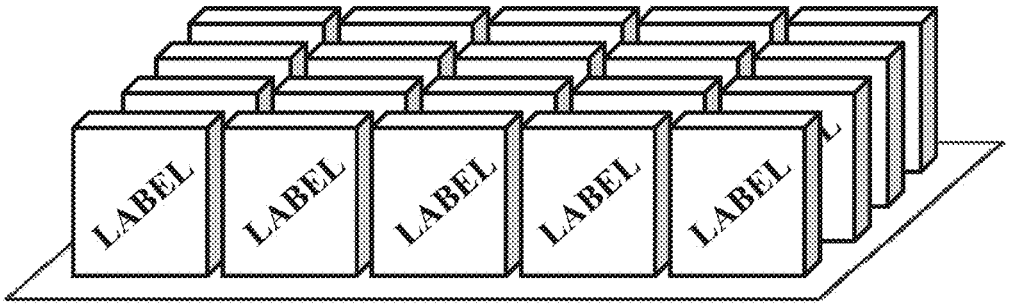
FIG. 29B is a simplified schematic illustration of product dispensing devices on a shelf in a retail environment, according to some embodiments of the invention.

FIG. 29B is a simplified schematic illustration of product dispensing devices on a shelf in a retail environment, according to some embodiments of the invention. Optionally, the label area of the devices is flat. In some embodiments, the device shape enables a shelf area to be densely filled with devices and/or a quantity of material displayed per shelf area is higher than that of prior art dispensing devices (e.g. 20% more, 50% more, 70% more, more than 70% more, or intermediate percentages). For example, at least 30%, 50%, 70% or intermediate percentages of a shelf length may include label materials which are within 20 degrees of a perpendicular to the shelf in a direction of a human viewer. Optionally or alternatively, at least 20%, 40%, 60% or intermediate percentages of a shelf area (e.g., a plane perpendicular to a viewer and generally parallel to the shelf and generally bounded by a lower shelf and an upper shelf) includes readable label material.

A further potential benefit of some embodiments over the cans illustrated in FIG. 29A is a potential reduction in shelf stacking and/or rearranging time. For example, the packaging of FIG. 29B does not need to be rotated to show the label, FIG. 29A illustrates cans 2990 which need to be rotated to show the label.

Another potential advantage is in packing and/or unpacking of boxes, where rectangular like shapes and/or shapes with easily attached handles, may be more easily lifted and/or arranged.

As used herein the term "about" refers to ±20%.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

It is expected that during the life of a patent maturing from this application many relevant elastic materials will be developed and the scope of the term elastic portion is intended to include all such new technologies a priori.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Various embodiments and aspects of the present invention as delineated hereinabove and as claimed in the claims section below find experimental support in the following examples.

EXAMPLES

Reference is now made to the following examples, which together with the above descriptions illustrate some embodiments of the invention in a non limiting fashion.

Materials and Experimental Methods

List of Materials:

Natural Rubber (NR), dirt content 0.1%, was SMR (Standard Malaysian Rubber) 10 or CV60 (constant viscosity 60), which can be considered as equivalent to one another (as shown hereinbelow).

Polybutadiene Rubber (PB) ML(1+4)100-45, was BR 1220, supplied by Nippon Zeon.

Zinc oxide, stearic acid, silica and sulfur were obtained from known vendors.

Organomodified nanoclays Cloisite 15A (Montmorillonite (MMT) treated with dimethyl hydrogenated tallow ammonium) and Cloisite 30B (MMT treated with methyl-dihyroxethyl hydrogenated tallow ammonium), were obtained from Southern Clays.

Mercaptosilane Si69 (TESPT; bis(triethoxysilylpropyl) tetrasulfane) was obtained from Degussa.

Plasticizer DOS is Dioctyl sebacate.

Coumarone indene resin plasticizers Cumar25 and Cumar80, were obtained from Neville.

MBS (accelerator 1), (Santocure) 2-(4-morpholinyl-mercapto)-benzothiazole, was obtained from Flexsys.

DPG (accelerator 2), (Perkacit) diphenyl guanidine, was obtained from Flexsys. TMTM (accelerator 3), tetramethyl thiuram monosulphide, was obtained from Flexsys.

TETD (an accelerator), tetraethyl thiuram disulfide, was obtained from Flexsys.

Santogard PVI (a retarder), N-(Cyclohexylthio)phthalimide, was obtained from Flexsys.

Carbon Black (HAF N330) was obtained from Cabot.

ExpGraphene 3775 is a commercially available graphene based nanofiller.

Struktol TS35 (a processing aid), an aliphatic-aromatic soft resin, was obtained from Schill & Seilacher.

Struktol WB16 (a processing aid), a mixture of calcium soaps and amides of saturated fatty acids, was obtained from Schill & Seilacher Struktol ZEH (a processing aid), (ZEH=zinc 2-ethyl hexanoate), for improving stress relaxation, was obtained from Schill & Seilacher Struktol ZEH-DL, (a processing aid), zinc 2-ethyl hexanoate on 33% silica carrier silica, was obtained from Schill & Seilacher.

Nanoclay hybrids (also referred to as nanohybrids) were prepared as described in Example 1 hereinbelow.

IPPD is N-isopropyL-N'-phenyl-paraphenylene diamine.

Elastomeric Composite Properties Measurements:

Rheological Properties:

All rheological measurements were performed using a MDL D2000 Arc 1 (Monsanto) Rheometer, and were operated according to Manufacturer's instructions, at the indicated temperature.

Minimal Viscosity (mV or MV) is measured in a rheological test, and is expressed as the torque (lb/inch) applied to an elastomeric composite, before vulcanization.

Scorch time (t2) is the time (in minutes) required for an elastomeric composite to exhibit torque of 2 lb/inch upon vulcanization, as measured in a rheological test.

Optimum Vulcanization Time (t90) is the time (in minutes) required for an elastomeric composite to exhibit 90% of the maximal torque value, as a measured in a rheological test. Similarly, t100 is the time required for an elastomeric composition to exhibit the maximal torque value.

The term "tan" represents "Tangent δ", or the tangent modulus, which is the ratio of the viscous torque (S") and the elastomeric torque (S'), and is dimensionless. Tan can be measured as the slope of a compression stress-strain curve.

S1, is the maximal torque value (in lb-in units).

S1-mV represents the difference between the maximal torque value (S1) and the minimal viscosity.

Mechanical Properties:

Mechanical measurements were performed according to standard (ASTM) procedures, as indicated.

Vulcanization time is the time required for achieving more than 90% of the maximal torque.

Elongation is the extension of a uniform section of a specimen (i.e., an elastomeric composite) expressed as percent of the original length as follows:

$$\text{Elongation \%} = \frac{\text{Final length} - \text{Original length}}{\text{Original length}} \times 100$$

Elongation was determined following the ASTM D412 standard.

Hardness is a resistance of an elastomeric composite to indentation, as measured under the specified conditions. Hardness ShA is Shore A hardness, determined following the ASTM D2240 standard using a digital Shore A hardness meter.

Tensile strength (or tensile) is a measure of the stiffness of an elastic substance, defined as the linear slope of a stress-versus-strain curve in uniaxial tension at low strains in which Hooke's Law is valid. The value represents the maximum tensile stress, in MPa, applied during stretching of an elastomeric composite before its rupture.

Modulus is a tensile stress of an elastomeric composite at a given elongation, namely, the stress required to stretch a uniform section of an elastomeric composite to a given elongation. This value represents the functional strength of the composite. M100 is the tensile stress at 100% elongation, M200 is the tensile stress at 200% elongation, etc.

Tear Strength is the maximum force required to tear an elastomeric composite, expressed in N per mm, whereby the force acts substantially parallel to the major axis of the composite.

Tensile strength, modulus and tear resistance were determined following the ASTM D412 standard.

Work represents the toughness of an elastomeric composite, namely, the energy a composite can absorb before it breaks, and is determined by the area under a stress-strain curve. The stress is proportional to the tensile force on the composite and the strain is proportional to its length. The area under the curve is therefore proportional to the integral of the force over the distance the elastomer stretches before breaking:

$$\text{Area} \propto \int F(L)dL,$$

and this integral represents the work (energy) required to break the composite.

Hchg ShA is the change on Shore A hardness upon ageing at 100° C. for 70 hours, and represents the hardness as measured upon ageing minus the hardness as measured before ageing.

Tchg % is the change, in percents, of the tear resistance upon ageing at 100° C. for 70 hours, and represents the difference between tear resistance upon ageing and before ageing, divided by the tear resistance before ageing, multiplied by 100.

Echg % is the change, in percents, of the elongation upon ageing at 100° C. for 70 hours, and represents the difference between elongation upon ageing and before ageing, divided by the elongation before ageing, multiplied by 100.

Yerzley Elasticity (Elast. Yerzley) is a measure of elasticity of an elastomeric composite as determined on a Yerzley device. It represents resilience, which is the ability of a material to absorb energy when it is deformed elastically, and to release that energy upon unloading. The modulus of resilience is defined as the maximum energy that can be absorbed per unit volume without creating a permanent distortion.

Stress Relaxation is the time dependent change in stress while maintaining a constant strain. It can be measured by rapidly straining a tested specimen in tension to a predetermined and relatively low strain level and measuring the stress necessary to maintain this strain as a function of time while keeping temperature constant. Stress decreases with time due to molecular relaxation processes that take place within the polymeric specimen. Relaxation can therefore be defined as a ratio of time dependent elastic modulus. Relaxation can further be defined as the change in % of the elastic modulus during a time period (e.g., a year).

Creep is the time dependent change is strain while maintaining a constant stress. It can be measured by subjecting a tested specimen to strain and measuring the level of stretching over time.

Figure 40A:
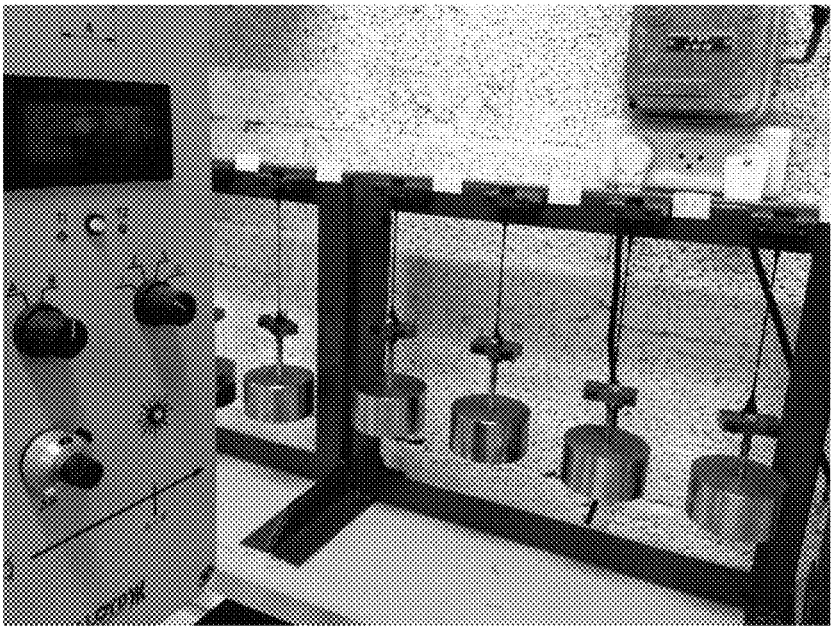
FIGS. 40A-B present a photograph of an apparatus used for performing an exemplary procedure for measuring the creep rate of elastomeric composites (FIG. 40A) and the data obtained in this procedure for an exemplary elastomeric composite according to some embodiments of the present invention (FIG. 40B).
Figure 40B:
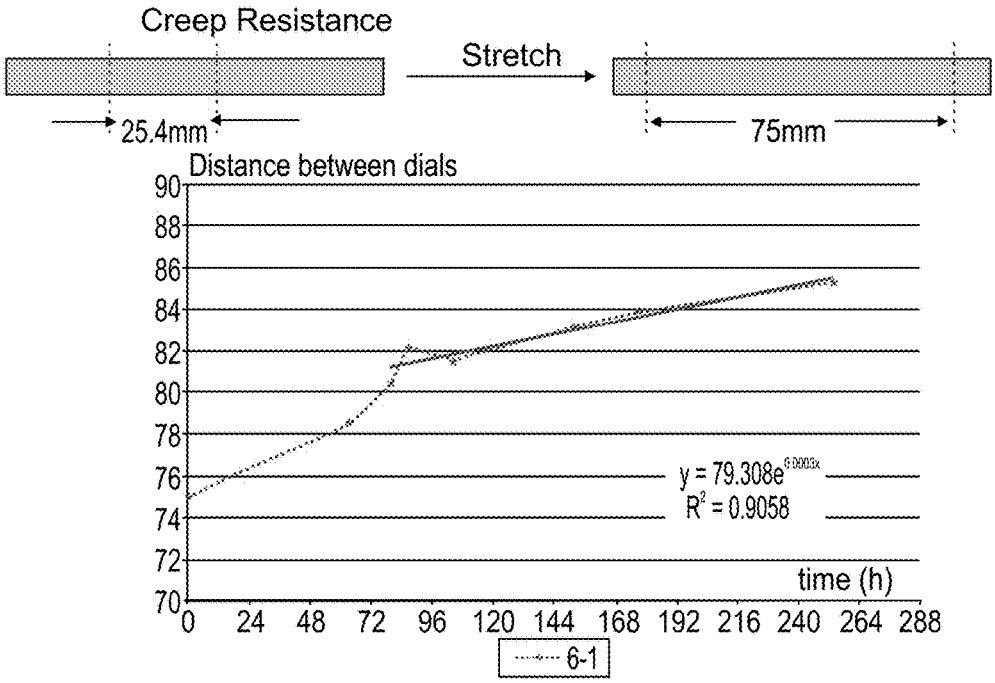

In an exemplary procedure, creep rate was determined by measuring the length between two-predetermined points on a specimen. The rate the length increases represents the creep rate. The creep rate is the slope of a curve of the stretching as a function of time. The creep per X years, in percents, can be calculated as the difference between the two points after X years–the initial difference between these points, divided by the initial difference between the two points and multiplied by 100. Such a procedure is exemplified in FIGS. 40A-B. Therein, a specimen was subjected to a stress applied by connecting it to 2 Kg weight. Stress on dumbbell (0.6 mm, 3.25 mm) is calculated as 110.61 $Kg/cm^2$.

Two points, one inch apart were marked at the beginning of stress application and the length between the points was measured with time, as described hereinabove.

The creep is presented herein as the change in mm per 3 years; or as the percentage (from the initial difference between the points, e.g., from 25.4 mm) of the creep per 3 years, upon application of a stress of about 110 $Kg/cm^2$. Values for the creep per 1 year, one month, or one week, can be easily extracted from these data.

Example 1

Preparation of Nanoclay Hybrids

Nanoclay hybrids are generally prepared by reacting commercially available MMT NCs, such as Cloisite 15A, with an antioxidant, as described herein, in an organic solvent (e.g., 600 ml), at elevated temperature, and thereafter adding to the mixture the mercaptosilane Si69, and optionally an acid (e.g., acetic acid or dodecylbenzensulfonic acid (Ufacid K)), added until a pH 3 is obtained. Reaction is then continued for several hours.

Figure 30:
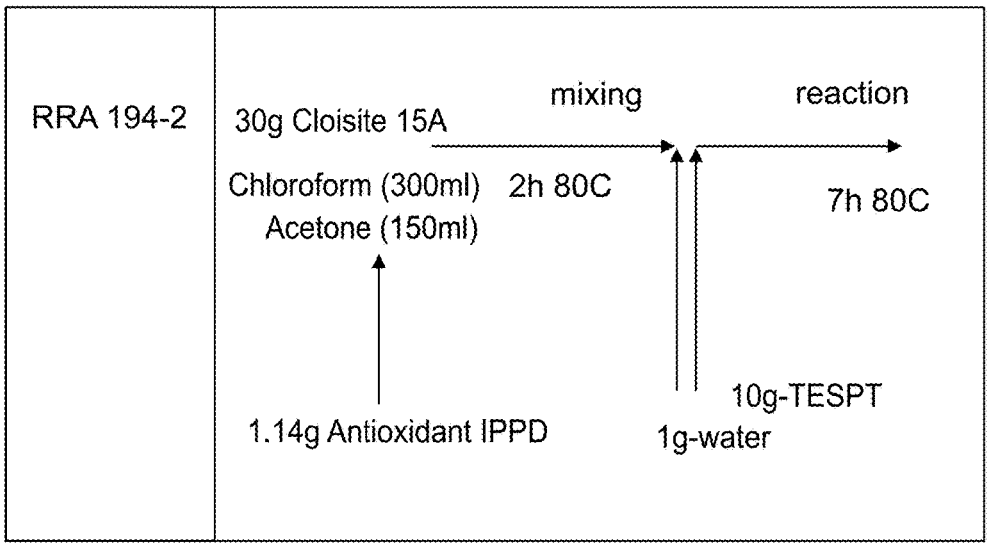
FIG. 30 presents a scheme depicting a process of preparing an exemplary modified nanoclay according to some embodiments of the present invention, referred to herein as RRA 194-2, by mixing NC Cloisite 15A and IPPD and thereafter adding Si69 (TE5PT), while using a mixture of chloroform and acetone (2:1) as the reaction solvent.

Preparation of RRA 194-2:

The preparation of RRA 194-2 is depicted in FIG. 30. In brief, to a suspension of Cloisite 15A in a mixture of chloroform:acetone 2:1 was added, while stirring, IPPD (an antioxidant), and upon heating for two hour at 80° C., Si69 and water were added, and the reaction mixture was heated for 7 hours at 80° C. Thereafter, the reaction mixture was poured onto a tray and dried for approximately 16 hours at room temperature.

Figure 31:
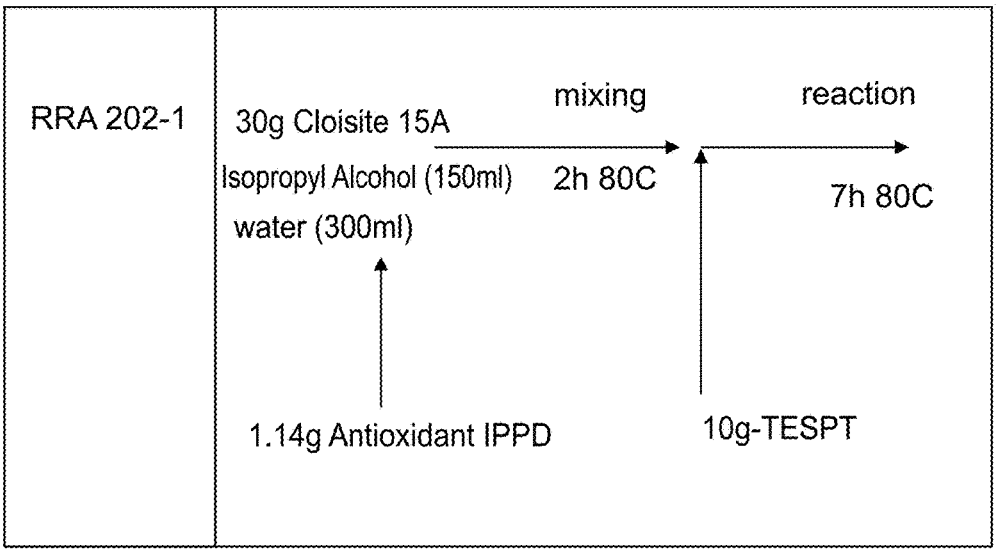
FIG. 31 presents a scheme depicting a process of preparing an exemplary modified nanoclay according to some embodiments of the present invention, referred to herein as RRA 202-1, by mixing NC Cloisite 15A and IPPD and thereafter adding Si69 (TE5PT), while using a mixture of isopropyl alcohol (IPA) and water (1:2) as the reaction solvent.

Preparation of RRA 202-1 and RRA 206-2:

The preparation of RRA 202-1 is depicted in FIG. 31. To a suspension of Cloisite 15A in a mixture of 1:3 isopropyl alcohol:water was added, while stirring, IPPD (an antioxidant), and upon heating for two hour at 80° C., Si69 was added, and the reaction mixture was heated for 7 hours at 80° C. Thereafter, the reaction mixture was poured onto a tray and dried for approximately 16 hours at room temperature.

RRA 206-2 was similarly prepared, while using a mixture of 3:1 isopropyl alcohol:water.

Following the above-described general procedure and exemplified procedure, additional exemplary modified nanoclays were prepared as follows:

Preparation of RRA 181-1:

To a suspension of Cloisite 15A in acetone was added, while stirring, IPPD (an antioxidant), and upon heating for one hour at 80° C., Si69, acid and water were added, and the reaction mixture was heated for 7 hours at 80° C.

Preparation of RRA 189-2:

To a suspension of Cloisite 15A in acetone was added, while stirring, DDA (an antioxidant) and SBS (an accelerator), and upon heating for two hour at 80° C., Si69, acid and water were added, and the reaction mixture was heated for 7 hours at 80° C.

Preparation of RRA 190-5:

To a suspension of Cloisite 15A in acetone was added, while stirring, DDA (an antioxidant) and SBS (an accelerator), and upon heating for two hour at 80° C., silica ($SiO_2$) in acetone was added and the mixture was heated for 10 hours at 90° C., prior to the addition of Si69 and water (no acid), and the reaction mixture was heated for 10 hours at 90° C.

Without being bound to any particular theory, it is assumed that the added silica reacts with both, free hydroxy groups on the nanoclays surface and the mercaptosilane.

Preparation of RRA 189-4:

To a suspension of Cloisite 15A in acetone was added, while stirring, DDA (an antioxidant) and SBS (an accelerator), and upon heating for two hour at 80° C., Si69 and water (no acid) were added, and the reaction mixture was heated for 7 hours at 80° C.

It is noted that RRA 189-4 are prepared similarly to RRA 189-but without the addition of an acid.

Preparation of RRA 194-1:

To a suspension of Cloisite 15A in chloroform was added, while stirring, IPPD (an antioxidant), and upon heating for two hour at 80° C., Si69 and water (no acid) were added, and the reaction mixture was heated for 7 hours at 80° C. Thereafter, the reaction mixture was poured onto a tray and dried for approximately 16 hours at room temperature.

Preparation of RRA 194-2:

To a suspension of Cloisite 15A in a mixture of chloroform:acetone 2:1 was added, while stirring, IPPD (an antioxidant), and upon heating for two hour at 80° C., Si69 and water (no acid) were added, and the reaction mixture was heated for 7 hours at 80° C.

Preparation of RRA 195-1:

To a suspension of Cloisite 15A in a mixture of water: acetone 2:1 was added, while stirring, IPPD (an antioxidant), and upon heating for two hour at 80° C., Si69 (no water and no acid) was added, and the reaction mixture was heated for 7 hours at 80° C.

Preparation of RRA 207-1:

To a suspension of Cloisite 15A in DMF was added, while stirring, IPPD (an antioxidant), and upon heating for two hour at 80° C., Si69 was added, and the reaction mixture was heated for 7 hours at 80° C. Thereafter, the reaction mixture was poured onto a tray and dried for approximately 16 hours at room temperature.

Additional Examples of nanoclay hybrids and of elastomeric composites comprising the same are provided hereinunder.

Example 2

Elastomeric Composite Containing Commercial Nanoclays and Mercaptosilane

Elastomeric composites were prepared in a one-pot method, in the presence of commercially available organo-modified nanoclays and mercaptosilane, with and without a plasticizer.

Table 1 below presents the ingredients of the tested elastomeric composites.

TABLE 1

| | ED01 | ED02 | ED03 | ED04 |
|---|---|---|---|---|
| NR (SMR 10) | 90.00 | | | |
| PB(BR 1220) | 10.00 | | | |
| zinc oxide | 5.00 | | | |
| acid stearic | 2.00 | | | |
| CLOISITE 30B | 5.00 | — | 5.00 | — |
| CLOISITE 15A | — | 5.00 | — | 5.00 |
| Mercaptosil (Si 69) | 5.00 | | | |
| Plasticis1 (DOS) | — | — | 13.50 | 13.50 |
| Sulfur | 1.80 | | | |
| Acceler1 (MBS) | 0.60 | | | |
| Acceler2 (DPG) | 0.50 | | | |
| Acceler3 (TMTM) | 0.25 | | | |

Figure 32:
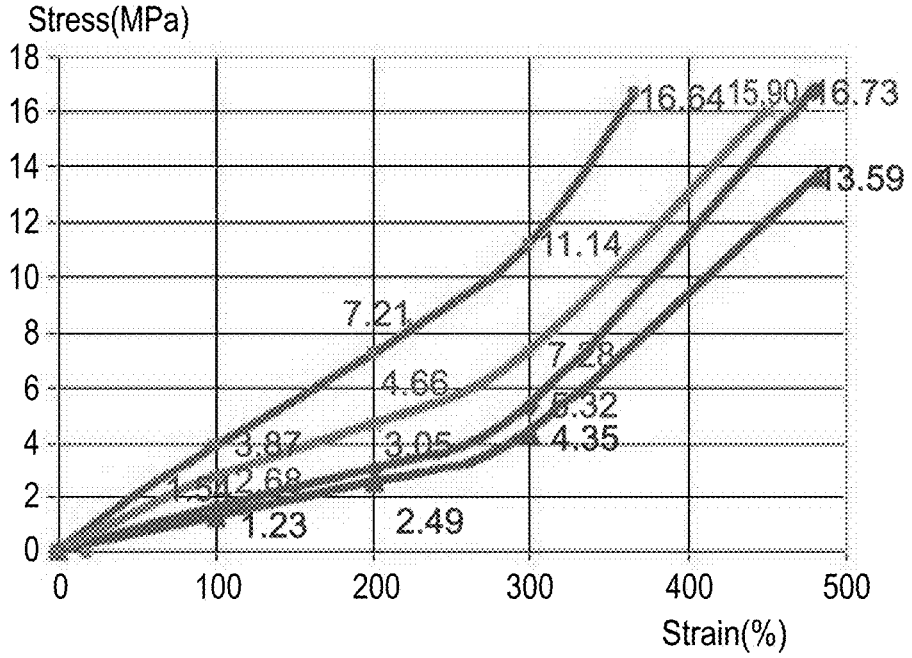
FIG. 32 presents comparative plots showing stress-versus-strain data recorded for exemplary elastomeric composites according to some embodiments of the present invention, made in a one-pot method from natural rubber and polybutadiene (90:10 phr), in the presence of, inter alia, mercaptosilyl, and in the presence of Cloisite 30B nanoclays (5.00 phr) (ED01; red), Cloisite 15B nanoclays (5.00 phr) (ED02; green), Cloisite 30B nanoclays (5.00 phr) and plasticizer DOS (13.50 phr) (ED03; blue), or Cloisite 15B nanoclays (5.00 phr) and plasticizer DOS (13.50 phr) (ED04; pink)

FIG. 32 presents comparative stress-versus-strain plots of the tested elastomeric composites, and demonstrates the adverse effect of the plasticizer on the tensile strength of the composite.

The effect of plasticizer load was therefore tested, and composites comprising lower amount of the plasticizer were prepared, as depicted in Table 2.

TABLE 2

| | ED53G | ED56G | ED59G |
|---|---|---|---|
| MR (SMR10) | 90.00 | | |
| PB (BR 1220) | 10.00 | | |
| zinc oxide | 5.00 | | |
| acid stearic | 2.00 | | |
| CLOISITE 15A | 10.00 | | |
| Mersaptosilane (Si69) | 5.00 | | |
| Plasticizer (DOA) | — | 3.25 | 6.50 |
| Sulfur | 1.80 | | |
| Acceler1 (MBS) | 0.60 | | |
| Acceler2 (DPG) | 0.50 | | |
| Acceler3 (TMTM) | 0.25 | | |
| Retarder (PVI) | 0.75 | | |

Figure 33:
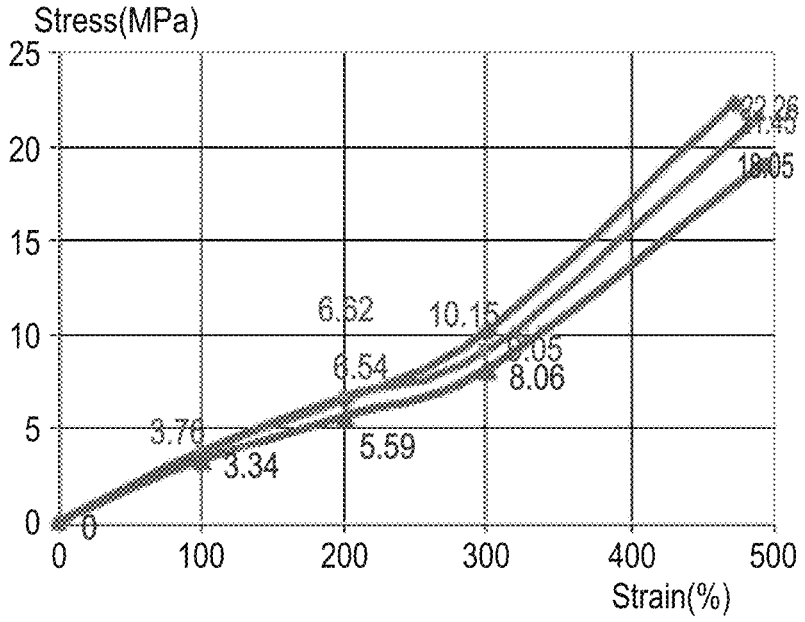
FIG. 33 presents comparative plots showing stress-versus-strain data recorded for exemplary elastomeric composites according to some embodiments of the present invention, made in a one-pot method from natural rubber and polybutadiene (90:10 phr), in the presence of, inter alia, mercaptosilyl, a retarder and Cloisite 15B nanoclays (5.00 phr) (ED53G; red), Cloisite 15B nanoclays (5.00 phr) plasticizer DOS (3.25 phr) (ED56G; green), or Cloisite 15B nanoclays (5.00 phr) and plasticizer DOS (6.50 phr) (ED59G; blue)

FIG. 33 presents comparative plots or the stress-versus-strain curves or the tested elastomeric composites.

Example 3

Elastomeric Composites Containing Nanohybrids

Elastomeric composites were prepared in a one-pot method, in the presence of commercially available organo-modified nanoclays and mercaptosilane, or, alternatively, in the presence of an exemplary nanohybrid, RRA 194-2 (see, Example 1).

Table 3 below presents the ingredients of the tested elastomeric composites.

TABLE 3

| | ED11-RG | ED34G |
|---|---|---|
| NR (SMR10) | 90.00 | |
| PB (BR 1220) | 10.00 | |
| zinc oxide | 5.00 | |
| acid stearic | 2.00 | |
| CLOISITE 15A | 10.00 | — |
| Nanohybrid (RRA 194-2R) | — | 15.00 |
| Mercaptosilane (Si 69) | 5.00 | — |
| Sulfur | 1.80 | |
| Acceler1 (MBS) | 0.60 | |
| Acceler2 (DPG) | 0.50 | |
| Aecceler3 (TMTM) | 0.25 | |

Figure 34:
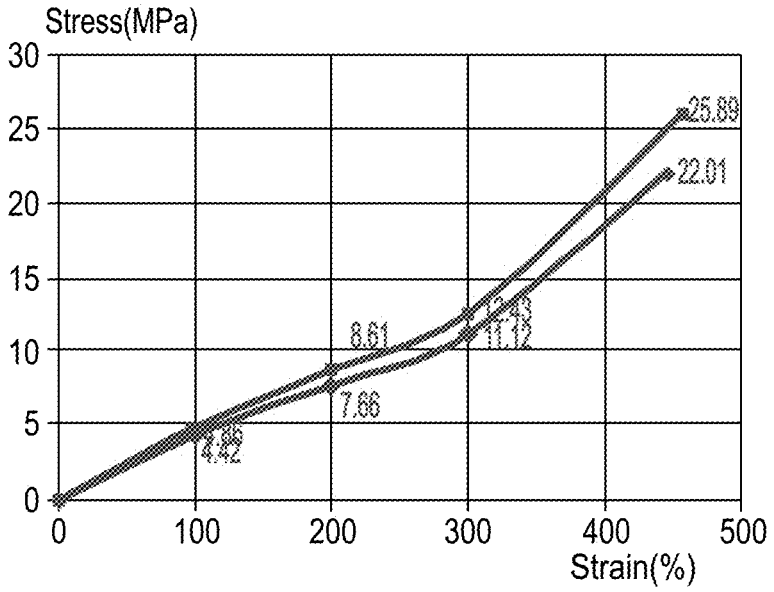
FIG. 34 presents comparative plots showing stress-versus-strain data recorded for exemplary elastomeric composites according to some embodiments of the present invention, made from natural rubber and polybutadiene (90:10 phr), in the presence of mercaptosilyl (5.00 phr) and Cloisite 15B nanoclays (10.00 phr) (ED11-RG; red), or Nanohybrids RRA 194-2 (10.00 phr) (ED34G; green)

FIG. 34 presents comparative plots of the stress-versus-strain curves of the tested elastomeric composites.

Figure 35A:
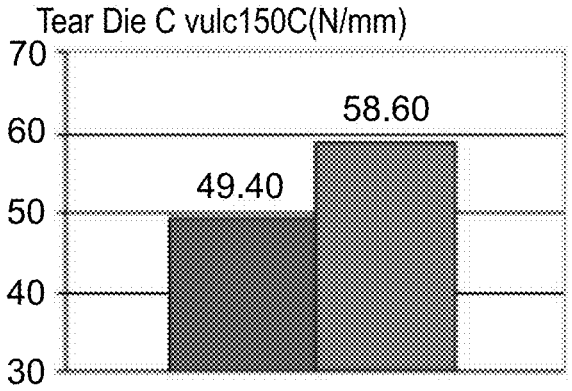
FIGS. 35A-B are bar graphs demonstrating Tear Resistance (FIG. 35A) and Work (FIG. 35B), as measured at 150° C., for exemplary elastomeric composites according to some embodiments of the present invention, made in a one-pot method from natural rubber and polybutadiene (90:10 phr), in the presence of mercaptosilyl (5.00 phr) and Cloisite 15B nanoclays (10.00 phr) (ED11-RG; red), or Nanohybrids RRA 194-2 (10.00 phr) (ED34G; green)
Figure 35B:
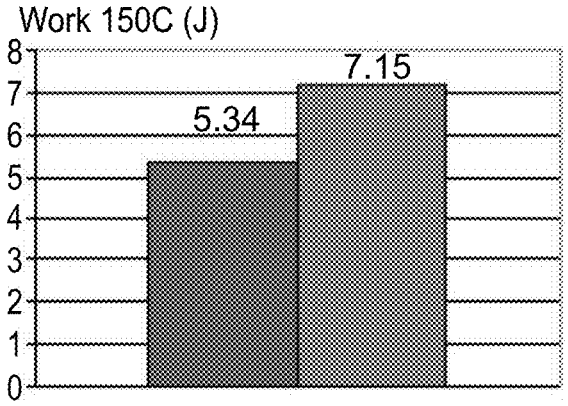

FIGS. 35A and 35B present the tear resistance and Work of tested composites. The improved performance of elastomeric composites containing the nanohybrids is clearly demonstrated in FIGS. 34 and 35A-B.

In order to further improve the performance of the elastomeric composites, Carbon Black and a retarding agent (retarder, PVI) were added, in various amounts and ratios.

Table 4 below presents the ingredients of the tested elastomeric composites.

TABLE 4

| | ED60-252 | ED60-253 | ED60-254 | ED60-255 | ED60-256 |
|---|---|---|---|---|---|
| NR (SMR10) | 90.00 | | | | |
| PB (BR 1220) | 10.00 | | | | |
| zinc oxide | 5.00 | | | | |
| acid stearic | 2.00 | | | | |
| Black (HAF N330) | 45.00 | 40.00 | 40.00 | 45.00 | 45.00 |
| Nanohybr (RRA202-1) | 15.00 | 13.33 | 13.33 | 13.33 | 13.33 |
| Sulfur | 1.80 | 1.80 | 2.20 | 1.80 | 2.20 |
| Acceler1 (MBS) | 0.60 | | | | |
| Acceler2 (DPG) | 0.50 | | | | |
| Acceler3 (TMTM) | 0.25 | | | | |
| SANTOGARD PVI | 0.50 | 0.75 | 0.50 | 0.75 | 0.50 |

Figure 36:
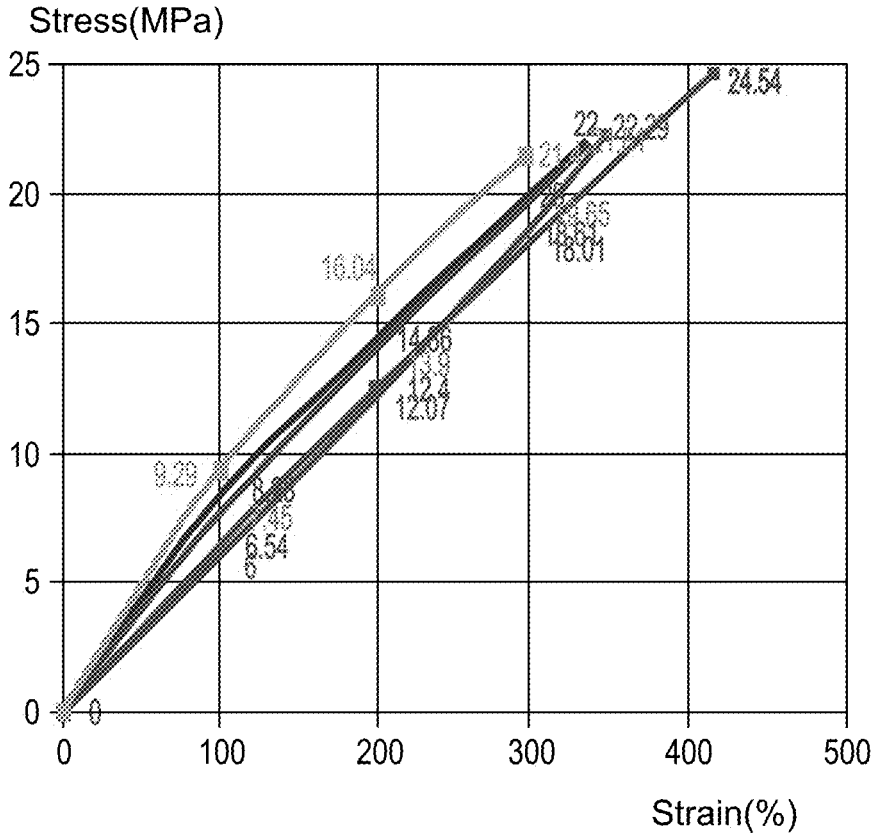
FIG. 36 presents comparative plots showing stress-versus-strain data recorded for exemplary elastomeric composites according to some embodiments of the present invention, made from natural rubber and polybutadiene (90:10 phr), in the presence of, inter alia, CB (45.00 phr), Nanohybrids RRA 202-1 (15.00 phr), sulfur (1.80 phr) and a retarder PVI (0.50 phr) (ED60-252; red), of CB (40.00 phr), Nanohybrids RRA 202-1 (13.33 phr), sulfur (1.80 phr) and a retarder PVI (0.75 phr) (ED60-253; green), or of CB (40.00 phr), Nanohybrids RRA 202-1 (13.33 phr), sulfur (2.20 phr) and a retarder PVI (0.50 phr) (ED60-254; blue), or of CB (40.00 phr), Nanohybrids RRA 202-1 (13.33 phr), sulfur (1.80 phr) and a retarder PVI (0.75 phr) (ED60-255; pink), or of CB (45.00 phr), Nanohybrids RRA 202-1 (13.33 phr), sulfur (2.20 phr) and a retarder PVI (0.50 phr) (ED60-256; light green)

FIG. 36 presents comparative plots of the stress-versus-strain curves of the tested elastomeric composites.

Figure 37A:
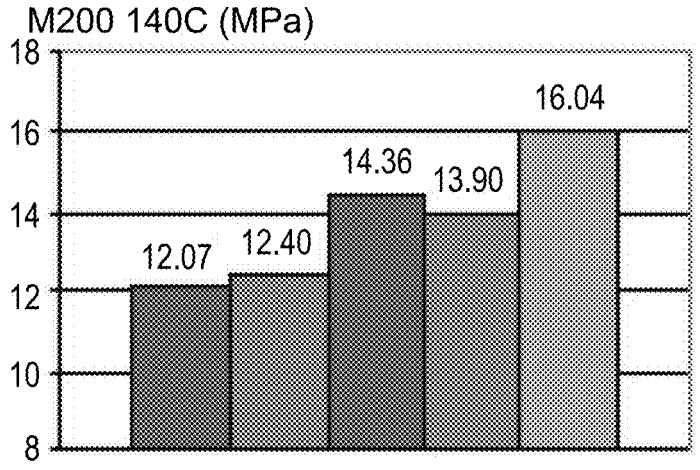
FIGS. 37A-B are bar graphs depicting the Elastic Modulus M200 (FIG. 37A) and Elongation (FIG. 37B) of the elastomeric composites of FIG. 36.
Figure 37B:
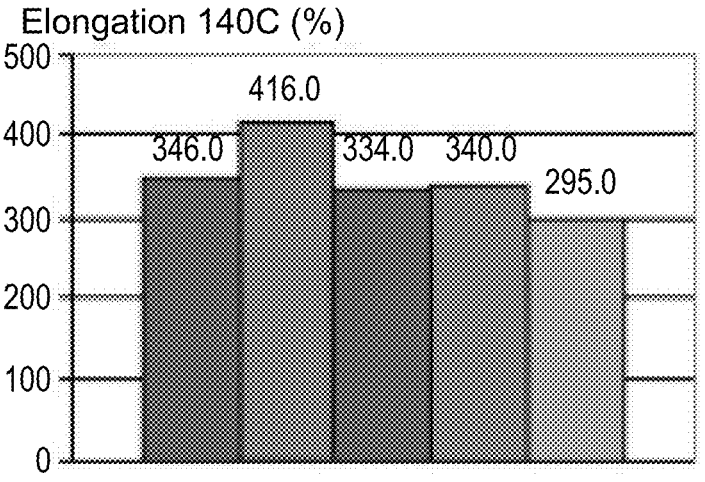

FIGS. 37A and 37B present the M200 and elongation of the tested composites, and clearly shows the superior elasticity, yet high modulus, of ED60-253, in which a 3:1 ratio of CB:nanoclays, is used.

The Yerzley elasticity and other properties of elastomeric composites containing the nanohybrids, compared to commercial nanoclays, were further tested.

Table 5 below presents the ingredients of the compared elastomeric composites and Table 6 below presents the properties of the tested elastomeric composites.

TABLE 5

| | E3 | ED64-3 |
|---|---|---|
| SMR 10 | 100.00 | 90.00 |
| BR 1220 | — | 10.00 |
| zinc oxide | 5.00 | 5.00 |
| acid stearic | 2.00 | 2.00 |
| Antioxid. PAN | 1.00 | — |
| ANTIOXIDANT 4010NA | 1.00 | — |
| Antioz. DPPD | 2.00 | — |
| HAF-LS | 50.00 | — |
| HAF N330 | — | 40.00 |
| Ultrasil VN3 | 10.00 | — |
| RRRA 204-3 | — | 13.33 |

TABLE 5-continued

| | E3 | ED64-3 |
|---|---|---|
| Si69 X50 | 2.50 | — |
| sulphur | 2.50 | 1.80 |
| Santocure MOR | 0.80 | — |
| SANTOCURE MBS | — | 1.20 |
| PERKACIT TMTM | 0.20 | 0.25 |
| PERKACIT DPG | — | 0.50 |
| Rheowax 721 | 0.50 | — |
| Struktol Akt. 73 | 4.00 | — |

TABLE 6

| | E3 | ED64-3 |
|---|---|---|
| Mechanical properties | | — |
| Vulc temp (° C.) | 160 | 140 |
| Vulc time (min) | 10 | 12 |
| Hardness ShA | 75 | 73 |
| Tensile MPa | 24.80 | 25.52 |
| Elongation % | 396 | 356 |
| M100 MPa | 5.20 | 7.46 |
| M200 MPa | 11.60 | 13.99 |
| M300 MPa | 19.20 | 20.82 |
| Elast Yerzley % | 66.5 | 69.07 |

Table 6 further demonstrates the improvement in mechanical properties, particularly the improvement in elasticity, as reflected by the improved resilience (Yerzley), and further the improvement in elastic modulus (M200), when nanohybrid was used.

Based on the obtained data, the composite referred to in Table 1 as ED60-253 was selected for further studies. This composite comprises Carbon Black 40 phr and 13.33 nanohybrid.

Example 4

Elastomeric Composites Containing 40 Phr Carbon Black and 13.33 Phr Nanohybrid The effects of the amounts of sulfur and MBS, and the presence, type and/or amount of a plasticizer, a retarder and a dispersant, and of any combination thereof, were tested for elastomeric composites containing Carbon Black 40 phr and nanohybrid 13.33 phr.

In preliminary experiments, it was found that a combination of 1.8 parts sulfur, 1.2 parts MBS as acclerator1, 0.5 parts of DPG as acclerator2, and 0.25 parts of TMTM as acclerator3, provides elastomeric composites with better performance, compared to other amounts and/or components ratios.

Figure 38:
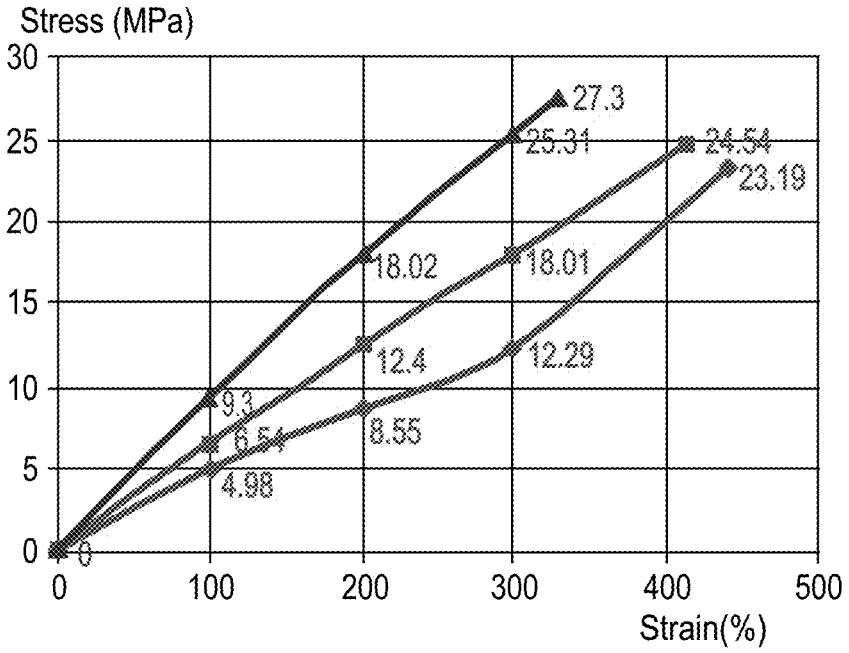
FIG. 38 presents comparative plots showing stress-versus-strain data recorded for exemplary elastomeric composites according to some embodiments of the present invention, made from natural rubber and polybutadiene (90:10 phr), in the presence of, inter alia, Nanohybrids RRA 194-2R (15.00 phr), sulfur (1.80 phr) and various amounts of accelerators (ED34-G; red), of CB (40.00 phr), Nanohybrids RRA 202-1 (13.33 phr), sulfur (1.80 phr), various amount of accelerators and a retarder PVI (0.75 phr) (ED60-253; green), or of CB (40.00 phr), Nanohybrids RRA 202-1 (13.33 phr), sulfur (1.80 phr) and various amounts of accelerators (ED253-OPT32; blue)

The improvement in the module of elasticity of such exemplary elastomeric composites is exemplified in FIG. 38.

Table 7 below presents the ingredients of the tested elastomeric composites presented in FIG. 38. As shown in Table 7 and FIG. 38, a substantial improvement in the elasticity modulus is observed for the elastomeric composite in which the combination of components was optimized.

TABLE 7

| | ED34G | ED60-253 | ED253-OPT32 |
|---|---|---|---|
| NR (SMR10) | 90.00 | | |
| PB (BR 1220) | 10.00 | | |
| zinc oxide | 5.00 | | |
| acid stearic | 2.00 | | |

TABLE 7-continued

| | ED34G | ED60-253 | ED253-OPT32 |
|---|---|---|---|
| Black (HAF N330) | — | 40.00 | 40.00 |
| Nanohybr1 (RRA 194-2R) | 15.00 | — | — |
| Nanohybr2 (RRA 202-1) | | 13.33 | |
| Sulfur | 1.80 | | |
| Acceler1 (MBS) | 0.60 | 0.60 | 1.20 |
| Acceler2 (DPG) | 0.50 | | |
| Acceler3 (TMTM) | 0.25 | | |
| Retarder (PVI) | — | 0.75 | — |

Figure 39:
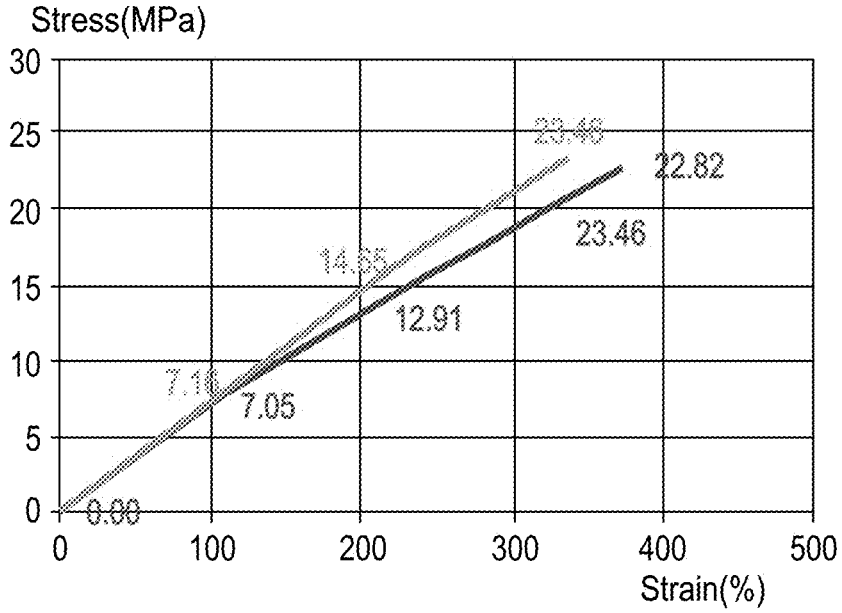
FIG. 39 presents comparative plots showing stress-versus-strain data recorded for the exemplary elastomeric composite denoted ED60-253R2, prepared by extrusion+steam vulcanization (green) and by plate molded vulcanization (light green)

The effect of the type of vulcanization was also tested. The elastomeric composite ED60-253R2 was prepared using extrusion and steam vulcanization and using plate molded vulcanization, as indicated in FIG. 39.

Table 8 below presents the lists of ingredient of ED60-253R2.

TABLE 8

| | ED60-253R2 |
|---|---|
| NR (SMR 10) | 90.00 |
| PB (BR 1220) | 10.00 |
| zinc oxide | 5.00 |
| acid stearic | 2.00 |
| Black (HAF N330) | 40.00 |
| Nanohybrid (RRA 202-1) | 13.33 |
| Sulfur | 1.80 |
| Acceler1 (MBS) | 0.60 |
| Acceler2 (DPS) | 0.50 |
| Acceler3 (TMTM) | 0.25 |
| Retarder (PVI) | 0.75 |

FIG. 39 presents comparative stress-versus-strain curves of the elastomeric composites prepared by the tested vulcanizations, and show that autoclaved (steamed) extruded composite exhibit somewhat reduced modulus, compared to the plate molded composite.

Further elastomeric composites, into which a processing aid was added, were tested. Such compositions were formulated in order to provide compositions which are suitable for extrusion processing (e.g., with steam), yet the effect of the processing aids on the elastic modulus and other mechanical properties is minimized.

Table 9 below presents the list of ingredients of an exemplary elastomeric composite, and Table 10 below presents the rheological and mechanical properties of this elastomeric composite.

TABLE 9

| | ED69-OPT33 |
|---|---|
| SMR 10 | 90.00 |
| BR 1220 | 10.00 |
| zinc oxide | 5.00 |
| acid stearic | 2.00 |
| HAF N330 | 40.00 |
| RRA 202-1 | 13.33 |
| sulfur | 1.80 |
| SANTOCURE MBS | 1.80 |
| PERKACIT DPG | 1.20 |
| SANTOGARD PVI | 1.00 |
| PERKACIT TMTM | 0.30 |
| STRUKTOL WB16 | 3.00 |
| CUMAR 80 | 1.50 |
| | 170.93 |

TABLE 10

| Rheological properties MDR D2000 140 C. | |
|---|---|
| MV lb-in | 1.40 |
| t2 min | 2.66 |
| t90 min | 10.60 |
| S1 | 12.39 |
| S1-mV | 10.99 |
| **Mechanical properties 140 C.** | |
| Vulc time min | 13.00 |
| Hardness ShA | 74 |
| Tensile MPa | 23.72 |
| Elongation % | 342 |
| M100 MPa | 6.65 |
| M200 MPa | 13.27 |
| M300 MPa | 20.37 |
| M300 M100 | 3.06 |
| Work | 5.09 |

In further comparative studies, elastomeric composites comprising similar ingredients to those used for ED60-253R2, yet in which the nanoclay hybrids were replaced by commercial graphene nanoparticles, were tested.

An inferior performance of these elastomeric composites, compared to the composites comprising the anti-oxidant modified nanoclay hybrids, as described hereinabove, was clearly demonstrated (data not shown)

Example 6

Elastomeric Composites Containing 40 Phr Carbon Black and 13.33 Phr Various Nanohybrids The effect of the type of the nanohybrid used was tested for elastomeric composites containing Carbon Black 40 phr and nanohybrid 13.33 phr, wherein the tested nanohybrids were RRA201-1; RRA 206-2; and RRA207-1, all prepared as described in Example 1 hereinabove and in Table 11 below.

TABLE 11

| | | NanoHybrids | | |
|---|---|---|---|---|
| | | RRA201-1 | RRA206-2 | RRA207-1 |
| 2 h 80 C. | Cloisite 15A | 40 | 40 | 40 |
| | water | 400 | 200 | — |
| | Isopropyl alcohol | 200 | 400 | — |
| | Dimethyl formamide | | — | 600 |
| | IPPD | 1.51 | 1.51 | 1.51 |
| 7 h 80 C. | Si 69 | 13.33 | 13.33 | 13.33 |

Table 12 below presents the list of ingredients of exemplary elastomeric composites, differing from one another by the type of the nanohybrid, and Table 13 below presents the rheological and mechanical properties of these elastomeric composites.

As can be seen, while all composites containing the nanohybrids exhibit high elongation, high Scorch time (t2) and high Work values, the best performance was obtained with RRA 206-2 nanohybrid, and further comparative studies were performed with elastomeric composites comprising this nanohybrid.

TABLE 12

| | ED69-OPT33 | ED70-2 | ED70-3 |
|---|---|---|---|
| SMR 10 | 90.00 | — | — |
| SMR CV60 | — | 90.00 | 90.00 |

TABLE 12-continued

| | ED69-OPT33 | ED70-2 | ED70-3 |
|---|---|---|---|
| BR 1220 | 10.00 | 10.00 | 10.00 |
| zinc oxide | 5.00 | 5.00 | 5.00 |
| acid stearic | 2.00 | 2.00 | 2.00 |
| HAF N330 | 40.00 | 40.00 | 40.00 |
| RRA 202-1 | 13.33 | — | — |
| RRA 206-2 | — | 13.33 | — |
| BRA 207-1 | — | — | 13.33 |
| sulphur | 1.80 | 1.80 | 1.80 |
| SANTOCURE MBS | 1.80 | 1.80 | 1.80 |
| PERKACIT DPG | 1.20 | 1.20 | 1.20 |
| SANTOGARD PVI | 1.00 | 1.00 | 1.00 |
| PERKACIT TMTM | 0.30 | 0.30 | 0.30 |
| STRUKTOL WB16 | 3.00 | 3.00 | 3.00 |
| CUMAR 80 | 1.50 | 1.50 | 1.50 |
| | 170.93 | 170.93 | 170.93 |

TABLE 13

| | ED69-OPT33 | ED70-2 | ED70-3 |
|---|---|---|---|
| Rheological properties MDR D2000 140 C. | | | |
| MV lb-in | 1.40 | 1.51 | 1.57 |
| t2 min | 2.66 | 2.33 | 2.41 |
| t90 min | 10.60 | 14.12 | 12.96 |
| t100 min | 23.45 | 23.95 | 23.93 |
| S1 min | 12.39 | 15.73 | 19.96 |
| S2 min | 0.01 | 0.03 | 0.67 |
| tan | 0.001 | 0.002 | 0.034 |
| Rev 0.5 | — | — | — |
| S1-mV | 10.99 | 14.22 | 18.39 |
| Mechanical properties 140 C. | | | |
| Vulc time min | 13.00 | 17.00 | 15.00 |
| Hardness ShA | 74 | 78 | 79 |
| Tensile MPa | 23.72 | 23.23 | 22.53 |
| Elongation % | 342 | 396 | 393 |
| M100 MPa | 6.65 | 6.11 | 5.73 |
| M200 MPa | 13.27 | 11.34 | 11.07 |
| M300 MPa | 20.37 | 17.09 | 16.91 |
| Tear N/mm | — | 52.00 | 53.50 |
| M300/M100 | 3.06 | 2.80 | 2.95 |
| Work | 5.09 | 6.24 | 5.76 |

Example 7

Elastomeric Composite Containing 20 Phr Carbon Black and 20 Phr Nanohybrid

Elastomeric composites containing Carbon Black 20 phr and nanohybrid 20 phr, were further tested, in order to test the effect of the CB/nanohybrid ratio on the stress relaxation and creep. Various combinations of accelerators, processing aid agents, retarders and plasticizers were also tested. Tables 14 and 15 present the list of ingredients of exemplary elastomeric composites, comprising the nanohybrid RRA 206-2 20 phr and Carbon Black 20 phr, and differing from one another by the vulcanization system used. Thus, for example, in elastomeric composite ED77-06 (Table 14), a vulcanization system comprising sulfur 0.70 phr, SANTOCURE MBS 1.70 phr, and PERKACIT TETD 0.70 phr, which has been described in the literature [Natural rubber formulary], in combination with the processing aid STRUKTOL ZEH (ZEH=zinc diethyl hexanoate), which has also been described in the literature for imparting low stress relaxation, was tested and compared to the previously tested system used in elastomeric composite ED 76-06 (see, for example, Tables 9 and 12).

TABLE 14

| | ED76-06 |
|---|---|
| SMR CV60 | 90.00 |
| BR 1220 | 10.00 |
| zinc oxide | 5.00 |
| acid stearic | 2.00 |
| HAF N330 | 20.00 |
| RRA 206-2 | 20.00 |
| sulphur | 1.80 |
| SANTOCURE MBS | 1.80 |
| PERKACIT DPG | 1.20 |
| SANTOGARD PVI | 1.00 |
| PERKACIT TMTM | 0.30 |
| STRUKTOL WB16 | 3.00 |
| CUMAR 80 | 1.50 |
| | 157.60 |

TABLE 15

| | ED77-06 |
|---|---|
| SMR CV60 | 90.00 |
| BR 1220 | 10.00 |
| zinc oxide | 5.00 |
| HAF N330 | 20.00 |
| RRA 206-2 | 20.00 |
| sulphur | 0.70 |
| SANTOCURE MBS | 1.70 |
| PERKACIT TETD | 0.70 |
| STRUKTOL WB16 | 3.00 |
| CUMAR 80 | 1.50 |
| STRUKTOL ZEH-DL | 1.00 |
| | 153.60 |

The rheological and mechanical properties of these elastomeric composites are presented in Tables 19 and 20, respectively. As can be seen therein, desired values of parameters such as t2, elongation, Work and creep, are exhibited by the elastomeric composition which comprises a combination of accelerators, processing aids, and sulfur, as devised and described hereinabove (although not comprising the literature recommended Struktol ZEH), and inferior values are exhibited for composites comprising the known vulcanization system.

TABLE 16

| | ED76-06 |
|---|---|
| Rheological properties MDR D2000 140 C. | |
| MV lb-in | 0.91 |
| t2 min | 2.93 |
| t90 min | 14.37 |
| S1 min | 11.92 |
| S2 min | 0.01 |
| tan | 0.001 |
| S1-mV | 11.01 |
| Mechanical properties 140 C. | |
| Vulc time min | 17.00 |
| Hardness ShA | 75 |
| Tensile MPa | 22.50 |
| Elongation % | 405 |
| M100 MPa | 6.66 |
| M200 MPa | 10.65 |
| M300 MPa | 15.36 |
| M300/M100 | 2.31 |
| Tear N/mm | 51.00 |
| Work | 5.76 |
| Creep | 294.02 |

TABLE 17

| | ED77-06 |
|---|---|
| Rheological properties MDR D2000 140 C. | |
| MV lb-in | 1.06 |
| t2 min | 1.84 |
| t90 min | 17.18 |
| S1 min | 11.19 |
| S2 min | 0.01 |
| tan | 0.001 |
| S1-mV | 10.13 |
| Mechanical properties 140 C. | |
| Vulc time min | 20.00 |
| Hardness ShA | 72 |
| Tensile MPa | 23.29 |
| Elongation % | 336 |
| M100 MPa | 7.45 |
| M200 MPa | 13.16 |
| M300 MPa | 20.24 |
| M300/M100 | 2.72 |
| Tear N/mm | 54.80 |
| Work | 4.69 |
| Creep | 302.87 |

Further elastomeric composites were tested for the effect of the type of an additional ZEH-containing processing aid on the composite's performance.

The lists of ingredients of these elastomeric composites are presented in Table 18 below, and the rheological and mechanical properties of these elastomeric composites are presented in Table 19 below.

As can be seen therein, the addition of ZEH-containing processing aid (with or without a carrier) results in higher values of t2, elongation, modulus, and reduced creep.

TABLE 18

| | ED80-07 | ED86-01 |
|---|---|---|
| SMR CV60 | 90.00 | — |
| SMR 10 | — | 90.00 |
| BR 1220 | 10.00 | 10.00 |
| zinc oxide | 5.00 | 5.00 |
| acid stearic | 2.00 | 2.00 |
| HAF N330 | 20.00 | 20.00 |
| RRA 206-2 | 20.00 | 20.00 |
| sulphur | 1.80 | 1.80 |
| SANTOCURE MBS | 1.80 | 1.80 |
| PERKACIT DPG | 0.40 | 0.40 |
| SANTOGARD PVI | 0.20 | 0.20 |
| STRUKTOL WB16 | 3.00 | 3.00 |
| CUMAR 80 | 1.50 | 1.50 |
| STRUKTOL ZEH-DL | 2.00 | — |
| Struktol ZEH | — | 1.30 |
| | 157.70 | 157.00 |

TABLE 19

| | ED80-07 | ED86-01 |
|---|---|---|
| Rheological properties MDR D2000 140 C. | | |
| MV lb-in | 0.48 | 0.80 |
| t2 min | 3.06 | 3.16 |
| t90 min | 12.26 | 14.52 |
| S1 min | 23.94 | 11.64 |
| S2 min | 9.66 | 0.80 |
| tan | 0.62 | 0.069 |
| S1-mV | 23.46 | 10.84 |
| Mechanical properties 140 C. | | |
| Vulc time min | 15.00 | 17.00 |
| Hardness ShA | 64 | 71 |

TABLE 19-continued

| | ED80-07 | ED86-01 |
|---|---|---|
| Tensile MPa | 24.33 | 24.29 |
| Elongation % | 452 | 427 |
| M100 MPa | 4.55 | 6.49 |
| M200 MPa | 8.55 | 10.45 |
| M300 MPa | 13.10 | 15.31 |
| M300/M100 | 2.88 | 2.36 |
| Tear N/mm | 44.40 | 57.00 |
| Creep | 219.92 | 281.65 |

Example 8

Elastomeric Composites Containing Various Carbon Black/Nanohybrid Ratios

Elastomeric composites comprising various Carbon black/nanohybrid ratios, with and without various concentrations of the Struktol ZEH-DL processing aid, were prepared and tested.

The lists of ingredients of these elastomeric composites are presented in Table 20 below and the rheological and mechanical properties are presented in Table 21 below.

TABLE 20

| | ED76-06 | ED80-01 | ED80-06 | ED80-07 | ED82-1 |
|---|---|---|---|---|---|
| SMR CV60 | 90.00 | — | 90.00 | 90.00 | 90.00 |
| SMR 10 | — | 90.00 | — | — | — |
| BR 1220 | 10.00 | 10.00 | 10.00 | 10.00 | 10.00 |
| zinc oxide | 5.00 | 5.00 | 5.00 | 5.00 | 5.00 |
| acid stearic | 2.00 | 2.00 | 2.00 | 2.00 | 2.00 |
| HAF N330 | 20.00 | 40.00 | 20.00 | 20.00 | 30.00 |
| RRA 206-2 | 20.00 | 13.33 | 20.00 | 20.00 | 17.00 |
| sulphur | 1.80 | 1.80 | 1.80 | 1.80 | 1.80 |
| SANTOCURE MBS | 1.80 | 1.80 | 1.80 | 1.80 | 1.80 |
| PERKACIT DPG | 1.20 | 0.40 | 0.40 | 0.40 | 0.40 |
| SANTOGARD PVI | 1.00 | 0.20 | 0.20 | 0.20 | 0.20 |
| PERKACIT TMTM | 0.30 | 0.30 | — | — | — |
| STRUKTOL WB16 | 3.00 | 3.00 | 3.00 | 3.00 | 3.00 |
| CUMAR 80 | 1.50 | 1.50 | 1.50 | 1.50 | 1.50 |
| STRUKTOL ZEH-DL | — | — | 1.00 | 2.00 | 2.00 |
| | 157.60 | 169.03 | 156.70 | 157.70 | 164.70 |

TABLE 21

| | ED76-06 | ED80-01 | ED80-06 | ED80-07 | ED82-1 |
|---|---|---|---|---|---|
| Rheological properties MDR D2000 140 C. | | | | | |
| MV lb-in | 0.91 | 1.23 | 0.80 | 0.48 | 1.02 |
| t2 min | 2.93 | 2.65 | 3.00 | 3.06 | 3.20 |
| t90 min | 14.37 | 13.25 | 12.18 | 12.26 | 14.11 |
| S1 min | 11.92 | 23.99 | 23.80 | 23.94 | 23.83 |
| S2 min | 0.01 | 12.78 | 9.61 | 9.66 | 12.71 |
| tan | 0.001 | 0.16 | 0.74 | 0.62 | 1.02 |
| S1-mV | 11.01 | 22.76 | 23.00 | 23.46 | 22.81 |
| Mechanical properties 140 C. | | | | | |
| Vulc time min | 17.00 | 16.00 | 15.00 | 15.00 | 17.00 |
| Hardness ShA | 75 | 76 | 65 | 64 | 78 |
| Tensile MPa | 22.50 | 23.70 | 22.85 | 24.33 | 22.73 |
| Elongation % | 405 | 429 | 425 | 452 | 374 |
| M100 MPa | 6.66 | 5.34 | 4.78 | 4.55 | 6.71 |

TABLE 21-continued

| | ED76-06 | ED80-01 | ED80-06 | ED80-07 | ED82-1 |
|---|---|---|---|---|---|
| M200 MPa | 10.65 | 10.21 | 9.06 | 8.55 | 11.60 |
| M300 MPa | 15.36 | 15.67 | 14.15 | 13.10 | 17.40 |
| M300/M100 | 2.31 | 2.93 | 2.96 | 2.88 | 2.59 |
| Tear N/mm | 51.00 | 60.10 | 49.30 | 44.40 | 52.90 |
| Creep | 294.02 | 246.22 | 231.93 | 219.92 | 267.17 |

As can be seen, the addition of ZEH-containing processing aid improved parameters such as creep, t2 and elongation in all tested CB/nanohybrid ratios. The best value for M200 was obtained for a composite comprising 30 phr CB and 17 phr nanohybrid.

Further elastomeric compositions were prepared, using various ratios of Carbon black/nanohybrid, and using the same content of Struktol ZEH, and of other components of the vulcanization system.

The lists of ingredients of these elastomeric composites are presented in Table 22 below and the rheological and mechanical properties are presented in Table 23 below.

TABLE 22

| | ED86-05 | ED86-03 | ED86-02 | ED86-04 |
|---|---|---|---|---|
| SMR 10 | 90.00 | 90.00 | 90.00 | 90.00 |
| BR 1220 | 10.00 | 10.00 | 10.00 | 10.00 |
| zinc oxide | 5.00 | 5.00 | 5.00 | 5.00 |
| acid stearic | 2.00 | 2.00 | 2.00 | 2.00 |
| HAF N330 | 40.00 | 20.00 | 30.00 | 30.00 |
| RRA 206-2 | 13.00 | 20.00 | 17.00 | 17.00 |
| sulphur | 1.80 | 1.80 | 1.80 | 1.80 |
| SANTOCURE MBS | 1.80 | 1.80 | 1.80 | 1.80 |
| PERKACIT DPG | 0.40 | 0.40 | 0.40 | 0.40 |
| SANTOGARD PVI | 0.20 | 0.20 | 0.20 | 0.20 |
| STRUKTOL WB16 | 3.00 | 3.00 | 3.00 | 3.00 |
| Struktol ZEH | 1.30 | 1.30 | 1.30 | 1.30 |
| CUMAR 80 | 1.50 | 1.50 | 1.50 | 1.50 |
| | 170.00 | 157.00 | 164.00 | 164.00 |

TABLE 23

| | ED86-05 | ED86-03 | ED86-02 | ED86-04 |
|---|---|---|---|---|
| Rheological properties MDR D2000 140 C. | | | | |
| MV lb-in | 1.59 | 0.95 | 1.10 | 1.24 |
| t2 min | 2.95 | 3.22 | 2.91 | 3.06 |
| t90 min | 13.17 | 14.76 | 13.64 | 14.15 |
| t100 min | 23.82 | 23.84 | 23.83 | 23.81 |
| S2 min | 1.16 | 0.80 | 0.96 | 0.96 |
| tan | 0.083 | 0.070 | 0.078 | 0.073 |
| Mechanical properties 140 C. | | | | |
| Vulc time min | 16.00 | 17.00 | 16.00 | 17.00 |
| Hardness ShA | 75 | 70 | 73 | 74 |
| Tensile MPa | 23.22 | 26.77 | 24.50 | 24.41 |
| Elongation % | 364 | 451 | 414 | 409 |
| M100 MPa | 6.84 | 6.52 | 6.43 | 6.55 |
| M200 MPa | 12.72 | 10.50 | 11.05 | 11.22 |
| M300 MPa | 19.45 | 15.44 | 16.50 | 16.77 |
| M300/M100 | 2.84 | 2.37 | 2.57 | 2.56 |
| Work | 5.64 | 6.94 | 6.43 | 5.97 |
| Tear N/mm | 52.50 | 56.50 | 53.50 | 56.00 |
| Creep | 236.30 | 259.96 | 273.74 | 222.56 |

As can be seen, the use of CB 30 phr and nanohybrid 17 phr resulted in improvements in both creep and M200, and also in t2. It is to be noted that typically, when M200 is increased, creep is also increased, and that in the composite presented herein, M200 was shown to increase and creep decreased.

Example 9

Elastomeric Composites Containing 30 Phr Carbon Black, 17 Phr Nanohybrid and a Mercaptosilane Elastomeric composites containing Carbon black 30 phr and nanohybrid RRA 206-2, and further containing mercaptosilane Si69 at various concentrations, and the processing aid Struktol ZEH, were prepared, while further manipulating the amounts of the accelerators used.

The lists of ingredients of these elastomeric composites are presented in Table 24 below, and the rheological and mechanical properties of these elastomeric composites are presented in Table 25 below.

As can be seen therein, parameters such as t2, M200 and Work were improved by the addition of the mercaptosilane.

TABLE 24

| | ED86-04(21) | ED86-04(211) | ED86-04(262) |
|---|---|---|---|
| SMR 10 | 90.00 | 90.00 | 90.00 |
| BR 1220 | 10.00 | 10.00 | 10.00 |
| zinc oxide | 5.00 | 5.00 | 5.00 |
| acid stearic | 2.00 | 2.00 | 2.00 |
| HAF N330 | 30.00 | 30.00 | 30.00 |
| RRA 206-2 | 17.00 | 17.00 | 17.00 |
| Si 69 | — | 2.00 | 3.00 |
| sulphur | 1.80 | 1.80 | 1.80 |
| SANTOCURE MBS | 1.80 | 1.80 | — |
| MBS (KZB) | — | — | 1.80 |
| PERKACIT DPG | 0.40 | 0.40 | 0.55 |
| SANTOGARD PVI | 0.20 | 0.20 | 0.20 |
| PERKACIT TMTM | — | — | 0.15 |
| STRUKTOL WB16 | 3.00 | 3.00 | 3.00 |
| CUMAR 80 | 1.50 | 1.50 | 1.50 |
| Struktol ZEH | 1.30 | 1.30 | 1.30 |
| | 164.00 | 166.00 | 167.30 |

TABLE 25

| | ED86-04(21) | ED86-04(211) | ED86-04(262) |
|---|---|---|---|
| Rheological properties | | | |
| MV lb-in | 1.22 | 0.49 | 0.69 |
| t2 min | 3.05 | 3.10 | 4.31 |
| t90 min | 13.23 | 15.34 | 16.45 |
| S1 min | 11.21 | 12.83 | 12.59 |
| S2 min | 0.86 | 0.98 | 0.97 |
| tan | 0.077 | 0.076 | 0.077 |
| S1-mV | 9.99 | 12.34 | 11.90 |
| Mechanical properties 140 C. | | | |
| Vulc time min | 16.00 | 18.00 | 19.00 |
| Hardness ShA | 71 | 72 | 72 |
| Tensile MPa | 25.88 | 25.45 | 23.95 |
| Elongation % | 421 | 412 | 387 |
| M100 MPa | 6.27 | 5.79 | 6.99 |
| M200 MPa | 10.83 | 11.04 | 12.14 |
| M300 MPa | 16.55 | 17.06 | 17.89 |
| M300/M100 | 2.64 | 2.95 | 2.56 |
| Work | 4.09 | 4.09 | 6.18 |
| Creep | 222.20 | 263.50 | — |

Example 10

Elastomeric Composites Comprising SBR Rubber and Nanohybrids

In general, elastomeric composites are prepared by mixing an SBR rubber with modified nanoclays as described herein, and a vulcanization agent (sulfur), and optionally with other ingredients such as fillers (e.g., carbon black, zinc oxide), acid, processing aids, accelerators, etc., as indicated. The mixture is then subjected to vulcanization and rheological and mechanical measurements are performed, as described hereinabove.

The obtained modified NCs, termed herein RRA 181-1 (see, Example 1) were mixed with SBR rubber and carbon black (HAF N330), to produce SBR rubber composite. For comparison, the same rubber composite was prepared with RRA 10 (modified nanoclay not in association with an antioxidant, as described herein).

Table 26 below presents the ingredients of 5267-1 (SBR rubber composite comprising RRA 10) and of S257-2R (SBR rubber composite with RRA 181-1).

TABLE 26

| Ingredient | S267-1 | S257-2R |
|---|---|---|
| Synpol1502 | 100.00 | 100.00 |
| acid stearic | 1.00 | 1.00 |
| zinc oxide | 3.00 | 3.00 |
| HAF. N330 | 15.00 | 15.00 |
| RRA 10 | 17.50 | — |
| RRA 181-1 | — | 17.50 |
| sulfur | 1.60 | 1.60 |
| MBS | 1.30 | 1.30 |
| STRUKTOL TS35 | 1.14 | 1.14 |

Table 27 below presents the properties of the compositions S267-1 and S257-2R as measured at 150° C. Some key features are also shown in graphic form in FIG. 41.

TABLE 27

| | S267-1 | S257-2R |
|---|---|---|
| Rheological properties | | |
| mV lb-in | 0.79 | 1.06 |
| t2 min | 5.88 | 2.87 |
| t90 min | 25.43 | 23.29 |
| t100 min | 35.93 | 36.00 |
| S1 lb-in | 12.46 | 14.36 |
| tan | 0.035 | 0.032 |
| S1-mV | 11.67 | 13.30 |
| Mechanical properties | | |
| Vulc time min | 28.00 | 26.00 |
| Hardness ShA | 63 | 70 |
| Tensile MPa | 18.59 | 23.16 |
| Elongation % | 435 | 403 |
| M100 MPa | 2.69 | 5.06 |
| M200 MPa | 6.90 | 10.79 |
| M300 MPa | 11.00 | 16.66 |
| Hchg ShA | 9 | 6 |
| Tchg % | −24.15 | −15.28 |
| Echg % | −55.61 | −41.88 |
| Tear N/mm | 52.10 | 57.20 |

Figure 41:
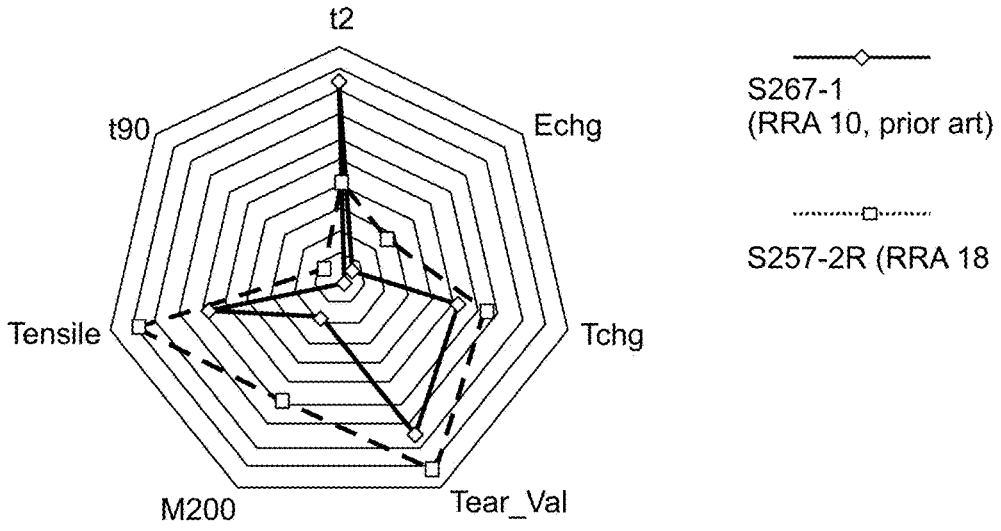
FIG. 41 is a graphical presentation of some of the physical characteristics of elastomeric composites made from NC hybrids, comparing an elastomeric composite containing a hybrid RRA 10 (solid line and diamonds), and an elastomeric composite containing the exemplary modified nanoclay according to some embodiments of the present invention, referred to herein as RRA 181-1 (broken line and squares)

As can be seen in Table 27 and FIG. 41, addition of the amine antioxidant significantly improved the tear resistance, modulus at various stretching lengths, tensile strength and hardness, compared to previously discloses organomodified nanoclays. In addition, ageing properties of the nanoclays were improved.

Without being bound by any particular theory, it is assumed that the added mercaptosilane interacts with free hydroxy groups on the modified NCs surface and may further react with silica (if added to the rubber formulation). The mercaptosilane may undergo condensation in the presence of water, and thus may contribute to the mechanical strength of the resulting rubber.

It is to be noted that the reactions to prepare the modified NCs disclosed herein are not necessarily carried out to completion, since experiments have so far shown that after 7 hours reaction with the TESPT there were no significant improvements in the mechanical properties of the products.

Without being bound by any particular theory, it is assumed that by the addition of an antioxidant to the modified nanoclays (Cloisite 15A) before the addition of mercaptosilane (e.g., TESPT; Si69), the process of increasing distance between the layers of the NC (a process begun during production of the modified NC by treating MMT with quaternary tallow ammonium salt) continues, due to the long-chain residues of the amine antioxidant. Such "spacing" of the NC layers increases the surface area of the NCs and such that the silanization, by the mercaptosilane occurs on a larger surface.

Example 11

Elastomeric Composites without Carbon Black

Elastomeric composites devoid of carbon black (CB) were produced: 596-1G comprising (prior art) RRA 10, 5266-1G comprising RRA 181-1 (see, Example 1), and S270-1G comprising RRA 189-2 (see, Example 1). Table 28 below lists the ingredients in the three elastomeric composites.

TABLE 28

| Ingredient | S96-1G | S266-1G | S270-1G |
|---|---|---|---|
| Synpol1502 | 100.00 | 100.00 | 100.00 |
| acid stearic | 1.00 | 1.00 | 1.00 |
| zinc oxide | 3.00 | 3.00 | 3.00 |
| RRA 10 | 10.00 | — | — |
| RRA 181-1 | — | 10.00 | — |
| RRA 189-2 | — | — | 10.00 |
| sulfur | 1.75 | 1.75 | 1.75 |
| Santocure TBBS | 1.00 | 1.00 | 1.00 |

Table 29 below presents the properties of the compositions 596-1G, S266-1G and S270-1G as measured at 170° C. Some key features are also shown in graphic form in FIG. 42.

TABLE 29

| | S96-1G | S266-1G | S270-1G |
|---|---|---|---|
| Rheological properties | | | |
| mV lb-in | 0.76 | 0.63 | 0.50 |
| t2 min | 2.52 | 1.27 | 1.45 |
| t90 min | 9.75 | 10.01 | 6.28 |
| S1 lb-in | 10.59 | 9.13 | 8.09 |
| tan | 0.029 | 0.023 | 0.022 |
| S1-mV | 9.83 | 8.50 | 7.59 |
| Mechanical properties | | | |
| Vulc time min | 12 | 13 | 9 |
| Hardness ShA | 48 | 57 | 55 |
| Tensile MPa | 10.40 | 10.40 | 10.61 |
| Elongation % | 519 | 327 | 454 |

TABLE 29-continued

| | S96-1G | S266-1G | S270-1G |
|---|---|---|---|
| M200 MPa | 2.39 | 5.57 | 3.70 |
| M300 MPa | 3.12 | 3.54 | 3.19 |
| Tear N/mm | 24.4 | 39.2 | 39.1 |
| Elast. Yerzley % | 79.32 | 76.44 | 76.46 |

Figure 42:
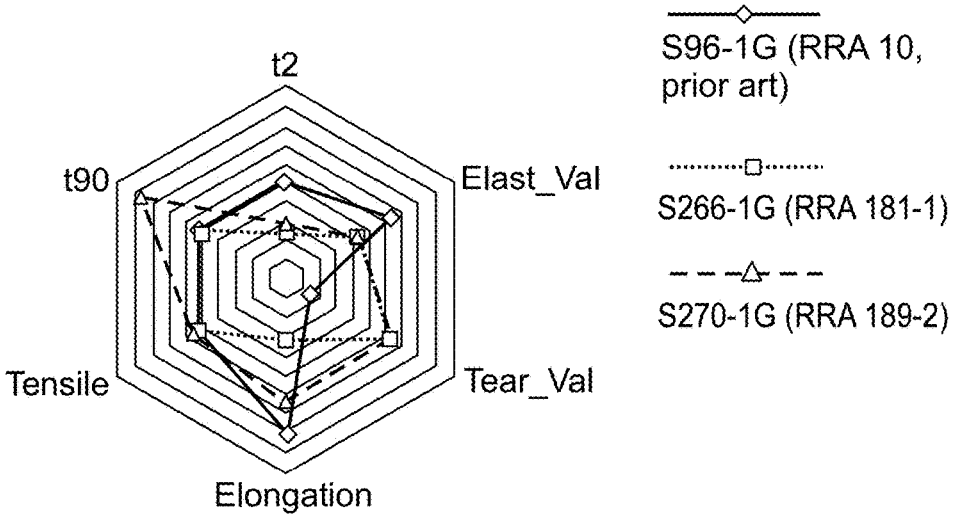
FIG. 42 is a graphical presentation of some of the physical characteristics of elastomeric composites made from NC hybrids, comparing an elastomeric composite containing a RRA 10 (solid line and diamonds), and the exemplary modified nanoclays according to some embodiments of the present invention, referred to herein as RRA 181-1 (dotted line and squares) and 189-2 (broken line and triangles)

As can be seen in Table 29 and FIG. 42, and similarly to the elastomeric composites containing CB, elastomeric composite containing the modified NCs as disclosed herein, which comprise the amine antioxidant (DDA or IPPD) exhibited improved tear resistance, shear modulus at various stretching lengths, and hardness, with no essential change in elasticity. S266-1G and S270-1G exhibited similar tear resistance, tensile strength, hardness and elasticity. The main improvement resulting from the incorporation of DDA and SBS over incorporation of IPPD was increasing scorch time (t2) and reducing of vulcanization time (DDA as amine is also a strong accelerator). However, IPPD has anti-ozone properties that may improve the wear resistance of the elastomeric composites.

Example 12

Additional Comparative Elastomeric Composites Devoid of CB

Additional exemplary elastomeric composites were prepared as described in Example 11 hereinabove, while replacing the accelerator TBBS by MBS.

The modified RRA 190-5, which was prepared while using MBS and into which silica was added during preparation was compared with RRA 50R, previously reported modified NCs into which silica was also added during preparation (see, Example 1 hereinabove).

Table 30 below lists the ingredients used to prepare the elastomeric composites termed herein S278-1G, that includes the previously reported RRA 50R, S274-5G, which includes RRA 190-5.

TABLE 30

| Ingredient | S278-1G | S274-5G |
|---|---|---|
| Synpol1502 | 100.00 | 100.00 |
| acid stearic | 1.00 | 1.00 |
| zinc oxide | 3.00 | 3.00 |
| HAF. N330 | 15.00 | 15.00 |
| RRA 50R | 10.00 | — |
| RRA 190-5 | — | 10.00 |
| sulfur | 1.75 | 1.75 |
| STRUKTOL MBS | 1.00 | 1.00 |

Figure 43:
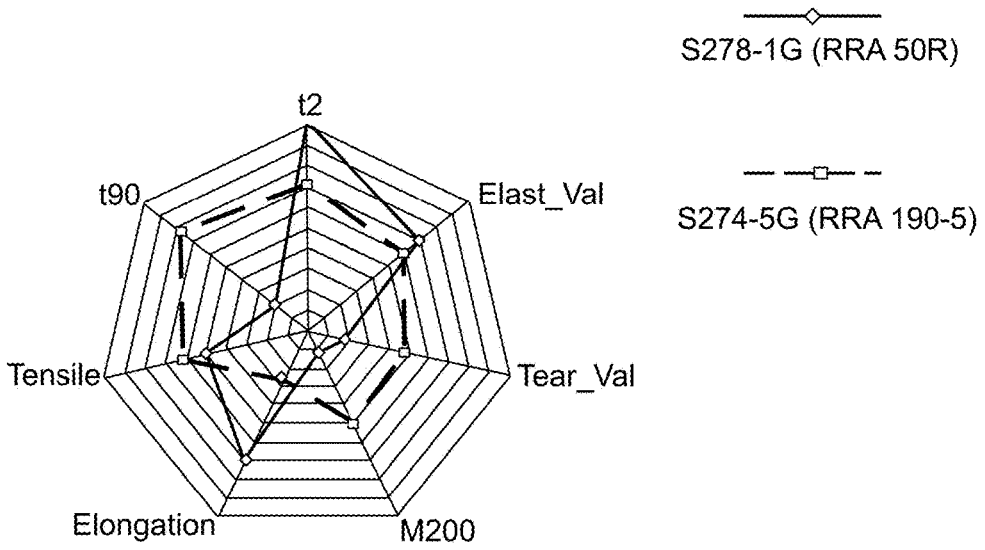
FIG. 43 is a graphical presentation of some of the physical characteristics of elastomeric composites made from NC hybrids, comparing an elastomeric composite containing a hybrid RRA 50R (S278-1G, solid line and diamonds), and an elastomeric composite containing an exemplary modified nanoclay according to some embodiments of the present invention, referred to herein as RRA 190-5 (S274-5G, broken line and squares)

Table 31 below presents the properties of the compositions S278-1G and S274-5G as measured at 150° C. Some key features are also shown in graphic form in FIG. 43.

TABLE 31

| | S278-1G | S274-5G |
|---|---|---|
| Rheological properties | | |
| mV lb-in | 0.55 | 0.61 |
| t2 min | 5.14 | 3.53 |
| t90 min | 23.98 | 21.12 |
| tan | 0.023 | 0.022 |
| S1-mV | 8.69 | 7.71 |
| Mechanical properties | | |
| Vulc time min | 26 | 24 |
| Hardness ShA | 52 | 55 |

TABLE 31-continued

| | S278-1G | S274-5G |
|---|---|---|
| Tensile MPa | 9.94 | 11.08 |
| Elongation % | 538 | 453 |
| M200 MPa | 2.48 | 3.11 |
| M300/M100 | 2.43 | 3.11 |
| Tear N/mm | 35.72 | 44.40 |
| Elast. Yerzley % | 80.42 | 78.89 |

As can be seen in Table 31, the elastomeric composites made with the accelerant MBS exhibited similar features to those observed with elastomeric composites made with the accelerant TBBS, namely, a general improvement in physical properties as a result of using the modified nanoclays as disclosed herein was observed, particularly a significant improvement of tear resistance, tensile strength and modulus, while retaining elasticity.

It is to be noted that in the modified nanoclays used in forming the elastomeric composite S274-5G, RRA 190-5, an accelerator SBS and a filler $SiO_2$ were added to the nanoclays composition-of-matter. The role of $SiO_2$ addition is discussed hereinabove. It is further assumed that when an accelerator is added during nanoclays formation, the properties of an elastomeric composite containing such nanoclays are further improved.

Example 13

Comparative Elastomeric Composites Containing Modified NCs Prepared in the Presence or Absence of an Acid The modified NCs RRA 181-1 and RRA189-2, described in Example 1 hereinabove, were prepared using acetic acid as a catalyst for the reaction of the mercaptosilane with the NCs. However, RRA 190-5 was prepared without use of the acetic acid or any other acid catalyst. Similarly, RRA 189-4 (see, Example 1) differs from RRA-189-2 (see, Example 1) by the absence of addition of an acid catalyst (acetic acid) during NCs modification.

The effect of the presence of an acid catalyst during modified NCs preparation on the properties of elastomeric composites containing the modified NCs is presented herein by comparing various elastomeric composites containing RRA-189-2 or RRA-189-4.

Table 32 lists the ingredients of the non-CB elastomeric composites S270-5G and S270-7G.

TABLE 32

| Ingredient | S270-5G | S270-7G |
|---|---|---|
| Synpol1502 | 100.00 | 100.00 |
| acid stearic | 1.00 | 1.00 |
| zinc oxide | 3.00 | 3.00 |
| RRA 189-2 | 8.00 | — |
| RRA 189-4 | — | 8.00 |
| sulfur | 1.75 | 1.75 |
| SANTOCURE MBS | 1.00 | 1.00 |

Table 33 presents the properties of the elastomeric composites S270-5G and S270-7G, as measured at 150° C.

TABLE 33

| | S270-5G | S270-7G |
|---|---|---|
| Rheological properties | | |
| mV lb-in | 0.64 | 0.64 |
| t2 min | 3.47 | 3.54 |
| t90 min | 15.57 | 14.63 |
| tan | 0.021 | 0.022 |
| S1-mV | 7.38 | 7.56 |
| Mechanical properties | | |
| Vulc time min | 18 | 17 |
| Hardness ShA | 55 | 54 |
| Tensile MPa | 10.18 | 11.04 |
| Elongation % | 438 | 478 |
| M200 MPa | 3.58 | 3.53 |
| M300/M100 | 3.27 | 3.43 |
| Tear N/mm | 34.70 | 35.70 |

Table 34 lists the ingredients of CB-containing elastomeric composites S268-2 (containing RRA 189-2) and S269-2 (containing RRA 189-4).

TABLE 34

| Ingredient | S268-2 | S269-2 |
|---|---|---|
| Synpol1502 | 100.00 | 100.00 |
| acid stearic | 1.00 | 1.00 |
| zinc oxide | 3.00 | 3.00 |
| HAF N330 | 15.00 | 15.00 |
| RRA 189-2 | 25.54 | — |
| RRA 189-4 | — | 25.54 |
| sulfur | 1.90 | 1.90 |
| SANTOCURE MBS | 1.00 | 1.00 |
| Structol TS35 | 1.14 | 1.14 |

Structol TS35 is a dispersant.

Table 35 presents the properties of the elastomeric composites S268-2 and S269-2, as measured at 150° C.

TABLE 35

| Rheological properties | S268-2 | S269-2 |
|---|---|---|
| mV lb-in | 0.95 | 0.89 |
| t2 min | 2.22 | 2.42 |
| t90 min | 23.36 | 23.95 |
| tan | 0.031 | 0.034 |
| S1-mV | 13.73 | 13.36 |
| Mechanical properties | S270-5G | S270-7G |
| Vulc time min | 26 | 26 |
| Hardness ShA | 72 | 70 |
| Tensile MPa | 23.89 | 24.70 |
| Elongation % | 407 | 460 |
| M200 MPa | 12.28 | 10.72 |
| M300/M100 | 2.66 | 2.79 |
| Tear N/mm | 61.30 | 57.90 |

Table 36 lists the ingredients of elastomeric composites S269-11 (containing RRA 189-2) and S269-21 (containing RRA 189-4), both containing CB and silica.

TABLE 36

| Ingredient | S269-11 | S269-21 |
|---|---|---|
| Synpol1502 | 100.00 | 100.00 |
| acid stearic | 1.00 | 1.00 |
| zinc oxide | 3.00 | 3.00 |
| HAF N330 | 15.00 | 15.00 |
| RRA 189-2 | 25.54 | — |

TABLE 36-continued

| Ingredient | S269-11 | S269-21 |
|---|---|---|
| RRA 189-4 | — | 25.54 |
| PERKASIL KS 408 | 10.00 | 10.00 |
| sulfur | 1.90 | 1.90 |
| SANTOCURE MBS | 1.00 | 1.00 |
| Structol TS35 | 1.14 | 1.14 |

Table 37 presents the properties of the elastomeric composites S269-11 and S269-21, as measured at 150° C.

TABLE 37

| Rheological properties | S268-2 | S269-2 |
|---|---|---|
| mV lb-in | 1.66 | 1.63 |
| t2 min | 1.94 | 2.15 |
| t90 min | 20.16 | 19.94 |
| tan | 0.049 | 0.050 |
| S1-mV | 13.88 | 13.70 |
| Mechanical properties | S270-5G | S270-7G |
| Vulc time min | 23 | 23 |
| Hardness ShA | 71 | 71 |
| Tensile MPa | 24.00 | 25.30 |
| Elongation % | 448 | 412 |
| M200 MPa | 9.51 | 11.42 |
| M300/M100 | 3.48 | 3.38 |
| Tear N/mm | 56.90 | 69.60 |

The data presented in Tables 33-37 indicate that in some composites, adding acetic acid during preparation of modified NCs may improve the elastomeric composites; however, in other compositions omitting the acetic acid may actually overall improve the properties of the elastomeric composites. An improvement of tensile strength and tear resistance is apparent in the elastomeric composites S270-7G and S269-21, in which the modified NC is prepared without acetic acid (RRA 189-4). It is noted that a particularly high tear threshold, which is known as suitable for e.g., tire applications, was observed for S269-21, despite the low CB content of the composite (15 phr).

Example 14

Elastomeric Composites Containing Modified NCs Prepared with and without Silica The effect of the addition of silica during preparation of the modified NCs as described herein can be seen while comparing the properties of S270-7G, which contain RRA 190-5 (see, Table 33) and S274-5G, which contain RRA 189-4 (see, Table 31). As described and discussed hereinabove, silica is added during the preparation of RRA 190-5.

S274-5G, containing RRA 190-5, has a significantly higher tear threshold, and higher tensile strength, compared with S270-7G, indicating that the addition of silica during the preparation of modified NCs as described herein beneficially affect the strength of elastomeric composites containing the modified NCs as described herein.

Example 15

Elastomeric Composites Containing Modified NCs Prepared Using Various Solvents The reaction of preparing the modified NCs as described herein was initially performed in acetone as a solvent, and the effect of replacing the acetone with other organic solvents or with a water:organic solvent mixture as studied.

Two similarly modified NCs were prepared as generally described hereinabove, one in which the solvent was chloroform (RRA 194-1, see, Example 1), and another in which the solvent was a mixture of isopropanol (IPA) and water (RRA 202-1, see, Example 1). All other ingredients and conditions used for preparing these NCs were the same.

Elastomer composites were prepared using these NCs, as depicted in Table 38.

TABLE 38

| Ingredient | S298-1G | S311-4G |
|---|---|---|
| Synpol1502 | 100.00 | 100.00 |
| acid stearic | 1.00 | 1.00 |
| zinc oxide | 3.00 | 3.00 |
| RRA 194-1 | 10.00 | — |
| RRA 202-1 | — | 10.00 |
| sulfur | 1.75 | 1.75 |
| SANTOCURE MBS | 1.00 | 1.00 |

Table 39 presents the properties of the elastomeric composites S298-1G and S311-4G, as measured at 150° C. Some key features are also shown in graphic form in FIG. 44, further comparing to S274-5G, containing RRA 190-5.

TABLE 39

| | S298-1G | S311-4G |
|---|---|---|
| Rheological properties | | |
| mV lb-in | 0.76 | 0.86 |
| t2 min | 3.79 | 3.67 |
| t90 min | 17.70 | 14.48 |
| tan | 0.028 | 0.001 |
| S1-mV | 9.90 | 7.69 |
| Mechanical properties | | |
| Vulc time min | 20.00 | 17.00 |
| Hardness ShA | 55 | 56 |
| Tensile MPa | 12.36 | 11.04 |
| Elongation % | 427 | 420 |
| M100 MPa | 2.45 | 2.43 |
| M200 MPa | 4.91 | 4.81 |
| M300 MPa | 7.87 | 7.39 |
| M300/M100 | 3.21 | 3.04 |
| Tear N/mm | 76.16 | 76.26 |

Figure 44:
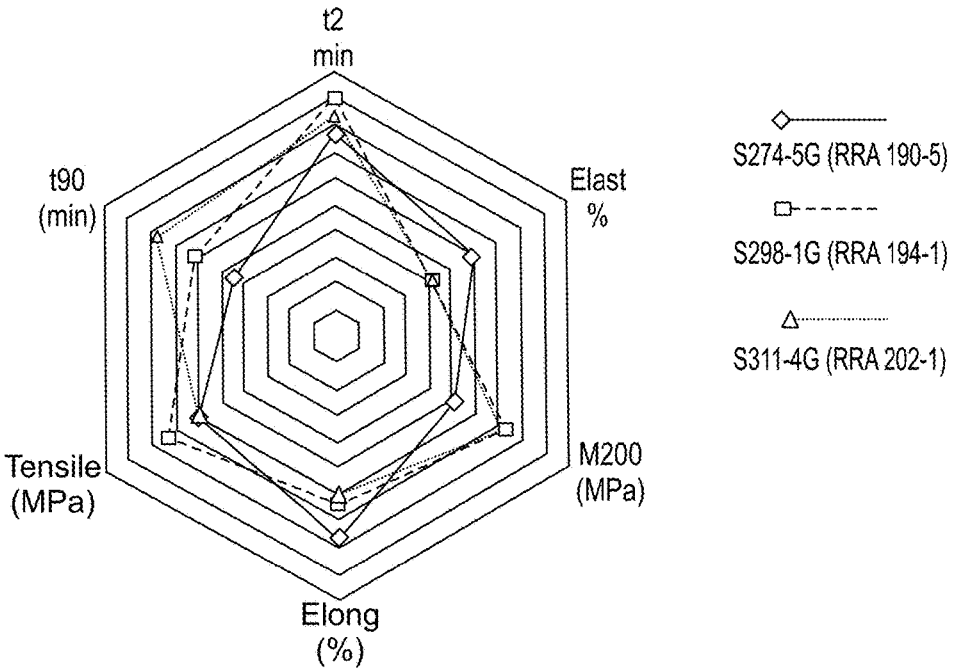
FIG. 44 is a graphical presentation of some of the physical characteristics of elastomeric composites made from NC hybrids, comparing elastomeric composites containing RRA 190-5 (diamonds and solid line), RRA 194-1 (S298-1G, squares and broken line) and RRA 202-1 (S331-4G, triangles and dotted line)

As can be seen in Table 39 and FIG. 44, the elastomeric composites S298-1G and S311-4G exhibit similar properties. These elastomeric composites, which are devoid of CB, were further comparable in their properties with S274-5G (see, Table 31 and FIG. 43), which contains CB and nanoclays prepared in acetone, and MBS and silica were added during the NCs preparation (see, RRA 190-5 in Example 1 hereinabove). Thus, since it is shown that silica appears to augment the strength of the elastomeric composites, and since the hybrids in S298-1G and S311-4G do not contain silica, it appears that using a mixture of IPA and water or chloroform in preparing the NCs is superior to acetone. It is noted that both IPA and chloroform are much less of a fire hazard compared with acetone.

The effect of the solvent used for preparing the modified nanoclays was further studied. RRA 194-2 (see, Example 1), was prepared using a chloroform:acetone (2:1) mixture, and RRA 195-1 (see, Example 1), was prepared using a water: acetone (2:1) mixture, and both were prepared using comparable conditions and ingredients as RRA 194-2 and RRA 202-1.

Table 40 below lists the properties of elastomeric composites, S298-2G and S302-1G, containing the nanoclays RRA 194-2 and RRA 195-1, respectively.

TABLE 40

| | S298-2G | S302-1G |
|---|---|---|
| Rheological properties | | |
| mV lb-in | 0.76 | 0.82 |
| t2 min | 3.05 | 4.00 |
| t90 min | 17.17 | 20.85 |
| tan | 0.025 | 0.031 |
| S1-mV | 10.64 | 10.39 |
| Mechanical properties | | |
| Vulc time min | 20.00 | 23.00 |
| Hardness ShA | 56 | 55 |
| Tensile MPa | 10.70 | 9.09 |
| Elongation % | 387 | 403 |
| M100 MPa | 2.60 | 2.08 |
| M200 MPa | 5.06 | 3.95 |
| M300 MPa | 7.86 | 6.04 |
| M300/M100 | 3.02 | 2.90 |
| Elast. Yerzley % | 78.05 | 78.35 |

Figure 45:
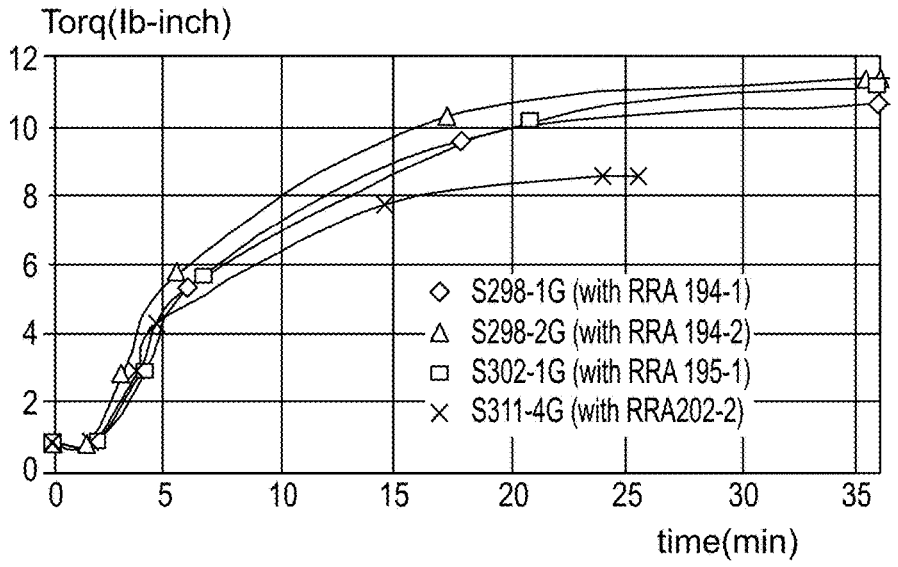
FIG. 45 presents comparative plots showing data recorded by a rheometer (Alpha Technologies MDR2000) at 150° C. for exemplary elastomeric composites according to some embodiments of the present invention, made from the nanoclay hybrids RRA 194-1 (S298-1G, diamonds), RRA 194-2 (S298-2G, triangles), and RRA 195-1 (S302-1G, squares) and RRA 202-1 (S311-4G, crosses)
Figure 46:
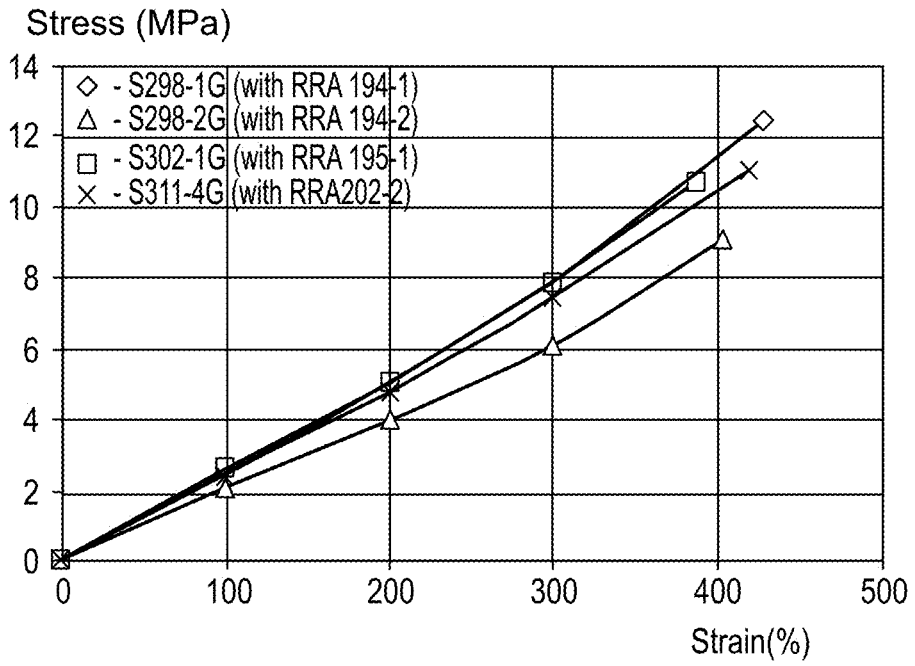
FIG. 46 presents comparative stress-strain curves recorded for exemplary elastomeric composites according to some embodiments of the present invention, made from the nanoclay hybrids RRA 194-1 (S298-1G, diamonds), RRA 194-2 (S298-2G, triangles), and RRA 195-1 (S302-1G, squares) and RRA 202-1 (S311-4G, crosses).

FIG. 45 presents comparative plots showing readings from a rheometer (Alpha Technologies MDR2000) at 150° C. as obtained for these elastomeric composites (containing RRA 194-2 and RRA 195-1), and of the elastomeric composites S209-1G and S311-4G, containing RRA 194-2 and RRA 202-1, respectively). FIG. 46 presents comparative stress-strain curves of these elastomeric composites.

It can be seen from the obtained data that all elastomeric composites containing modified nanoclays prepared while using a solvent other than acetone exhibited similar properties as those containing RRA 190-5, as discussed hereinabove, without using a filler. An improvement in vulcanization time was also observed for these elastomeric composites.

Thus, it is shown that production of modified nanoclays as described herein, while using in solvent mixtures containing water, such as the a mixture of IPA:water and acetone:water, may be preferable over use of acetone as a solvent.

Example 15

An circular disk of ED86-04 material (as described elsewhere in this document), the disk being of approximately 55 mm diameter, and approximately 3 mm thick was attached to a disk metal rigid portion by tightly screwing (using 12 screws) a metal ring against the metal rigid portion, the elastic portion held therebetween. The chamber formed between the metal rigid portion and the elastic portion was filled with 40 ml of liquid and a Mindman™ pressure gauge attached to the rigid portion, measured a pressure inside the chamber of approximately 6 bar.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device for dispensing a material under pressure, comprising:

at least one elastic portion defining at least one wall of a chamber defining a volume within which said material is to be contained;

at least one non-elastic portion coupled to said at least one elastic portion and affecting a geometry of one or more of: (i) said at least one elastic portion, and (ii) said chamber; and an outlet for dispensing said material out from said chamber;

wherein, at least when the material is contained within said chamber, said at least one elastic portion is stretched so as to apply inwardly directed compressive forces and urge a reduction in the volume of said chamber;

wherein said at least one elastic portion is still stretched to apply inwardly directed compressive forces when said chamber is empty of the material, wherein at least when said chamber is empty, said outlet, said at least one elastic portion and said at least one non-elastic portion are parallel to a longitudinal axis of said chamber, and wherein when said chamber is filled with said material, at least a portion of said at least one elastic portion and said at least one non-elastic portion moves perpendicular to said longitudinal axis.

2. The device of claim 1, wherein said at least one non-elastic portion is rigid.

3. The device according to claim 2, comprising the outlet from said chamber defined in said at least one elastic portion.

4. The device according to claim 3, further comprising:

a valve attached at said outlet;

wherein upon opening said valve, material is dispensed from said chamber.

5. The device according to claim 2, wherein said outlet is disposed on said rigid portion.

6. The device according to claim 5, wherein said chamber applies a compressive force on said material in a direction which is within 20 degrees of a perpendicular to said outlet, when the material is dispensed from said chamber through said outlet.

7. The device according to claim 2, wherein said chamber is enclosed by said at least one elastic portion and said at least one rigid portion.

8. The device according to claim 2, wherein said at least one elastic portion conforms to at least most of a chamber wall defined by said at least one rigid portion, when said at least one elastic portion is at a most relaxed state thereof.

9. The device according to claim 8, wherein said elastic portion is not flat when relaxed.

10. The device of claim 2, comprising a base on which said device stands;

wherein said at least one elastic portion is configured to expand, when the chamber is filled parallel to said base.

11. The device according to claim 2, wherein said chamber is defined by at least two elastic portions facing each other and wherein said at least one rigid portion maintains a shape of said chamber along at least one dimension thereof.

12. The device according to claim 11, wherein said rigid portion is reinforced.

13. The device according to claim 11, wherein said at least two elastic portions approach each other to less than a distance of 2 mm over at least 50% of their area when said volume is empty.

14. The device according to claim 11, wherein said at least one rigid portion defines a volume for said at least two elastic portions to expand into without extending past a bounding geometry defined by at least one said rigid portion, said volume being at least 3 millimeters in a direction of expansion of at least one of said at least two elastic portions.

15. The device according to claim 11, wherein said at least one rigid portion is provided in two parts which clamp said at least two elastic portions therebetween.

16. The device according to claim 2, wherein said at least one elastic portion has different resistance to stretching in different directions along a wall of said chamber.

17. The device according to claim 2, wherein at least one portion of said at least one elastic portion is non-planar.

18. The device of claim 17, wherein said at least one elastic portion has a varying thickness when at rest.

19. The device of claim 2, wherein a portion of at least one elastic portion is reinforced with a non-expanding element.

20. The device according to claim 2, wherein one or more of said at least one elastic portion and said at least one non-elastic portion includes an impermeable coating.

21. The device according to claim 2, comprising at least one impermeable layer between said material and said at least one elastic portion.

22. The device according to claim 2, wherein said at least one rigid portion maintains a geometry of said chamber along at least one dimension thereof.

23. The device according to claim 2, wherein said chamber is configured to apply a pressure of at least 6 bar.

24. The device according to claim 1, comprising the outlet from said chamber defined in said at least one non-elastic portion.

25. The device of claim 1, wherein said non-elastic portion is flexible.

26. The device according to claim 1, wherein said at least one non-elastic portion comprises two rigid portions, wherein said elastic portion connects said two rigid portions at perimeters thereof such that when said chamber is filled with said material said elastic portion stretches to increase a separation between said two rigid portions.

27. The device according to claim 1, wherein a thickness of said at least one elastic portion is from about 0.5 mm to about 7 mm.

* * * * *